US010415276B2

(12) United States Patent
Bussis et al.

(10) Patent No.: US 10,415,276 B2
(45) Date of Patent: Sep. 17, 2019

(54) GESTURE ACCESS AND OBJECT IMPACT AVOIDANCE SYSTEM FOR A MOTOR VEHICLE

(71) Applicant: ADAC Plastics, Inc., Grand Rapids, MI (US)

(72) Inventors: Ryan Bussis, Grand Rapids, MI (US); Anne Adamczyk, Grand Rapids, MI (US); James Jetton, Grand Rapids, MI (US)

(73) Assignee: ADAC Plastics, Inc., Grand Rapids, MI (US)

( * ) Notice: Subject to any disclaimer, the term of this patent is extended or adjusted under 35 U.S.C. 154(b) by 0 days.

(21) Appl. No.: 16/164,570

(22) Filed: Oct. 18, 2018

(65) Prior Publication Data

US 2019/0048624 A1 Feb. 14, 2019

Related U.S. Application Data

(63) Continuation-in-part of application No. 15/262,647, filed on Sep. 12, 2016, now abandoned, and a (Continued)

(51) Int. Cl.
*E05F 11/00* (2006.01)
*E05B 81/78* (2014.01)
(Continued)

(52) U.S. Cl.
CPC ..... *E05B 81/78* (2013.01); *E05B 81/77* (2013.01); *E05B 85/16* (2013.01); *G08C 23/04* (2013.01)

(58) Field of Classification Search
CPC ..... E05B 81/78; E05B 81/77; E05B 85/16; G08C 23/04; E05F 15/40; E05F 15/72; E05F 15/70; E05Y 2900/531
(Continued)

(56) References Cited

U.S. PATENT DOCUMENTS 5,682,135 A 10/1997 Labonde
6,086,131 A 7/2000 Bingle et al.
(Continued)

FOREIGN PATENT DOCUMENTS

DE 102016007388 A1 12/2016
EP 2082908 7/2000
(Continued)

OTHER PUBLICATIONS

Search Report and Written Opinion for International Patent Application No. PCT/US2016/066623 dated Apr. 3, 2017.
(Continued)

*Primary Examiner* — Chi Q Nguyen
(74) *Attorney, Agent, or Firm* — Barnes & Thornburg LLP

(57) ABSTRACT

A gesture access and object impact avoidance system for a motor vehicle, includes a radar signal assembly configured to be mounted to the motor vehicle and to transmit radar signals and detect reflected radar signals, and a processor to operate in (i) a gesture access mode, when the motor vehicle is not moving or is disabled from moving, by controlling an access closure actuator to lock, unlock, open or close an access closure of the motor vehicle if an object is within a sensing region of the radar signal assembly and exhibits a predefined gesture, and (ii) an object impact avoidance mode, when the motor vehicle is moving or enabled to move, by activating a warning device or controlling an impact avoidance device actuator if an object is within a predefined distance of the radar signal assembly.

20 Claims, 32 Drawing Sheets

Related U.S. Application Data continuation-in-part of application No. 15/378,823, filed on Dec. 14, 2016, now abandoned, and a continuation of application No. PCT/US2018/037517, filed on Jun. 14, 2018.

(60) Provisional application No. 62/217,842, filed on Sep. 12, 2015, provisional application No. 62/266,917, filed on Dec. 14, 2015.

(51) Int. Cl.
*E05B 85/16* (2014.01)
*G08C 23/04* (2006.01)

(58) Field of Classification Search
USPC ..... 49/324, 381
See application file for complete search history.

(56) References Cited

U.S. PATENT DOCUMENTS

| | | | | |
|---|---|---|---|---|
| 6,676,186 | B2 | 1/2004 | Greif | |
| 8,333,492 | B2 | 12/2012 | Dingman | |
| 8,643,628 | B1 | 2/2014 | Eriksson et al. | |
| 8,868,299 | B2 | 10/2014 | Kroemke | |
| 8,917,239 | B2 | 12/2014 | Eriksson et al. | |
| 9,001,087 | B2 | 4/2015 | Eriksson et al. | |
| 9,102,266 | B2 | 8/2015 | Dingman | |
| 9,164,625 | B2 | 10/2015 | Holmgren et al. | |
| 9,394,737 | B2 | 7/2016 | Gehin | |
| 9,446,739 | B2 | 9/2016 | Herthan | |
| 9,470,033 | B1 | 10/2016 | Dudar | |
| 9,598,003 | B2 | 3/2017 | Dingman | |
| 9,646,436 | B1 | 5/2017 | Campbell et al. | |
| 9,670,702 | B2 | 6/2017 | Sugita | |
| 9,694,735 | B2 | 7/2017 | Sheehan | |
| 9,739,082 | B2 | 8/2017 | Kraus | |
| 9,745,778 | B1 | 8/2017 | Bingle | |
| 9,776,556 | B2 | 10/2017 | Dingman | |
| 9,812,017 | B2 | 11/2017 | Krauss | |
| 9,892,583 | B2 | 2/2018 | Bingle | |
| 9,922,472 | B2 | 3/2018 | Jergess | |
| 9,956,940 | B2 | 5/2018 | Ette | |
| 10,137,363 | B2 * | 11/2018 | Parshionikar | G06K 9/0053 |
| 2001/0011836 | A1 | 8/2001 | Grey | |
| 2001/0052839 | A1 | 12/2001 | Nahata et al. | |
| 2004/0031908 | A1 | 2/2004 | Neveux et al. | |
| 2006/0226953 | A1 | 10/2006 | Shelley | |
| 2006/0232379 | A1 | 10/2006 | Shelly | |
| 2008/0068145 | A1 | 3/2008 | Weghaus et al. | |
| 2009/0302635 | A1 | 12/2009 | Nakamura | |
| 2010/0106182 | A1 | 4/2010 | Patel | |
| 2011/0196568 | A1 | 8/2011 | Nickolaou et al. | |
| 2011/0309912 | A1 | 12/2011 | Muller | |
| 2012/0200486 | A1 | 8/2012 | Meinel et al. | |
| 2012/0312956 | A1 | 12/2012 | Chang et al. | |
| 2014/0156112 | A1 | 6/2014 | Lee | |
| 2014/0169139 | A1 | 6/2014 | Lee | |
| 2014/0204599 | A1 | 7/2014 | Miura | |
| 2015/0009062 | A1 | 1/2015 | Hethan | |
| 2015/0069249 | A1 | 3/2015 | Alameh et al. | |
| 2015/0248796 | A1 | 9/2015 | Iyer et al. | |
| 2015/0277848 | A1 * | 10/2015 | Grothe | G06F 3/017 340/4.42 |
| 2016/0096509 | A1 | 4/2016 | Ette | |
| 2016/0300410 | A1 | 10/2016 | Jones et al. | |
| 2016/0376819 | A1 | 12/2016 | Bingle | |
| 2017/0074009 | A1 | 3/2017 | Banter | |
| 2017/0138097 | A1 | 5/2017 | Patel | |
| 2017/0152697 | A1 | 6/2017 | Dehelean | |
| 2017/0158115 | A1 | 6/2017 | Linden | |
| 2017/0166166 | A1 | 6/2017 | Lindic | |
| 2017/0234054 | A1 * | 8/2017 | Kumar | E05F 15/40 49/324 |
| 2017/0369016 | A1 * | 12/2017 | Gurghian | E05F 15/40 |
| 2018/0065542 | A1 | 3/2018 | Dingman | |
| 2018/0178788 | A1 * | 6/2018 | Ikedo | B60W 30/0956 |
| 2018/0238098 | A1 * | 8/2018 | Rhode | E05F 15/73 |
| 2018/0238099 | A1 | 8/2018 | Schatz et al. | |
| 2019/0128040 | A1 | 5/2019 | Mitchell | |
| 2019/0162010 | A1 | 5/2019 | Rafrafi et al. | |
| 2019/0162821 | A1 | 5/2019 | Rafrafi et al. | |
| 2019/0162822 | A1 | 5/2019 | Rafrafi et al. | |

FOREIGN PATENT DOCUMENTS

| | | | |
|---|---|---|---|
| EP | 2738337 | A1 | 6/2014 |
| KR | 1020120032145 | A1 | 4/2012 |
| WO | 2009152956 | | 12/2009 |

OTHER PUBLICATIONS

Search Report and Written Opinion for International Patent Application No. PCT/US2018/037517 dated Mar. 11, 2019.

* cited by examiner

GESTURE ACCESS AND OBJECT IMPACT AVOIDANCE SYSTEM FOR A MOTOR VEHICLE

CROSS-REFERENCE TO RELATED APPLICATIONS

This application is a continuation-in-part of U.S. patent application Ser. No. 15/262,647, filed Sep. 12, 2016, which claims the benefit of and priority to U.S. Provisional Patent Application Ser. No. 62/217,842, filed Sep. 12, 2015, the disclosures of which are incorporated herein by reference in their entireties. This application is also a continuation-in-part of U.S. patent application Ser. No. 15/378,823, filed Dec. 14, 2016, which claims the benefit of and priority to U.S. Provisional Patent Application Ser. No. 62/266,917, filed Dec. 14, 2015, the disclosures of which are incorporated herein by reference in their entireties. This application also claims the benefit of and priority to PCT/US2018/037517, filed Jun. 14, 2018, the disclosure of which is incorporated herein by reference in its entirety.

FIELD OF THE DISCLOSURE

The present disclosure relates generally to motor vehicle-mounted wireless access systems and object impact avoidance systems and, more particularly, to such systems in which transmitted and reflected wireless signals are used to detect object motion and in which activation of one or more motor vehicle actuators, of one or more audible devices and/or of one or more illumination devices is controlled based on the detected motion.

BACKGROUND

Many vehicles today are equipped with a passive entry system, or "PES." In some PES implementations, a key fob communicates with a computer of the motor vehicle, and the motor vehicle computer operates to automatically unlock one or more door locks of the motor vehicle in response to detection of the key fob being in close proximity to the motor vehicle. This allows an operator of the vehicle to approach the vehicle and open the door without having to manually unlock the door with a key or to manually press a button on the key fob. In some such applications, the motor vehicle computer is also configured to automatically lock the vehicle in response to detection of the key fob being outside of the close proximity of the motor vehicle.

Another known type of hands-free vehicle access or entry system employs an infrared ("IR") detector assembly. Typically, such systems may use an active near infrared arrangement including multiple IR LEDs and one or more sensors in communication with a computer or other circuitry. The computer is typically operable in such an assembly to calculate the distance of an object from the assembly by timing the interval between emission of IR radiation and reception by the sensor(s) of at least a portion of the emitted IR radiation that is reflected by the object back to the sensor(s), and then interpreting the timing information to determine movement of the object within the IR field. Exemplary IR movement recognition systems are disclosed in US Patent Application Publication 20120200486, US Patent Application Publication 20150069249, and US Patent Application Publication 20120312956, and US Patent Application Publication 20150248796, the disclosures of which are incorporated herein by reference in their entireties.

DESCRIPTION OF THE ILLUSTRATIVE EMBODIMENTS

For the purposes of promoting an understanding of the principles of this disclosure, reference will now be made to a number of illustrative embodiments shown in the attached drawings and specific language will be used to describe the same.

This disclosure relates to object detection system mountable to or carried by a motor vehicle in any of various locations at or about the motor vehicle. In some embodiments, the object detection system may implemented solely in the form of a hands-free vehicle access system. In some such embodiments, one or more illumination devices may be implemented to provide visual feedback of objects being detected. In other embodiments, the object detection system may be implemented in the form of a combination hands-free vehicle access system and an object impact avoidance system. In such embodiments, the object detection system operates in a hands-free vehicle access mode under some conditions and in an object impact avoidance mode under other operating conditions.

Figure 1:
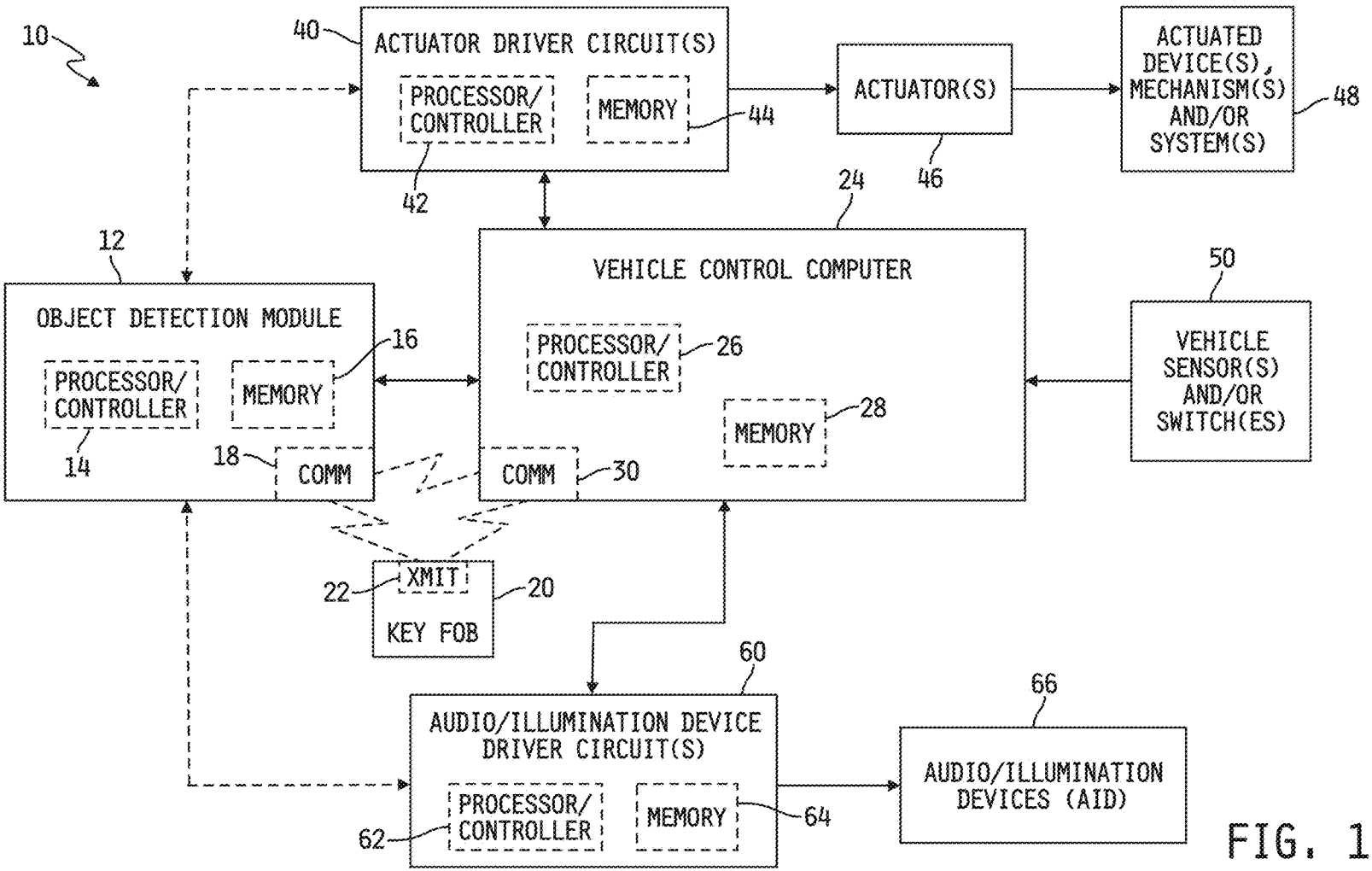
FIG. 1 is a simplified block diagram schematic of an embodiment of a gesture access and object impact avoidance system for a motor vehicle.

Referring now to FIG. 1, an embodiment of an object detection system 10 is shown. The object detection system 10 illustratively includes an object detection module 12 having at least one processor or controller 14, at least one memory 16 and a communication circuit 18 for receiving vehicle access signals wirelessly transmitted by a transmitter 22 of a key fob 20. The object detection module 12 further illustratively includes object detection circuitry, and various example embodiments of such object detection circuitry will be described below with respect to FIGS. 2, 6A, 7 and 8.

In some embodiments, the object detection system 10 may include a vehicle control computer 24 electrically connected to the object detection module 12 and having at least one processor or controller 26 and at least one memory 28. In some embodiments, the vehicle control computer 24 may include a communication circuit 30 for receiving the vehicle access signals wirelessly transmitted by the transmitter 22 of the key fob 20. In some embodiments, the communication circuit 18 of the object detection module 12 and the communication circuit 30 of the vehicle control computer 24 may be configured to wirelessly communicate with one another in a conventional manner so that the processors 14, 26 may conduct information transfer wirelessly via the communication circuits 18, 30.

In some embodiments, the object detection system 10 may include one or more actuator driver circuits 40 for controllably driving one or more corresponding actuators 46. In some such embodiments, the one or more actuator driver circuits 40 may include at least one processor or controller 42 and at least one memory 44 in addition to one or more conventional driver circuits, although in other embodiments the processor or controller 42 and the memory 44 may be omitted. In some embodiments, one, some or all of the one or more driver circuits 40 may be electrically connected to the vehicle control computer 24 so that the processor or controller 26 of the vehicle control computer 24 may control the operation of one or more actuators 46 via control of such one or more driver circuits 40. Alternatively or additionally, at least one, some or all of the one or more driver circuits 40 may be electrically connected to the object detection module 12 as illustrated by dashed-line connection in FIG. 1, so that the processor or controller 14 of the object detection module 12 may control operation of one or more actuators 46 via control of such one or more driver circuits 40. In any case, the one or more actuators 46 are operatively coupled to one or more conventional, actuatable devices, mechanisms and/or systems 48. Examples of such actuators and actuatable devices, mechanisms and/or systems may include, but are not limited to, one or more electronically controllable motor vehicle access closure locks or locking systems, one or more electronically controllable motor vehicle access closure latches or latching systems, an automatic (i.e., electronically controllable) engine ignition system, an automatic (i.e., electronically controllable) motor vehicle braking system, an automatic (i.e., electronically controllable) motor vehicle steering system, an automated (i.e., electronically controllable) motor vehicle driving system (e.g., "self-driving" or "autonomous driving" system), and the like.

In some embodiments, the object detection system 10 may include one or more conventional vehicle operating parameter sensors, sensing systems and/or switches 50 carried by the motor vehicle and electrically connected to, or otherwise communicatively coupled to, the vehicle control computer 24. Examples of such vehicle operating parameter sensors, sensing systems and/or switches 50 may include, but are not limited to, an engine ignition sensor or sensing system, a vehicle speed sensor or sensing system, a transmission gear selector position sensor, sensing system or switch, a transmission gear position sensor, sensing system or switch, and the like.

In some embodiments, the object detection system 10 may include one or more conventional audio and/or illumination device driver circuits 60 for controllably driving one or more corresponding audio (or audible) devices and/or one or more illumination devices 66. In some such embodiments, the one or more audio and/or illumination device driver circuits 60 may include at least one processor or controller 62 and at least one memory 64 in addition to one or more conventional driver circuits, although in other embodiments the processor or controller 62 and the memory 64 may be omitted. In some embodiments, one, some or all of the one or more driver circuits 60 may be electrically connected to the vehicle control computer 24 so that the processor or controller 26 of the vehicle control computer 24 may control the operation of one or more audio and/or illumination devices 66 via control of such one or more driver circuits 60. Alternatively or additionally, at least one, some or all of the one or more driver circuits 60 may be electrically connected to the object detection module 12 as illustrated by dashed-line connection in FIG. 1, so that the processor or controller 14 of the object detection module 12 may control operation of one or more of the audio and/or illumination devices 66 via control of such one or more driver circuits 60. In any case, examples of such audio devices may include, but are not limited to, one or more electronically controllable audible warning device or systems, one or more electronically controllable audio notification devices or systems, one or more electronically controllable audio voice messaging devices or systems, one or more electrically controllable motor vehicle horns, and the like. Examples of such illumination devices may include, but are not limited to, one or more exterior motor vehicle illumination device, one or more interior motor vehicle illumination devices, one or more warning illumination devices, and the like.

Figure 2:
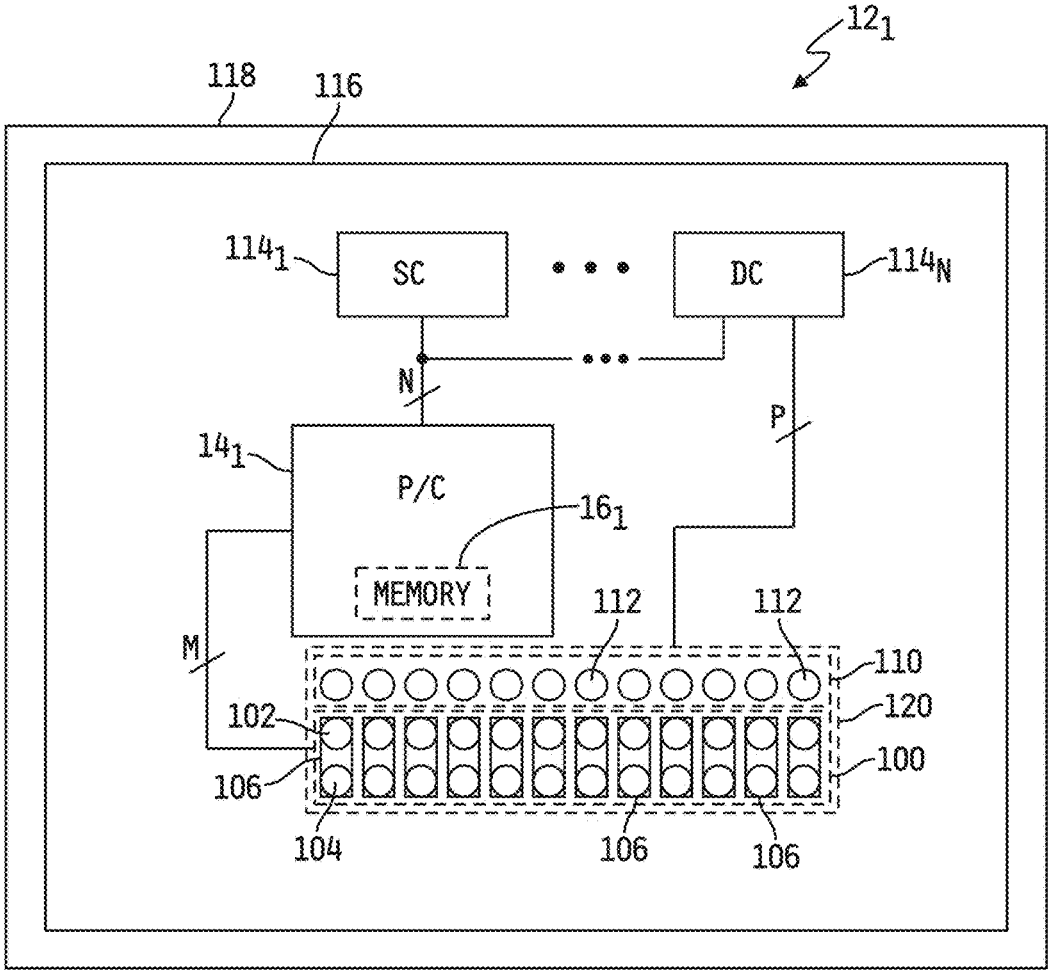
FIG. 2 is a simplified block diagram schematic of an embodiment of the object detection module illustrated in FIG. 1.

Referring now to FIG. 2, one example embodiment $\mathbf{12}_1$ is shown of the object detection module 12 illustrated in FIG. 1. In the illustrated embodiment, the object detection module $\mathbf{12}_1$ includes a radiation emission and detection assembly 100 electrically connected to the at least one processor or controller $\mathbf{14}_1$ via a number M of signal paths, wherein M may be any positive integer. The radiation emission and detection assembly 100 illustratively includes a plurality of radiation transmitters 102 in the form of an array of two or more infrared light-emitting diodes ("IR LEDs"), and a plurality of radiation detectors 104 in the form of an array of two or more infrared light sensors ("IR sensors"). The IR LEDs 102 are conventional and are configured to be responsive to control signals produced by the processor or controller $\mathbf{14}_1$ to emit radiation outwardly from the assembly 100. The IR sensors 104 are likewise conventional and are configured to produce radiation detection signals. The radiation detection signals produced by the IR sensors 104 illustratively include reflected radiation signals if the emitted radiation is reflected by an object in a sensing region of the IR sensors 104, in accordance with a time sequence in which one or more of the IR LEDs 102 is activated to emit radiation and at least a portion of such emitted radiation is reflected by the object toward and detected by at least one of the IR sensors 104.

In the embodiment illustrated in FIG. 2, the plurality of IR LEDs 102 and the plurality of IR sensors 104 are arranged in pairs with each IR LED 102 emitting the IR radiation for detection by an associated IR sensor 104 paired therewith. In some such embodiments, an array of IR LEDs 102 and an array of IR sensors 104 of the radiation emission and detection assembly 100 may be provided together in the form of a preformed IR sensor module. In alternate embodiments, the plurality of IR LEDs 102 may be provided in the form of a preformed IR LED array. In some such embodiments, the plurality of IR sensors 104 may be provided individually and in other embodiments the plurality of IR sensors 104 may be provided in the form of an IR sensor array separate from the IR LED array. In still other alternate embodiments, the plurality of IR sensors 104 may be provided in the form of a preformed IR sensor array, and the plurality of IR LEDs 102 may be provided individually or in the form of an IR LED array. In embodiments in which the plurality of IR LEDs 102 is provided in the form of an array, such an array may be arranged linearly, e.g., in a continuous row. Likewise, in embodiments in which the plurality of IR sensors 104 is provided in the form of an array of IR sensors, such an array may be arrange linearly, e.g., in a continuous row. In the embodiment illustrated in FIG. 2 for example, the IR LEDs 102 and the IR sensors 104 are both arranged in the form of linear arrays. In alternate embodiments in which the plurality of IR LEDs 102 is provide in the form of an array, and/or in which the plurality of IR sensors 104 is provided in the form of an array, either or both such arrays may be arranged non-linearly and/or non-continuously, e.g., in groups of two or more spaced apart LEDs and/or sensors.

Radiation emission and detection assemblies 100 are conventionally associated with processors or controllers $\mathbf{14}_1$ as depicted in FIG. 2, and at least one associated memory 161 includes conventional instructions which, when executed by the processor or controller $\mathbf{14}_1$, cause the processor or controller $\mathbf{14}_1$ to determine from the IR sensor 104 such things as, without limitation, (a) when an object has been detected in a sensing region of the sensors 104 IR, (b) whether the object is of a predetermined type, and (c) whether the object has moved within the sensing region. Examples of known IR detector systems are disclosed in US Patent Application Publication 20120200486, US Patent Application Publication 20150069249, US Patent Application Publication 20120312956, and US Patent Application Publication 20150248796, the disclosures of which are incorporated herein by reference in their entireties.

In some embodiments, the IR LEDs 102 and IR sensors 104 illustratively take the form of an IR sensor module available from NEONODE, INC. (San Jose, Calif.). The modules typically contain multiple pairs of IR emitter LEDs 102 and IR sensors 104 for receiving reflected IR radiation. Such modules typically have a range of about 200 millimeters (mm) of off-surface detection and arranging IR LEDs 102 and the IR sensors 104 in pairs permits a higher resolution of detection. For instance, the assembly 100 of IR LEDs 102 and IR sensors 104 is capable of detecting the difference between a single finger and multiple fingers. As a result, the assembly 100 of IR LEDs 102 and IR sensors 104 is capable of detecting gesturing by a user's hand, for instance.

The embodiment of the object detection module $\mathbf{12}_1$ illustrated in FIG. 2 further includes a plurality of illumination devices 112. In some embodiments, the illumination devices 112 are spaced apart at least partially across the sensing region of the IR sensors 104, and in other embodiments one or more of the illumination devices 112 may be positioned remotely from the sensing region. In some embodiments, the illumination devices 112 may be arranged in the form of a linear or non-linear array 110 of equally or non-equally spaced-apart illumination devices. In some embodiments, the plurality of illumination devices include at least one LED configured to emit radiation in the visible spectrum. In such embodiments, the at least one LED may be configured to produce visible light in a single color or in multiple colors. In alternate embodiments, the plurality of illumination sources may include one or more conventional non-LED illumination sources.

In the embodiment illustrated in FIG. 2, the plurality of illumination devices 112 is provided in the form of an array 110 of visible light LEDs equal in number to the number of IR LEDs 102 and arranged such that each visible light LED 112 is co-extensive with a respective one of the plurality of IR LEDs 102 paired with a corresponding IR sensor 104. In the illustrated embodiment, each visible light LED 112 is positioned adjacent to and above a respective one of the plurality of IR LEDs 102 which is itself positioned adjacent to and above a respective paired one of the IR sensors 104. In alternate embodiments, the visible light LEDs 112, the IR LEDs 102 and the IR sensors 104 may be positioned in any order relative to one another and arranged horizontally, as shown in FIG. 2, vertically, diagonally or non-linearly. In some alternate embodiments, more or fewer visible light LEDs 112 than the IR LEDs 102 and/or the IR sensors 104 may be provided.

The one or more illumination devices 112 is/are illustratively included to provide visual feedback of one or more conditions relating to detection by the radiation emission and detection assembly 100 of an object within a sensing region of the assembly 100. In one example embodiment, two illumination devices 112 may be provided for producing the desired visual feedback. In one implementation of this example embodiment, a first one of the illumination devices 112 may be configured and controlled to illuminate with a first color to visibly indicate the detected presence by the radiation emission and detection assembly 100 of an object within the sensing region, and the second illumination device 112 may be configured and controlled to illuminate with a second color, different from the first, to visibly indicate that the detected object exhibits a predefined gesture. In another example embodiment, three illumination devices 112 may be provided. In this embodiment, a first one of the illumination devices 112 may be controlled to illuminate with a first color to visibly indicate the detected presence of an object within an area of the sensing region in which the radiation emission and detection assembly 100 is unable determine whether the detected object exhibits a predefined gesture (e.g., the object may be within a sub-region of the sensing region which is too small to allow determination of whether the object exhibits the predefined gesture), a second one of the illumination devices 112 is controlled to illuminate with a second color to visibly indicate the detected presence of an object within an area of the sensing region in which the radiation emission and detection assembly 100 is able to determine whether the detected object exhibits a predefined gesture, and a third one of the illumination devices is controlled to illuminate with a third color to visibly indicate that the object within the sensing region is detected by the radiation emission and detection assembly 100 as exhibiting a predefined gesture.

In other embodiments, the one or more illumination devices 112 may include any number of illumination devices 10. Multiple illumination devices 112, for example, may be illuminated in one or more colors to provide a desired visual feedback. In any such embodiments, in one or more illumination devices 112 may be LEDs, and one or more such LEDs may illustratively be provided in the form of RGB LEDs capable of illumination in more than one color. According to this variant, it will be appreciated that positive visual indication of various modes of operation of the radiation emission and detection assembly 100 may be carried out in numerous different colors, with each such color indicative of a different state of operation of the object detection module $\mathbf{12}_1$. As one non-limiting example, the color red may serve to indicate that the radiation emission and detection assembly 100 has detected an object (e.g., a hand or foot) within the sensing region, but is unable to determine whether the detected object is exhibiting a predefined gesture. The color green, in contrast, may serve to indicate that the detected object is exhibiting a predefined gesture and, consequently, that the predefined vehicle command associated with that predefined gesture (e.g., unlocking the vehicle closure, opening the vehicle closure, etc.) is being effected. In addition to green, other colors might be uniquely associated with different predefined commands. Thus, while green illumination might reflect that a closure for the vehicle is being unlocked, blue illumination, for example, may reflect that a fuel door latch has been opened, purple illumination may reflect that a window is being opened, etc.

In still other embodiments, in addition to or alternatively to color distinction, different operating modes, i.e., different detection modes, of the radiation emission and detection assembly 100 may be visually distinguished from one another by controlling the at least one illumination device 112 to switch on and off with different respective frequencies and/or duty cycles. In some embodiments which include multiple illumination devices 112, the different operating modes of the radiation emission and detection assembly 100 may be additionally or alternatively distinguished visually from one another by activating different subsets of the multiple illumination devices 112 for different operating or detection modes, and/or by sequentially activating the multiple illumination devices 112 or subsets thereof with different respective activation frequencies and/or duty cycles.

The object detection module $\mathbf{12}_1$ further illustratively includes a number N of conventional supporting circuits (SC) and conventional driver circuits (DC) $\mathbf{114}_1$-$\mathbf{114}_N$, wherein N may be any positive integer. The supporting circuit(s) (SC) is/are each electrically connected to the processor or controller $\mathbf{14}_1$, and may include one or more conventional circuits configured to support the operation of the processor or controller $\mathbf{14}_1$ and/or other electrical circuits and/or components of the object detection module $\mathbf{12}_1$. Example supporting circuits may include, but are not limited to, one or more voltage supply regulation circuits, one or more capacitors, one or more resistors, one or more inductors, one or more oscillator circuits, and the like. The driver circuit(s) (DC) include one or more inputs electrically connected to the processor or controller $14_1$ and one or more outputs electrically connected to the one or more illumination devices 112 and the plurality of IR LEDs 104. The driver circuit(s) DC is/are conventional and is/are configured to be responsive to one or more control signals supplied by the processor or controller $14_1$ to selectively drive, i.e., activate and deactivate, the plurality of IR LEDs 102 and the one or more illumination devices 112.

It will be understood that the terms "processor" and "controller" used in this disclosure is comprehensive of any computer, processor, microchip processor, integrated circuit, or any other element(s), whether singly or in multiple parts, capable of carrying programming for performing the functions specified in the claims and this written description. The at least one processor or controller $14_1$ may be a single such element which is resident on a printed circuit board with the other elements of the inventive access system. It may, alternatively, reside remotely from the other elements of the system. For example, but without limitation, the at least one processor or controller $14_1$ may take the form of a physical processor or controller on-board the object detection module $12_1$. Alternately or additionally, the at least one processor or controller $14_1$ may be or include programming in the at least one processor or controller 26 of the vehicle control computer 24 illustrated in FIG. 1. Alternatively or additionally still, the at least one processor or controller $14_1$ may be or include programming in the at least one processor or controller 42 of the actuator driver circuit(s) 40 and/or in the at least one processor or controller 62 of the audio/illumination device driver circuit(s) 60 and/or in at least one processor or controller residing in any location within the motor vehicle in which the system 10 is located. For instance, and without limitation, it is contemplated that one or more operations associated with one or more functions of the object detection module $12_1$ described herein may be carried out, i.e., executed, by a first microprocessor and/or other control circuit(s) on-board the object detection module $12_1$, while one or more operations associated with one or more other functions of the object detection module $12_1$ described herein may be carried out, i.e., executed, by a second microprocessor and/or other circuit(s) remote from the object detection module $12_1$, e.g., such as the processor or controller 26 on-board the vehicle control computer 24.

In the embodiment illustrated in FIG. 2, the IR LEDs 102, the IR sensors 104, the illumination devices 112, the at least one processor or controller $14_1$ and the supporting/driver circuits $114_1$-$114_N$ are all mounted to a conventional circuit substrate 116 which is mounted within a housing 118. In some such embodiments, the IR LEDs 102, IR sensors 104 and visible LEDs 112 may be combined and provided in the form of a radiation assembly or module 120 mounted to the circuit substrate 116 as illustrated by example in FIG. 2. In alternate embodiments, the circuit substrate 116 may be provided in the form of two or more separate circuit substrates, and in such embodiments one or more of the IR LEDs 102, the IR sensors 104, the illumination devices 112, the at least one processor or controller $14_1$ and the supporting/driver circuits $114_1$-$114_N$ may be mounted to a first one of the two or more circuit substrates and remaining one(s) of the one or more of the IR LEDs 102, the IR sensors 104, the illumination devices 112, the at least one processor or controller $14_1$ and the supporting/driver circuits $114_1$-$114_N$ may be mounted to other(s) of the two or more circuit substrates. In some such embodiments, all such circuit substrates may be mounted to and/or within a single housing 118, and in other embodiments at least one of the two or more of the circuit substrates may be mounted to and/or within the housing 118 and one or more others of the two or more circuit substrates may be mounted to or within one or more other housings. In embodiments which the object detection module $12_1$ includes multiple housings, two or more such housings may be mounted to the motor vehicle at or near a single location, and in other embodiments at least one of the multiple housings may be mounted to the motor vehicle at a first location and at least another of the multiple housings may be mounted to the motor vehicle at a second location remote from the first location. As one non-limiting example, at least the plurality of IR LEDs 102 and the plurality of IR sensors 104 may be mounted to or within a first housing mounted to the motor vehicle at a first location suitable for detection of one or more specific objects, and at least the one or more illumination devices may be mounted to or within a second housing mounted to the motor vehicle at a second location suitable for viewing by one or more users and/or operators of the motor vehicle.

In one embodiment, electrical power for the object detection module 12, the vehicle control computer 24, the actuator driver circuit(s) 40, the actuator(s) 46, the audio/illumination device driver circuit(s) 60 and the audio/illumination device(s) 66 is illustratively provided by a conventional electrical power source and/or system on-board the motor vehicle. In alternate embodiments, electrical power for the object detection module 12, the actuator driver circuit(s) 40, the actuator(s) 46, the audio/illumination device driver circuit(s) 60 and/or the audio/illumination device(s) 66 may be provided by one or more local power sources, e.g., one or more batteries, on-board the associated module(s), circuit(s) and/or device(s).

Referring now to FIGS. 3A-5, the radiation emission and detection assembly 100 is illustratively operable, under control of the processor or controller $14_1$, to detect an object OB within a sensing region R (depicted schematically in dashed lines in FIGS. 3A-5) of the assembly 100, and to provide corresponding object detection signals to the processor or controller $14_1$. In some embodiments, the processor or controller $14_1$ is, in turn, operable, e.g., by executing corresponding instructions stored in the memory $16_1$, to (1) determine from the object detection signals whether the object OB is within the sensing region R, (2) determine whether the object OB detected as being within the sensing region R exhibits a predefined gesture, and (3) if the detected object OB exhibits a predefined gesture, to (i) control the illumination devices 112 to selectively illuminate one or more of the illumination devices 112 to visibly indicate detection of the predefined gesture, and (ii) control, via the actuator control driver circuit(s), at least one of the actuators 46 associated with an access closure of the motor vehicle to lock or unlock the access closure and/or to open or close the access closure.

In some embodiments, the processor or controller $14_1$ is operable upon detection of the object OB within the sensing region R to selectively illuminate the at least one illumination device 112 in a manner which visibly indicates the detected presence of the object OB within the sensing region R. In some such embodiments, the processor or controller $14_1$ is operable upon detection of the object OB within the sensing region to selectively illuminate the at least one illumination device in a manner which indicates that the object OB is within a sub-region of the sensing region R that is too small to make a determination of whether the object OB exhibits the predefined gesture, and is operable to selectively illuminate the at least one illumination device in a manner which indicates that the object OB is within a sub-region of the sensing region R in which a determination can be made of whether the object OB exhibits the predefined gesture. In embodiments in which the at least one illumination device 112 is provided in the form of an array 110 of illumination devices spaced apart at least partially across the sensing region R, the processor or controller $\mathbf{14}_1$ is illustratively operable to selectively illuminate illumination devices 112 in the array 10 in a manner which correlates the location of the detected object OB within the sensing region R to a corresponding location or region along the illumination device array 110. In any case, the memory 16 illustratively has instructions stored therein which, when executed by the processor $\mathbf{14}_1$, causes the processor $\mathbf{14}_1$ to carry out the functions described below. It will be understood that in other embodiments, such instructions may be stored, in whole or in part, in one or more other memory units within the system 10 and/or may be executed, in whole or in part, by one or more other processors and/or controllers within the system 10.

Figure 3A:
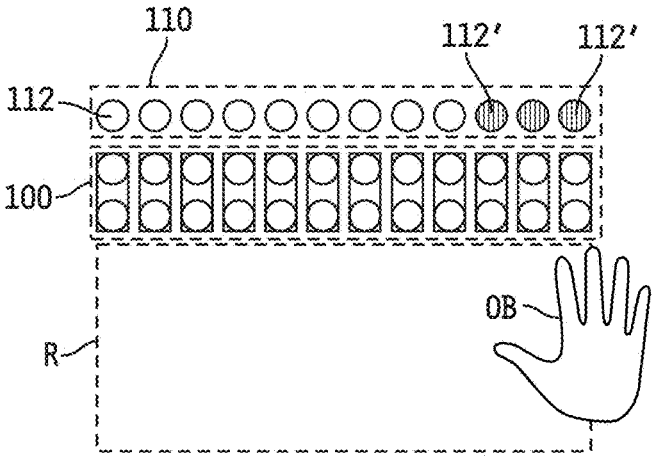
FIG. 3A is a simplified diagram depicting illumination of visible lights in response to detection of an object entering the sensing region of the object detection module of FIG. 2.

In a first example state of operation illustrated in FIG. 3A, an object OB—in this example, a user's hand, foot or other object that is part of or controlled by the user—has entered the sensing region R of the radiation emission and detection assembly 100. Due to limitations of the assembly 100, however, the object is insufficiently positioned within the sensing region R, and/or is positioned within a sub-region sensing region R that is too small, for the assembly 100 to be able to determine if and when the object OB exhibits a predefined gesture. As a result, the processor or controller $\mathbf{14}_1$ is operable to control the illumination driver circuits DC to activate at least one of the illumination devices 112—in this example, the illumination devices 112', 112' proximate the IR LED/sensor pairs which detected the object OB—with a first color to visually indicate to the user that the object OB has been detected within a sub-region of the sensing region R, but is insufficiently positioned in the sensing region R such that the sub-region R is too small to enable to the assembly 100 to determine whether the object OB exhibits a predefined gesture. In this example, the applicable illumination devices 112' are controlled to illuminate with the color red. Illustratively, red serves as a generally universal indicator of warning and so is appropriate as a visual indicator to the user that the object OB is insufficiently positioned in the sensing region R. As noted above, however, one or more other colors may alternatively be employed as desired. Alternatively or additionally still, one or more of the illumination devices 112' (or 112 generally) may be controlled in another visually distinctive manner to provide the visual indicator that the object OB is insufficiently positioned in the sensing region R such that the sub-region R is too small to enable to the assembly 100 to determine whether the object OB exhibits a predefined gesture, e.g., sequentially activating and deactivating the illumination devices 112' (or one or more of the illumination devices 112 generally) with a predefined frequency, activating and deactivating one or more of the illumination devices 112' (or one or more of the illumination devices 112 generally) with a predefined frequency and/or duty cycle, and/or activating in any manner only a subset of the illumination devices 112' (or one or more of the illumination devices 112 generally).

Figure 3B:
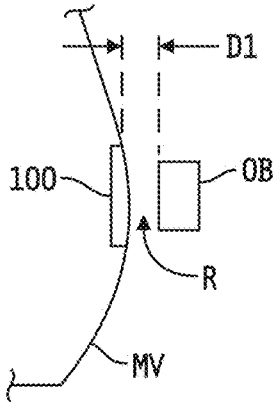
FIG. 3B is a simplified side elevational view of a portion of a motor vehicle having the object detection module of FIG. 2 mounted thereto and depicting an example distance range of object detection by the module.

As illustrated by example in FIG. 3B, the object OB is detectable within a distance D1 of the assembly 100, where D1 defines a maximum axial sensing region R; that is, a maximum distance away from the assembly 100 at which the object OB is horizontally and vertically aligned with the assembly 100, i.e., directly opposite the assembly 100. As briefly described above, the radiation emission and detection assembly 100 made up of multiple IR LEDs 102 and IR sensors 104 illustratively has a range of about 200 millimeters (mm) of off-surface detection, and D1 is thus approximately equal to 200 mm. It is to be understood, however, that the object OB is also detectable by the assembly distances less than D1 at least partially off-axis vertically and/or horizontally relative to the assembly 100.

Figure 4:
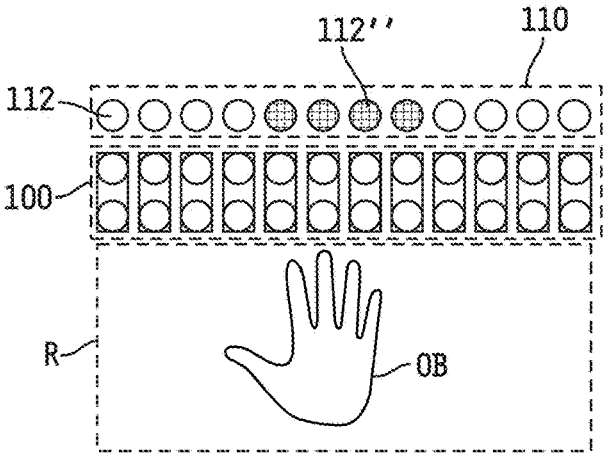
FIG. 4 is a simplified diagram depicting illumination of visible lights in response to detection of an object in the sensing region of the object detection module of FIG. 2.

In a second example state of operation illustrated in FIG. 4, the object OB is positioned centrally within the sensing region R. In some cases, the user may have initially positioned the object OB in the location illustrated in FIG. 4, and in other cases the user may have moved the object OB to the location illustrated in FIG. 4 in response to visual feedback provided by illumination of one or more of the illumination devices 112, such as depicted in the example of FIG. 3A. In any case, in the position illustrated in FIG. 4, the object OB is sufficiently in the sensing region and/or otherwise within a sub-region of the sensing region R in which the radiation emission and detection assembly 100 is capable of detecting whether and when the object OB exhibits a predefined gesture. As a result, the processor or controller $\mathbf{14}_1$ is operable to control the illumination driver circuits DC to activate at least one of the illumination devices 112—in this example, the illumination devices 112" proximate the IR LED/sensor pairs which detected the object OB—with a second color to visually indicate to the user that the object OB is detected within the sensing region R and is within a sub-region thereof in which the processor or controller $\mathbf{14}_1$ is capable of determining whether the object OB exhibits a predefined gesture.

In this example, the illumination devices 112" are illuminated in the color amber (or yellow or gold), which serves as a visual feedback indication that the object OB is positioned within the sensing region R such that any subsequent gestures made by the object OB can be recognized by the processor or controller $\mathbf{14}_1$ as a predefined gesture or any of multiple different predefined gestures. As noted above, however, one or more other colors may alternatively be employed as desired. Alternatively or additionally still, one or more of the illumination devices 112" (or one or more of the illumination devices 112 generally) may be controlled in another visually distinctive manner to provide the visual indication that the object OB is positioned within the sensing region R such that any subsequent gestures made by the object OB can be recognized by the processor or controller $\mathbf{14}_1$ as a predefined gesture or any of multiple different predefined gestures, e.g., sequentially activating and deactivating the illumination devices 112' (or one or more illumination devices 112 generally) with a predefined frequency, activating and deactivating one or more of the illumination devices 112' (or one or more illumination devices 112 generally) with a predefined frequency and/or duty cycle, and/or activating in any manner only a subset of the illumination devices 112' (or any subset of the illumination devices 112 generally).

Figure 5:
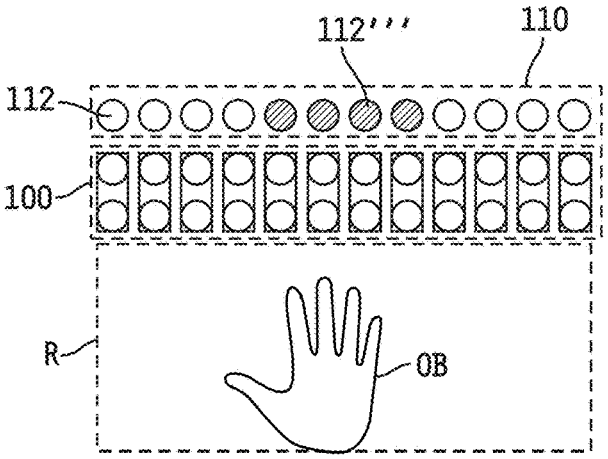
FIG. 5 is a simplified diagram depicting illumination of visible lights by the object detection module of FIG. 2 in response to exhibition of a predefined gesture by the detected object.

In a third example state of operation illustrated in FIG. 5, the object OB positioned centrally within the sensing region R (e.g., see FIG. 4) has exhibited a predefined gesture which has been detected by the assembly 100 and determined by the processor or controller $\mathbf{14}_1$ as correspond to a predefined gesture. As a result, the processor or controller $\mathbf{14}_1$ is operable to control the illumination driver circuits DC to activate at least one of the illumination devices 112—in this example, the illumination devices 112''' proximate the IR LED/sensor pairs which detected the object OB (e.g., the same illumination devices 112" illuminated in FIG. 4)—with a third color to visually indicate to the user that the detected object OB has exhibited a predefined gesture. Illumination in this instance is in the color green, which illustratively serves as a generally universal indicator of acceptance and so is appropriate as a visual indicator to the user that the gesture has been recognized. As noted above, however, one or more other colors may alternatively be employed as desired. Alternatively or additionally still, one or more of the illumination devices 112''' (or one or more of the illumination devices 112 generally) may be controlled in another visually distinctive manner to provide the visual indication that the object OB positioned within the sensing region R has exhibited a predefined gesture, e.g., sequentially activating and deactivating the illumination devices 112''' (or one or more illumination devices 112 generally) with a predefined frequency, activating and deactivating one or more of the illumination devices 112''' (or one or more illumination devices 112 generally) with a predefined frequency and/or duty cycle, and/or activating in any manner only a subset of the illumination devices 112''' (or any subset of the illumination devices 112 generally). In any case, the processor or controller $\mathbf{14}_1$ is further responsive to detection of the predefined gesture to control at least one of the actuator control driver circuit(s) 40 to control at least one of the actuators 46 associated with an access closure of the motor vehicle, e.g., to lock or unlock the access closure and/or to open or close the access closure.

The memory 16 illustratively has stored therein a vehicle access condition value which represents the predefined gesture. In alternate embodiments, the vehicle access condition value may be stored in one or more of the memory 16, the memory 28, the memory 44 and the memory 64. In some embodiments, the vehicle access condition value is illustratively stored in the form of a predefined set or sequence of values, and the processor $\mathbf{14}_1$ is illustratively operable to process the signal(s) produced by the assembly 100 to convert such signals to a detected set or sequence of values, to then compare the detected set or sequence of values to the stored, predefined set or sequence of values and to then determine that the predefined gesture has been exhibited and detected by the assembly 100 if the detected set or sequence of values matches the vehicle access condition value in the form of the stored, predefined set or sequence of values. In some such embodiments, the object detection module $\mathbf{12}_1$ may have a "learning" mode of operation in which the predefined gesture may be programmed by exhibiting the predefined gesture within the sensing region R of the assembly 100, then converting the signals produced by the assembly 100 in response to the exhibited gesture to a learned set or sequence of values, and then storing the learned set or sequence of values as the predefined set of sequence or values corresponding to the predefined gesture. In some embodiments, two or more different vehicle access condition values may be stored in the memory 16 (and/or any of the memories 28, 44 and 64) each corresponding to a different one of two or more corresponding predefined gestures, and the processor $\mathbf{14}_1$ may be operable to compare detected sets or sequences of values produced by the assembly 100 to each of the two or more different stored vehicle access condition values to determine whether one of the two or more predefined gestures has been exhibited. In some such embodiments, each of the multiple predefined gestures may be associated with a different user of the motor vehicle, and in other such embodiments any single user may have two or more predefined gestures store in the memory $\mathbf{14}_1$.

In some embodiments, the processor or controller $\mathbf{14}_1$ may be responsive to (i) detection of the object OB within a sub-region of the sensing region R but insufficiently positioned in the sensing region R such that the sub-region R is too small to enable to the assembly 100 to determine whether the object OB exhibits a predefined gesture, (ii) detection of the object OB positioned within the sensing region R such that any subsequent gestures made by the object OB can be recognized by the processor or controller $\mathbf{14}_1$ as a predefined gesture or any of multiple different predefined gestures, and/or (iii) detection of the predefined gesture, to control at least one of the audio/illumination device driver circuits 60 to activate one or more respective audio and/or illumination devices 66 in addition to the one or more illumination devices 112 or in instead of the one or more illumination devices 112.

While the foregoing example illustrates the selective illumination of several of the illumination devices 112 simultaneously, it will be appreciated that the number of lights illuminated in any given situation may vary depending on the type of feedback desired, the number and/or type of illumination devices 112 being employed in the system, etc. Likewise, although one or more of the illumination devices 112 may activated with one or more colors and/or be activated and deactivated, i.e., switched on and off, to provide visual feedback of the position of the object OB, one or more illumination devices 112 may alternatively be activated (and deactivated) in any manner which visually directs, e.g., coaxes, the user to move the object OB is a particular direction and/or to a particular position relative to the assembly 100.

In one embodiment, the at least one processor or controller $\mathbf{14}_1$ is illustratively operable, upon determining from the radiation emission and detection assembly 100 that a predefined gesture has been exhibited by an object OB within the sensing region R of the assembly 100, to communicate instructions to the vehicle control computer 24 to effect the desired operation (e.g., to unlock or lock a closure—such as a door, rear hatch, tailgate, etc., to open a closure—such as a rear hatch, tailgate, etc. and/or to activate, i.e., turn on, one or more interior and/or exterior vehicle illumination devices). In some alternate embodiments, the at least one processor or controller $\mathbf{14}_1$ may be operable, upon such determination, to control one or more actuator driver circuits 40 and/or one or more audio/illumination device driver circuits 60 directly to effect the desired operation. In other alternate embodiments, the at least one processor or controller $\mathbf{14}_1$ may be operable, upon such determination, to communicate instructions to the vehicle to one or more other processors or controllers, e.g., the at least one processor or controller 42 and/or the at least one processor or controller 62, to effect the desired operation. In still other alternate embodiments, the at least one processor or controller $\mathbf{14}_1$ may be operable, upon such determination, to effect the desired operation in part and to instruct one or more other processors or controllers, e.g., 26, 42, 62, to also effect the desired operation in part.

In some embodiments, one or more aspects of the gesture access process described above and illustrated by example with respect to FIGS. 3A-5 may be implemented in combination with, or integrated with, one or more existing vehicle access devices, techniques or processes. One non-limiting example of such an existing vehicle access device, technique and process is a conventional intelligent "key fob"-type remote used in PES-type access systems. Such access systems may typically operate in a conventional manner by issuing a short-range "challenge" signal to a "key fob"

remote 20 carried by a user. If the "key fob" remote 20 is one that is authorized for the vehicle, the "challenge" response from the remote 20 results in the vehicle control computer 24 being placed in a mode where it will accept subsequent "commands" from the remote 20, such as unlocking or locking the vehicle, unlatching the trunk or rear hatch, or the like. The gesture access process described above and illustrated by example with respect to FIGS. 3A-5 may operatively interface with the vehicle control computer 24 so as to permit execution of the gesture access process by the processor or controller $\mathbf{14}_1$ only in circumstances when an authorized user seeks to use the system, e.g., such as when the user conveying gesture access movements to the radiation emission and detection assembly 100 is also carrying a key fob remote 20 or other remote device, e.g., a smart phone or other mobile device, which may communicate with the vehicle control computer 24 to allow the user to access the vehicle using predefined gesture access movements. Alternatively, the object detection module $\mathbf{12}_1$ may further include the necessary components to enable independent authentication of the user; that is, the electronics, hardware, firmware and/or software necessary to issue a challenge signal and to receive and evaluate the response from a user's key fob 20 and/or to otherwise communicate with one or more other mobile electronic devices 20 carried by the user for purposes of authenticating the user for subsequent recognition by the combination of the radiation emission and detection assembly 100 and the processor or controller $\mathbf{14}_1$ of a predefined gesture movement carried out by the user.

In embodiments in which the gesture access process illustrated by example in FIGS. 3A-5 and descried above is permitted only in circumstances when an authorized user seeks to use the system, e.g., such as when the user conveying gesture access movements to the radiation emission and detection assembly 100 is also carrying a key fob remote 20 or other such remote device, the memory 161 illustratively has a key fob code stored therein, and the processor or controller $\mathbf{14}_1$ is illustratively operable to receive a key fob signal(s) wirelessly transmitted by a key fob or other such remote device 20 within a key fob signal detection area of the motor vehicle, to determine a code based on the received key fob signal and to activate the IR LED(s) 102 and process the radiation detection signals detected by the IR sensor(s) 104 only if the determined code matches the stored key fob code. Illustratively, the key fob signal detection area is defined by a transmission/detection range of the key fob or other such remote device 20, which may typically be up to about 20-30 yards (or more). In some such embodiments, the key fob code is illustratively associated in the memory 161 with a vehicle access condition value, corresponding to a predefined gesture, also stored in the memory 161, and in such embodiments the processor or controller $\mathbf{14}_1$ is illustratively operable to process the radiation detection signals produced by the assembly 100 as described above and actuate a corresponding one of the actuators 46 only if the object OB in the sensing region R of the assembly 100 exhibits the predefined gesture corresponding to the vehicle access condition value associated in the memory 161 with the stored key fob code. In embodiments in which multiple key fob codes are stored in the memory 161, each such stored key fob code is illustratively associated in the memory 161 with a different vehicle access condition value mapped to or associated with a different corresponding predefined gesture. In such embodiments, the processor or controller $\mathbf{14}_1$ is illustratively operable to activate one or more of the actuators 46, as described above, only upon detection of a key fob code which matches one of the multiple stored key fob codes, followed by detection by the assembly 100 of a gesture exhibited within the sensing region R which matches the predefined gesture mapped to or associated with the vehicle access condition value associated in the memory with the matching key fob code.

Figure 6A:
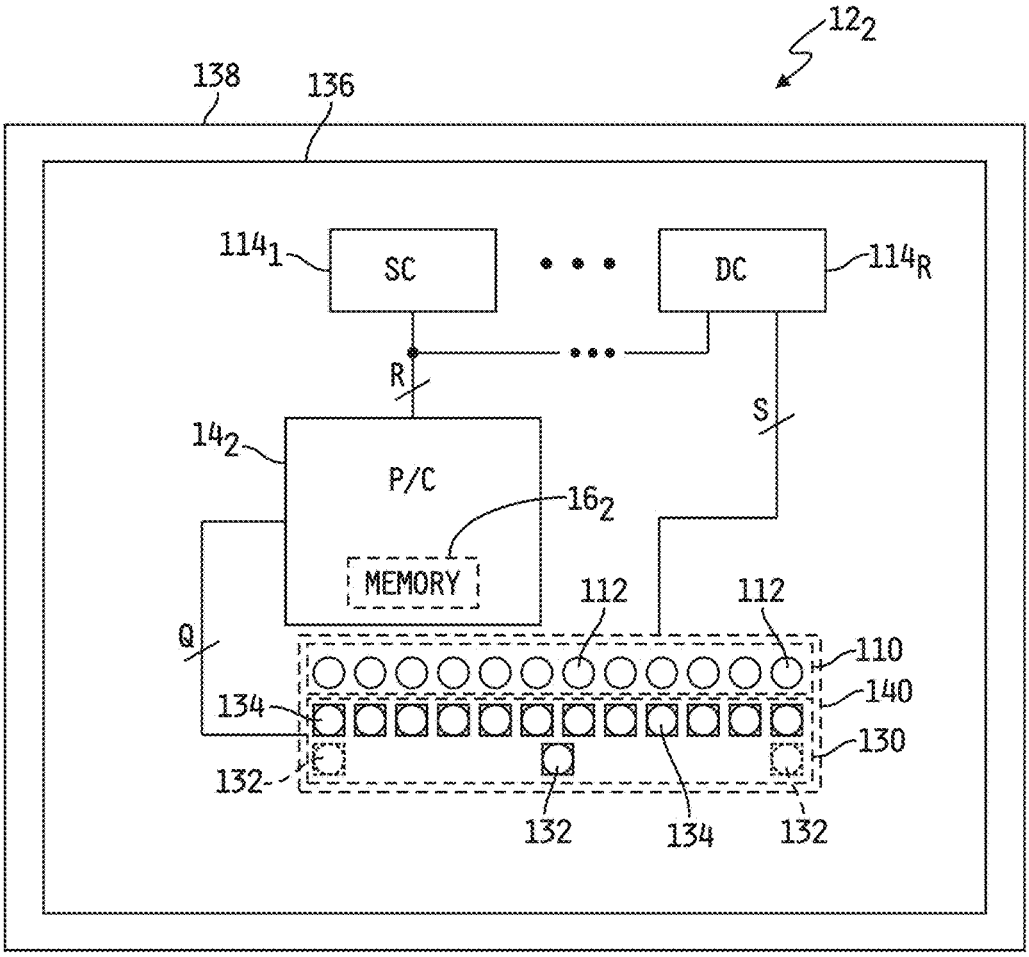
FIG. 6A is a simplified block diagram schematic of another embodiment of the object detection module illustrated in FIG. 1.

Referring now to FIG. 6A, another example embodiment $\mathbf{12}_2$ is shown of the object detection module 12 illustrated in FIG. 1. In the illustrated embodiment, the object detection module $\mathbf{12}_2$ includes a radiation emission and detection assembly 130 electrically connected to the at least one processor or controller 142 via a number Q of signal paths, wherein Q may be any positive integer. The radiation emission and detection assembly 130 illustratively includes at least one radiation transmitter 132 in the form of a radar transmitter, and a plurality of radiation detectors 134 in the form of an array of two or more radar detectors. In some embodiments, a single radar transmitter 132 is positioned adjacent to or proximate to the plurality of radar detectors 134, and in other embodiments two or more radar transmitters 132 may be positioned adjacent to or proximate to the plurality of radar detectors as illustrated by dashed-line representation in FIG. 6A. In other embodiments, the one or more radar transmitters 132 may be spaced apart from the plurality of radar detectors 134.

The at least one radar transmitter 132 is illustratively conventional, and is configured to be responsive to control signals produced by the processor or controller $\mathbf{14}_1$ to emit radio frequency (RF) radiation outwardly from the assembly 100. In one embodiment, the at least one radar transmitter 132 is configured to emit radiation in the so-called short-range-radar (SRR) band, e.g., at and around 24 gigahertz (GHz). Alternatively or additionally, the at least one radar transmitter 132 may be configured to emit radiation in the so-called long-range-radar (LRR) band, e.g., at and around 77 GHz. It will be understood, however, that these numerical frequency ranges are provided only by way of example, and that the at least one radar transmitter 132 may be alternatively or additionally configured to emit radiation at radar frequencies less than 1 GHz and up to or greater than 300 GHz. In any case, each of the plurality of radar detectors 134 is configured to detect radar signals in frequency range(s) corresponding to that/those of the at least one radar transmitter 132, and to produce radiation detection signals corresponding thereto.

The radiation detection signals produced by the radar detectors 134 illustratively include reflected radar signals if the emitted radiation is reflected by an object in a sensing region of the assembly 130, in accordance with a conventional time sequence in which the at least one radar transmitter 132 is activated to emit radiation and at least a portion of such emitted radiation is reflected by the object toward and detected by at least one of the radar detectors 134. As illustrated by example in FIG. 6B, an object OBJ is detectable within a distance D2 of the assembly 130, where D2 defines a maximum axial sensing region; that is, a maximum distance away from the assembly 130 at which the object OB is horizontally and vertically aligned with the assembly 130, i.e., directly opposite the assembly 130. Within this distance D2, radar signals 133 emitted by the at least one radar transmitter 132 propagate outwardly away from the assembly 130 and from the motor vehicle MV, and at least a portion of such signals 133 which strike the object OBJ are reflected by the object OBJ back toward the assembly 130 in the form of reflected radar signals 135 which are detected by one or more of the plurality of radar detectors 134. The distance D2 between the assembly 130 mounted to the motor vehicle MV and a detectable object is illustratively several meters, and in some embodiments D2 may be greater than several meters. It is to be understood, however, that the object OBJ is also detectable by the assembly 130 at distances less than D2 and at least partially off-axis vertically and/or horizontally relative to the assembly 130.

Referring again to FIG. 6A, the illustrated object detection module $\mathbf{12}_2$ is illustratively otherwise identical in structure and operation to the object detection module $\mathbf{12}_1$ illustrated in FIGS. 2-5 and described above. For example, the object detection module $\mathbf{12}_2$ further illustratively includes a plurality of illumination devices 112 which may (or may not) be arranged in the form of a linear or non-linear array 110 of equally or non-equally spaced-apart illumination devices as illustrated in FIG. 6A. The plurality of illumination devices 112 are illustratively as described above with respect to FIG. 2. As another example, the object detection module $\mathbf{12}_2$ further illustratively includes a number R of conventional supporting circuits (SC) and conventional driver circuits (DC) $\mathbf{114}_1$-$\mathbf{114}_R$, wherein R may be any positive integer. The supporting circuit(s) (SC) and the driver circuit(s) (DC) is/are each as described above with respect to FIG. 2. As yet another example, the components of the object detection module $\mathbf{12}_2$ are illustratively mounted to at least one circuit substrate 136, which is as described with respect to the circuit substrate 116 of FIG. 2, and the combination is illustratively mounted to or within a housing 138, which is as described with respect to the housing 118 of FIG. 2. In some embodiments, as also described above with respect to the object detection module $\mathbf{12}_2$ illustrated in FIG. 2, the at least one radar transmitter 132, the plurality of radar detectors 134 and the one or more visible LEDs 112 may be combined and provided in the form of a radiation assembly or module 140 mounted to the at least one circuit substrate 136 as illustrated by example in FIG. 6A.

Figure 7:
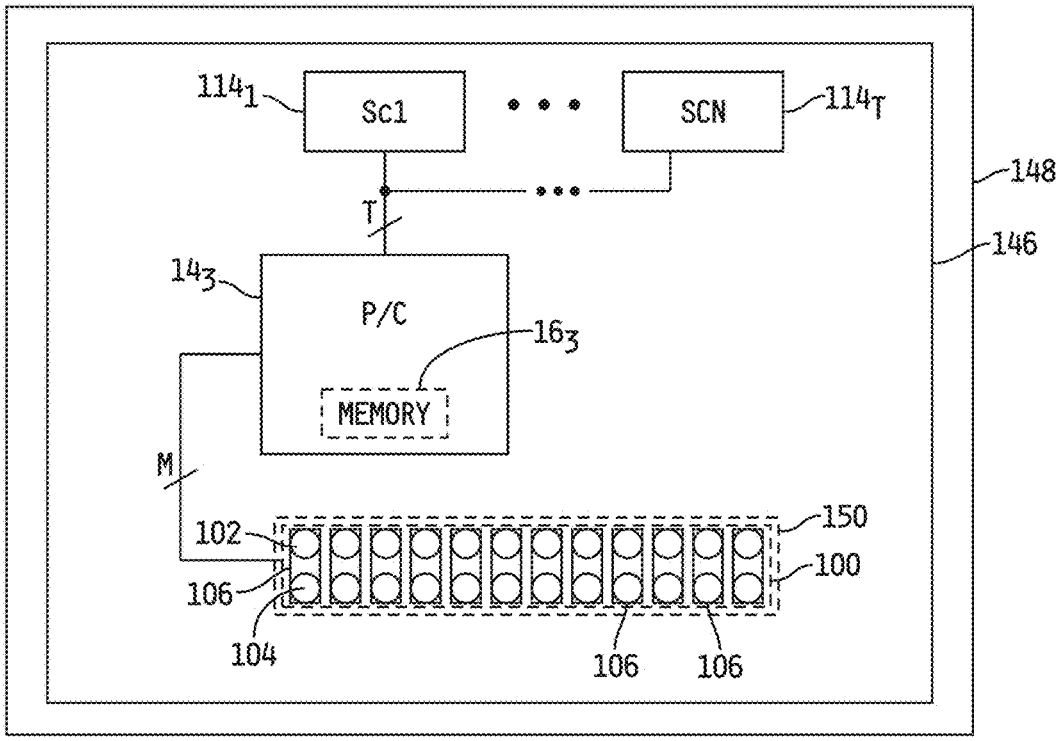
FIG. 7 is a simplified block diagram schematic of yet another embodiment of the object detection module illustrated in FIG. 1.

Referring now to FIG. 7, yet another example embodiment $\mathbf{12}_3$ is shown of the object detection module 12 illustrated in FIG. 1. In the illustrated embodiment, the object detection module $\mathbf{12}_3$ includes the radiation emission and detection assembly 100 illustrated in FIG. 2 and described above, which is electrically connected to the at least one processor or controller $\mathbf{14}_3$ via a number M of signal paths, wherein M may be any positive integer. Unlike the object detection module $\mathbf{12}_1$ illustrated in FIG. 2, the object detection module $\mathbf{12}_3$ does not include the plurality of illumination devices 112. The object detection module $\mathbf{12}_3$ is otherwise identical in structure and operation to the object detection module $\mathbf{12}_1$ illustrated in FIGS. 2-5 and described above. For example, the object detection module $\mathbf{12}_3$ further illustratively includes a number T of conventional supporting circuits (SC) $\mathbf{114}_1$-$\mathbf{114}_T$, wherein T may be any positive integer. In some embodiments, the object detection module $\mathbf{12}_3$ may further include one or more conventional driver circuits, as described above with respect to FIG. 2, in such embodiments in which the object detection module $\mathbf{12}_3$ includes one or more drivable devices. In any case, the supporting circuit(s) (SC) is/are each as described above with respect to FIG. 2. As another example, the components of the object detection module $\mathbf{12}_3$ are illustratively mounted to at least one circuit substrate 146, which is as described with respect to the circuit substrate 116 of FIG. 2, and the combination is illustratively mounted to or within a housing 148, which is as described with respect to the housing 118 of FIG. 2. In some embodiments, as also described above with respect to the object detection module $\mathbf{12}_1$ illustrated in FIG. 2, the plurality of IR LEDs 102 and the plurality of IR sensors 104 may be combined and provided in the form of a radiation assembly or module 150 mounted to the at least one circuit substrate 146 as illustrated by example in FIG. 7.

Figure 8:
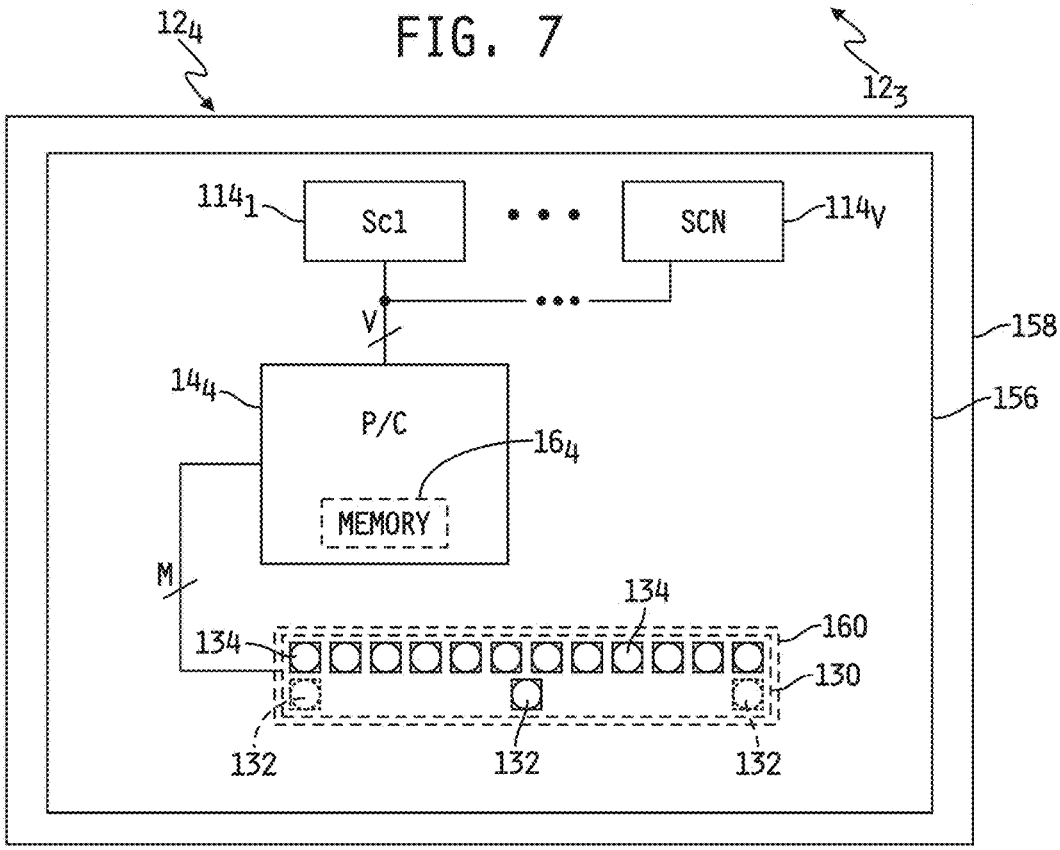
FIG. 8 a simplified block diagram schematic of a further embodiment of the object detection module illustrated in FIG. 1.

Referring now to FIG. 8, still another example embodiment $\mathbf{12}_4$ is shown of the object detection module 12 illustrated in FIG. 1. In the illustrated embodiment, the object detection module $\mathbf{12}_4$ includes the radiation emission and detection assembly 130 illustrated in FIG. 6A and described above, which is electrically connected to the at least one processor or controller $\mathbf{14}_4$ via a number M of signal paths, wherein M may be any positive integer. Unlike the object detection module $\mathbf{12}_2$ illustrated in FIG. 6A, the object detection module $\mathbf{12}_4$ does not include the plurality of illumination devices 112. The object detection module $\mathbf{12}_4$ is otherwise identical in structure and operation to the object detection module $\mathbf{12}_2$ illustrated in FIGS. 6A, 6B and described above. For example, the object detection module $\mathbf{12}_4$ further illustratively includes a number V of conventional supporting circuits (SC) $\mathbf{114}_1$-$\mathbf{114}_V$, wherein V may be any positive integer. In some embodiments, the object detection module $\mathbf{12}_4$ may further include one or more conventional driver circuits, as described above with respect to FIG. 2, in such embodiments in which the object detection module $\mathbf{12}_4$ includes one or more drivable devices. In any case, the supporting circuit(s) (SC) is/are each as described above with respect to FIG. 2. As another example, the components of the object detection module $\mathbf{12}_4$ are illustratively mounted to at least one circuit substrate 156, which is as described with respect to the circuit substrate 116 of FIG. 2, and the combination is illustratively mounted to or within a housing 158, which is as described with respect to the housing 118 of FIG. 2. In some embodiments, as also described above with respect to the object detection module $\mathbf{12}_2$ illustrated in FIG. 6A, the at least one radar transmitter 132 and the plurality of radar detectors 134 may be combined and provided in the form of a radiation assembly or module 160 mounted to the at least one circuit substrate 156 as illustrated by example in FIG. 8.

Figure 9:
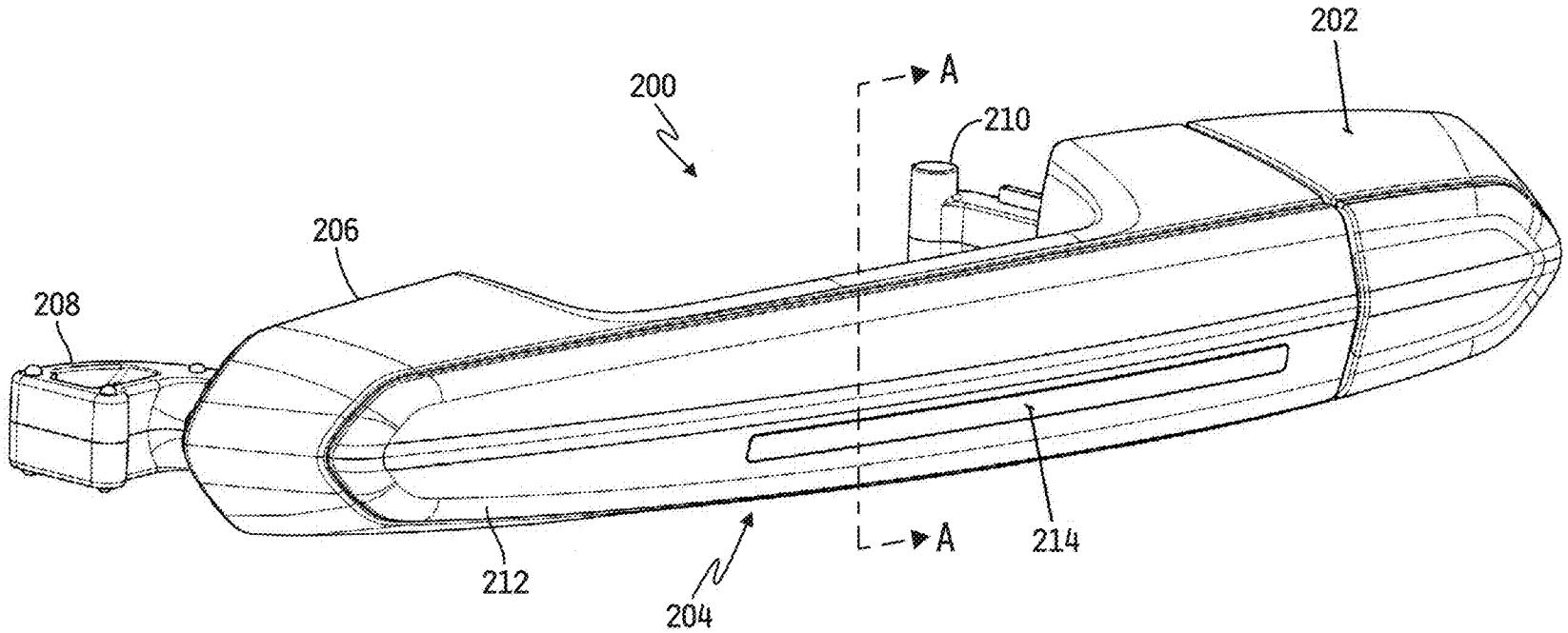
FIG. 9 is a perspective view of an embodiment of a motor vehicle access closure release handle in which the object detection module of FIG. 2 or FIG. 6A may be embodied.

The object detection module 12, as described above with respect to FIG. 1 and various example embodiments $\mathbf{12}_1$-$\mathbf{12}_4$ of which are described above with respect to FIGS. 2-8, may be implemented in a motor vehicle in any number of ways. As one example, and without limitation, the object detection module $\mathbf{12}_3$ or the object detection module $\mathbf{12}_4$ may be embodied in a motor vehicle access handle (e.g., a door handle) assembly 200 as illustrated by example in FIGS. 9-12. Referring now to FIG. 9, the motor vehicle access handle assembly 200 is illustratively a strap-style handle of the type comprising a stationary base 202 fixable to a motor vehicle door and a movable portion 204 adapted to be grasped by a user and pulled outwardly away from the door to release the door latch and, thus, open the door. A handle base 206 is coupled to a pivot mount 210 configured to be pivotally mounted to the motor vehicle door and a latch actuator 208 operatively coupled with a door latch assembly located within the motor vehicle door. A grip cover 212 is mountable to and over the handle base 206, and the grip cover 212 carries a lens 214 through which radiation is emitted outwardly in the direction of a user approaching or positioned proximate the lens 214 and through which reflected radiation passes into the handle 200. Together, the grip cover 212 and the handle base 206 form a grip configured to be grasped by a human hand. As will be described in greater detail below, the grip cover 212 and handle base 206 together form a housing which carries the object detection module $\mathbf{12}_3$ or $\mathbf{12}_4$. In one embodiment, the radiation emission and detection assembly 100, including the plurality of IR LEDs 102 and the plurality of IR sensors 104, is housed within the movable portion 204 of the handle assembly 200, and in another embodiment the radiation emission and detection assembly 130, including the at least one radar transmitter 132 and the plurality of radar detectors 134, is housed within the movable portion 204.

Figure 10:
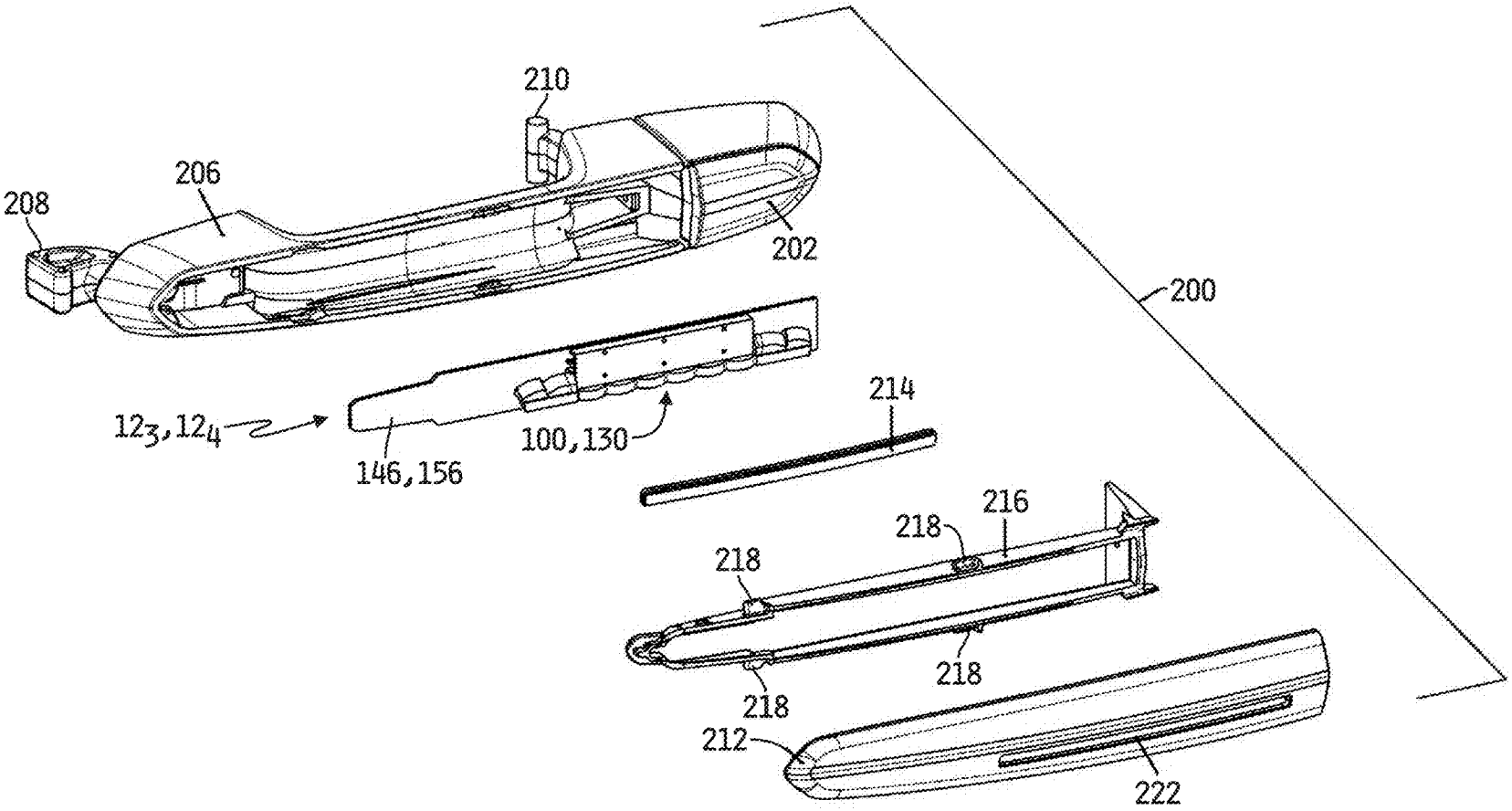
FIG. 10 is an exploded view of the motor vehicle access closure release handle of FIG. 9.

Referring now to FIG. 10, the grip cover 212 includes an opening 222 therein in which the lens 214 is mounted. The lens 214 may be secured within the opening 222 in any known fashion. In the illustrated embodiment, lens 214 includes a base portion that is wider than the opening 222, whereby the lens 214 is inserted through the opening 222 from the inside of the grip cover 212 and the base portion secured to the grip cover 212 with epoxy or other suitable adhesive.

Figure 11:
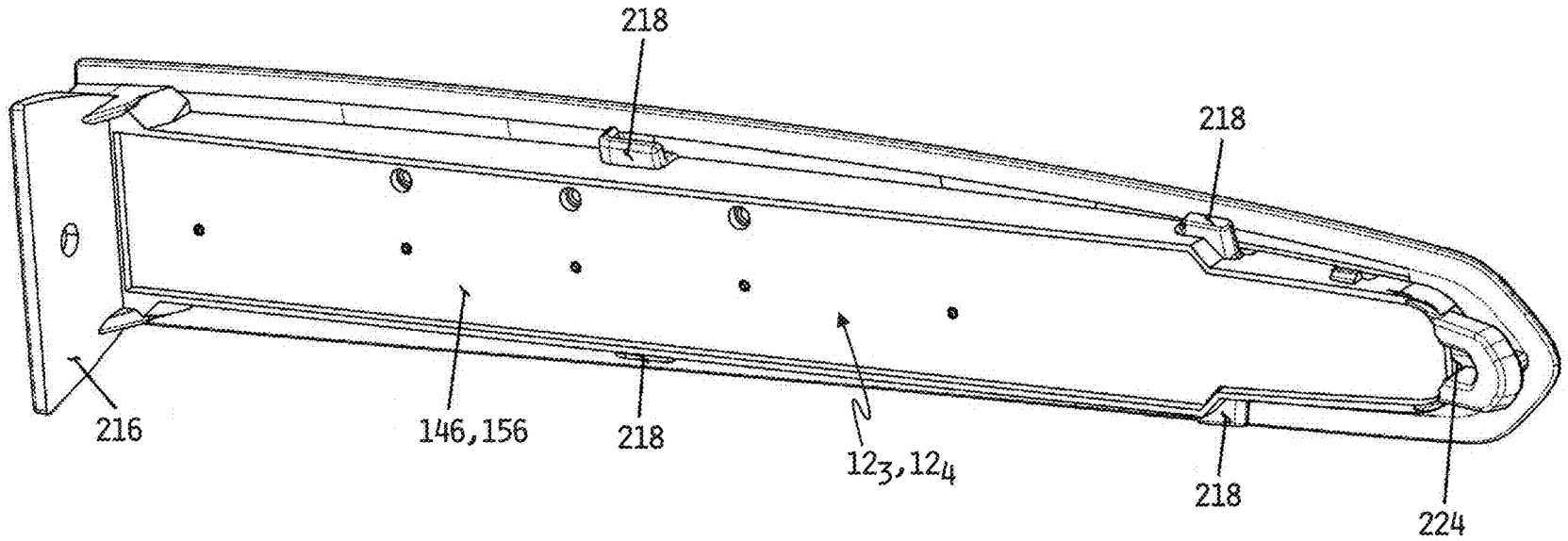
FIG. 11 is a rear view of the motor vehicle access closure release handle of FIG. 8.

As further illustrated in FIGS. 10 and 11, the object detection module $\mathbf{12}_3$ or $\mathbf{12}_4$ is shown including the respective radiation emission and detection assembly 100, 130 mounted to a respective circuit substrate 146, 156. The radiation emission and detection assembly 100, 130 is illustratively mounted to the circuit substrate 146, 156, and the circuit substrate 146, 156 is illustratively mounted to a support member 216. The radiation emission and detection assembly 100, 130, the circuit substrate 146, 156 and the support member 216 are all illustratively configured such that, when assembled, the radiation emission and detection assembly 100, 130 is aligned with the opening 222 and the lens 214 described above. Illustratively, the support member 16 is dimensioned to be sandwiched between the handle base 206 and the grip cover 212 so as to securely position the object detection module $\mathbf{12}_3$, $\mathbf{12}_4$ within the housing defined by the handle base 206 and the grip cover 212.

Figure 12:
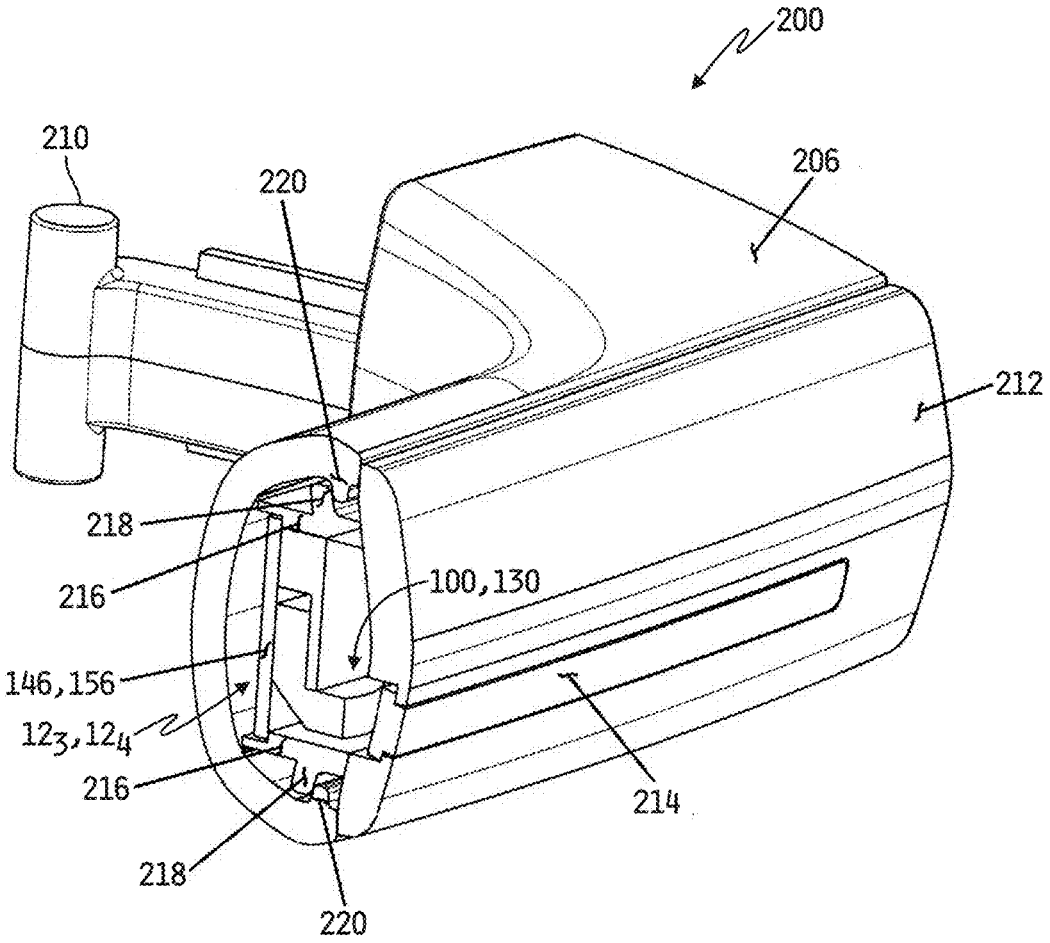
FIG. 12 is a cross-sectional view of the motor vehicle access closure release handle of FIG. 9 as viewed along section lines A-A.
Figure 13:
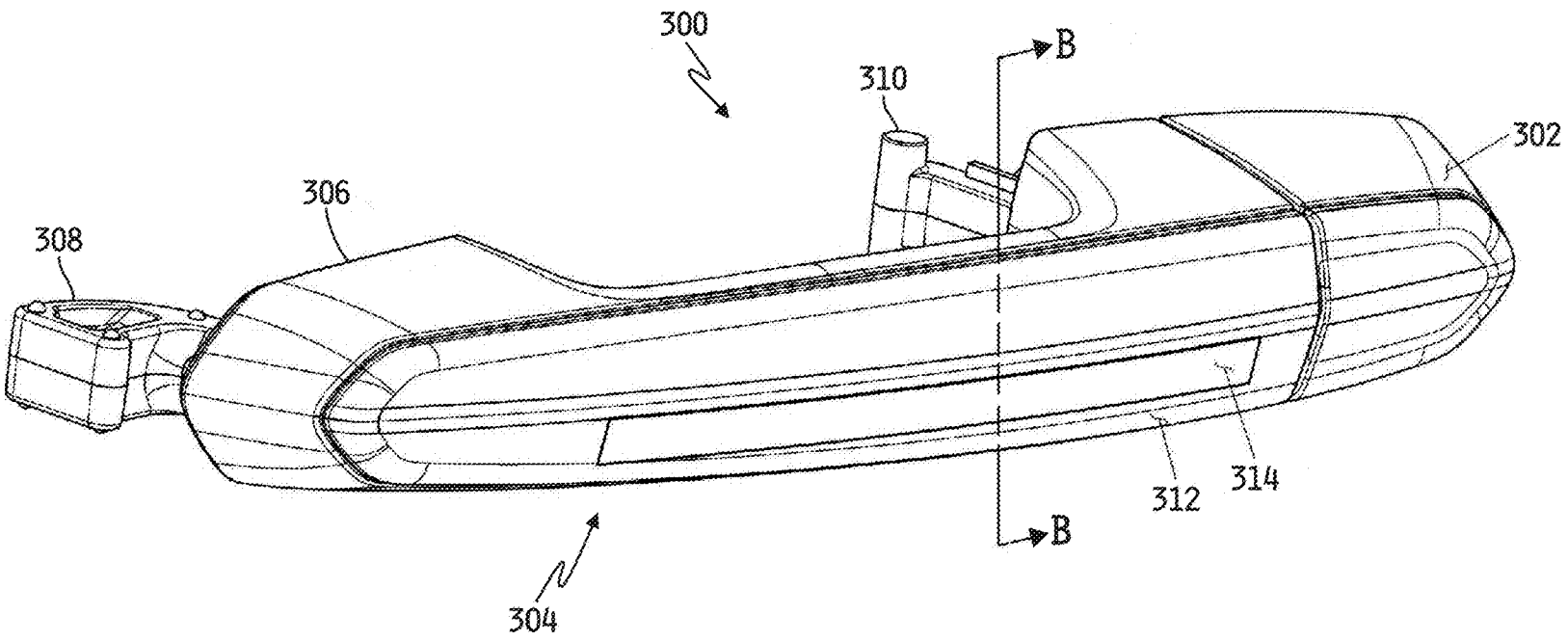
FIG. 13 is a perspective view of another embodiment of a motor vehicle access closure release handle in which the object detection module of FIG. 2 or FIG. 6A may be embodied.
Figure 14:
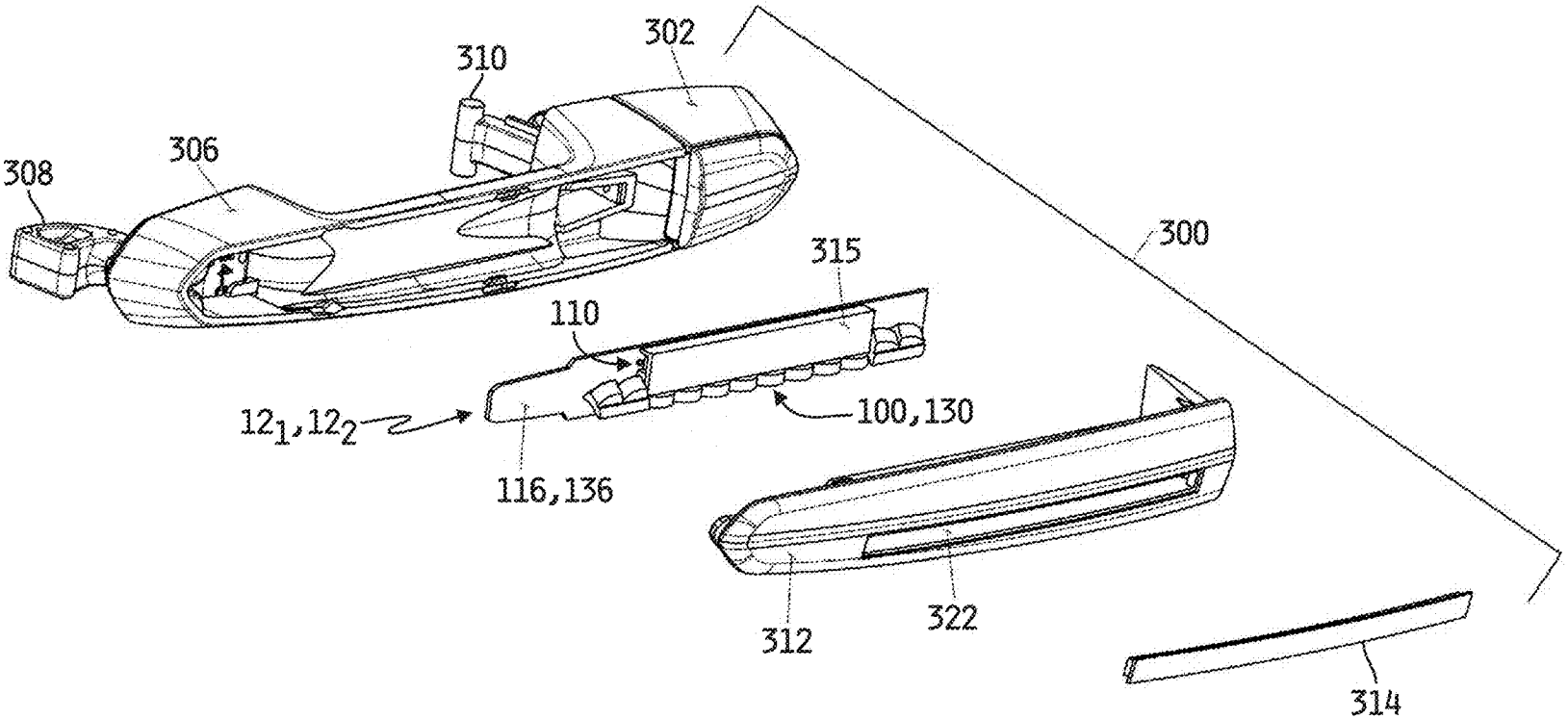
FIG. 14 is an exploded front perspective view of the motor vehicle access closure release handle of FIG. 13.

Referring now to FIGS. 10 and 12, the support member 216 can be seen to include a plurality of outwardly facing locking tabs 218 which engage with corresponding locking tabs 220 defined on the handle base 206 to securely capture the support member 216 in place within the housing defined by the handle base 206 and the grip cover 212. And as shown best in FIG. 11, an opening 224 defined in the support member 216 provides a pass-through for wiring (not depicted) for electrically connecting the components mounted to the circuit substrate 146, 156 to a power source (e.g., the vehicle battery) and, optionally, to one or more of the motor vehicle's onboard computers, e.g., 24, in order to effect vehicle commands, in some embodiments, as described herein.

As another example implementation of the object detection module 12 in a motor vehicle, the object detection module $\mathbf{12}_1$ or the object detection module $\mathbf{12}_2$ may likewise be embodied in a motor vehicle access handle assembly (e.g., a door handle) 300 as illustrated by example in FIGS. 13-16. Referring to FIGS. 13 through 16, the motor vehicle access handle assembly 300 is illustratively a strap-style handle of the type including a stationary base 302 fixable to a motor vehicle door and a movable portion 304 adapted to be grasped by a user and pulled outwardly away from the door to release the door latch and, thus, open the door. A handle base 306 is coupled to a pivot mount 310 configured to be pivotally mounted to the motor vehicle door and a latch actuator 308 operatively coupled with a door latch assembly located within the motor vehicle door. A grip cover 312 is mountable to and over the handle base 306, and the grip cover 312 illustratively carries a lens 314 through which radiation is emitted outwardly in the direction of a user approaching or positioned proximate the lens 314, through which reflected radiation passes into the handle assembly 300 and through which illumination of at the at least one illumination source 112 is visible. Together, the grip cover 312 and the handle base 306 form a grip configured to be grasped by a human hand. As will be described in greater detail below, the grip cover 312 and handle base 306 together form a housing which carries the object detection module $\mathbf{12}_1$ or $\mathbf{12}_2$. In one embodiment, the radiation emission and detection assembly 100, including the plurality of IR LEDs 102 and the plurality of IR sensors 104, is housed within the movable portion 304 of the handle assembly 300, and in another embodiment the radiation emission and detection assembly 130, including the at least one radar transmitter 132 and the plurality of radar detectors 134, is housed within the movable portion 304. In both embodiments, the array 110 of illumination sources 112 is also housed within the movable portion 304 of the handle assembly, although in alternate embodiments the array 110 may be replaced by one or more individual illumination sources 112 as described above.

As in the door handle assembly 200, the grip cover 312 includes an opening 322 therein configured to receive the lens 314, and the lens 314 may be secured to the grip cover 312 within the opening 322 via any conventional means. As further illustrated in FIGS. 14 and 15, the object detection module $\mathbf{12}_1$ or $\mathbf{12}_2$ is shown including the respective radiation emission and detection assembly 100, 130 mounted to a respective circuit substrate 116, 136. The illumination device array 110 is also illustratively mounted to the circuit substrate 116, 136 adjacent to the radiation emission and detection assembly 100, 130 as described above, and in the illustrated embodiment a light-transmissive cover or lens 315 is mounted to the circuit substrate 116, 136 over the illumination device array 110. In one embodiment, the array 110 of illumination devices 112 is aligned with and relative to the radiation emission and detection assembly 100, 130 such that each of the illumination devices 112 is positioned adjacent to a corresponding one of the plurality of IR sensors 104, in the case of the assembly 100, or adjacent to a corresponding one of the plurality of radar detectors 134 in the case of the assembly 130.

The circuit substrate 116, 136 is illustratively mounted to a support member 316 between sidewalls 324 of the grip cover 312. In some embodiments, the radiation emission and detection assembly 100, 130, the illumination device array 110 and the circuit substrate 116, 136 are all illustratively configured such that, when assembled, the radiation emission and detection assembly 100, 130 and the illumination device array 110 are together aligned with the opening 322 and the lens 314 described above. In alternate embodiments, the grip cover 312 may be at least partially light transmissive, and in such embodiments illumination of the one or more illumination devices 112 is viewable through the grip cover 312. In still other embodiments, the grip cover 312 may define another opening and be fitted with another lens through which illumination of the one or more illumination devices 112 may be viewed. In any case, the support member 316 is illustratively dimensioned to be sandwiched between the handle base 206 and the grip cover 212 so as to securely position the object detection module 121, 122 within the housing defined by the handle base 206 and the grip cover 212.

Figure 15:
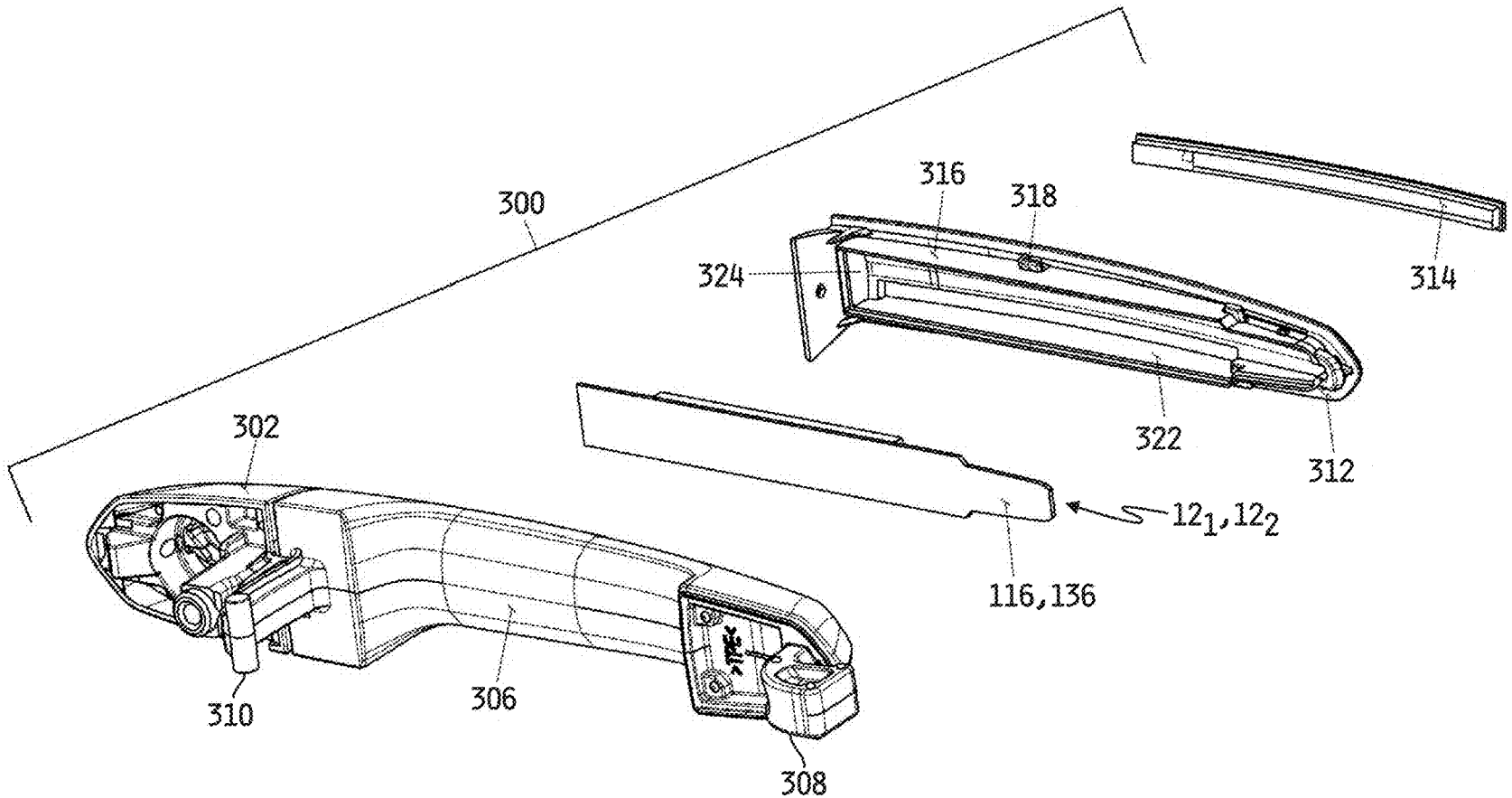
FIG. 15 is an exploded rear perspective view of the motor vehicle access closure release handle of FIG. 13.
Figure 16:
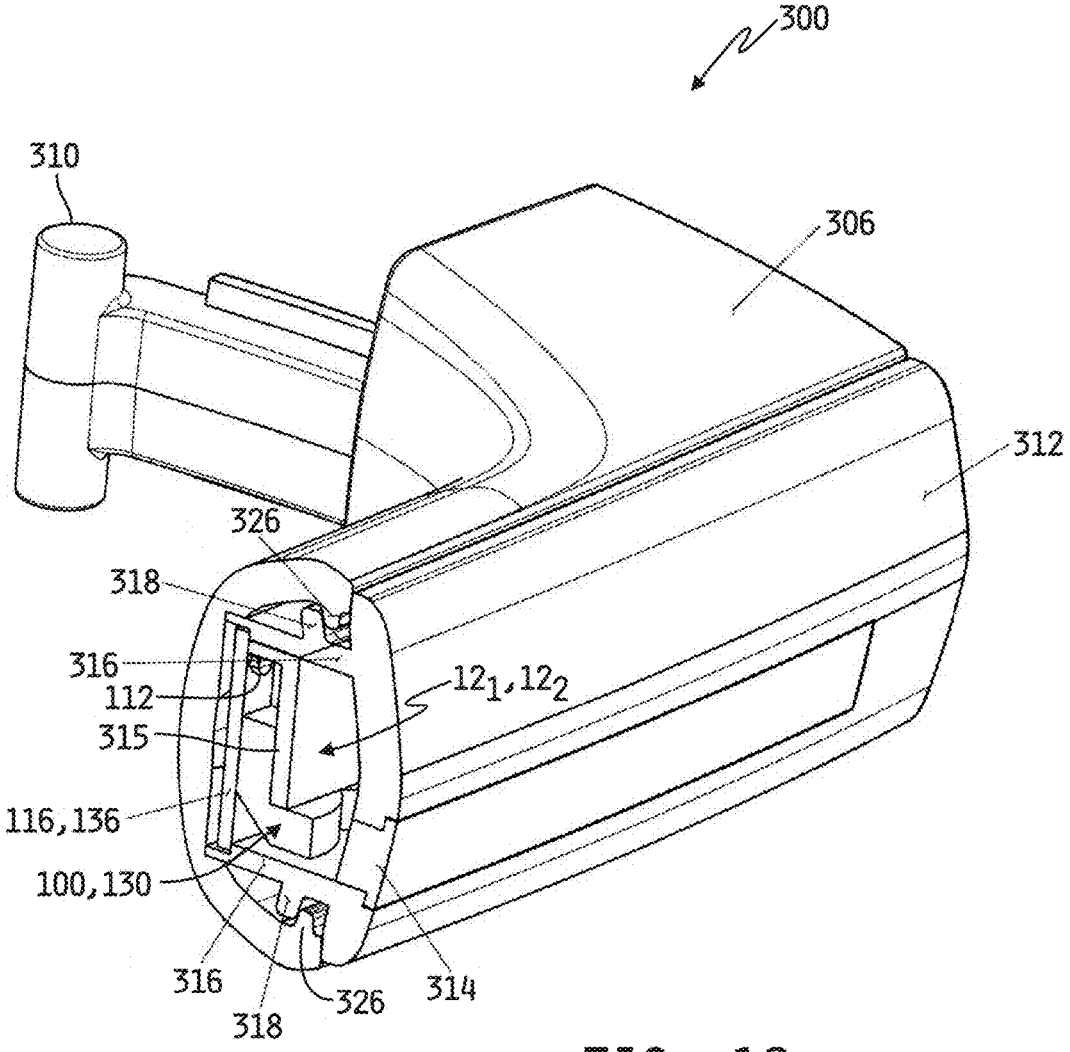
FIG. 16 is a cross-sectional view of the motor vehicle access closure release handle of FIG. 13 as viewed along section lines B-B.

With particular reference to FIGS. 15 and 16, secure positioning of the circuit substrate 116, 136 carrying the radiation emission and detector assembly 100, 130 and the illumination device array 110 220 is accomplished via the support member 316 which extends inwardly from the grip cover 312 so as to be positioned inside the moveable portion 304 of the handle assembly 300. The support member 316 includes sidewalls on which are disposed a plurality of outwardly facing locking tabs 318 which engage with corresponding locking tabs 326 defined on the base portion 306 to securely connect the and handle base 306 to the grip cover 312. The circuit substrate 116, 136 is sandwiched between the support member 316 and the handle base 312, while the radiation emission and detection assembly 100, 130 and the illumination device array 110 are IR received between the sidewalls of the support member 316.

In either of the motor vehicle access handle assemblies 200, 300 illustrated in FIGS. 9-16, it will be understood that some embodiments may include the at least one respective processor or controller 141-144 mounted to the respective circuit substrate 116, 136, 146, 156 as described above with respect to FIGS. 1-8. In some alternate embodiments, the at least one respective processor or controller 141-144 may be positioned elsewhere on the vehicle and operatively connected to the radiation emission and detection assembly 100, 130 and, in the embodiment illustrated in FIGS. 13-16, to the illumination device array 110. In either case, it will also be understood that some embodiments may include the support circuit(s) and, in the case of the modules 121, 122, 114 also mounted to the respective circuit substrate 116, 136, 146, 156 as described above with respect to FIGS. 1-8. In alternate embodiments, at least one of the support circuit(s) and/or at least one of the driver circuit(s) (in embodiments which include at least one driver circuit) may be positioned elsewhere on the vehicle and operatively connected to the respective circuit components of the modules 121-124. In any such embodiment, the respective processor or controller $\mathbf{14}_1$-$\mathbf{14}_4$ is operable as described above with respect to FIGS. 2-8 to actuate at least one actuator 46 upon detection of a predefined gesture, to controllably illuminate the one or more illumination sources 112, as also described above, in embodiments which include the one or more illumination sources 112 and, in some embodiments, to control activation of one or more audio and/or illumination devices 66.

Figure 17:
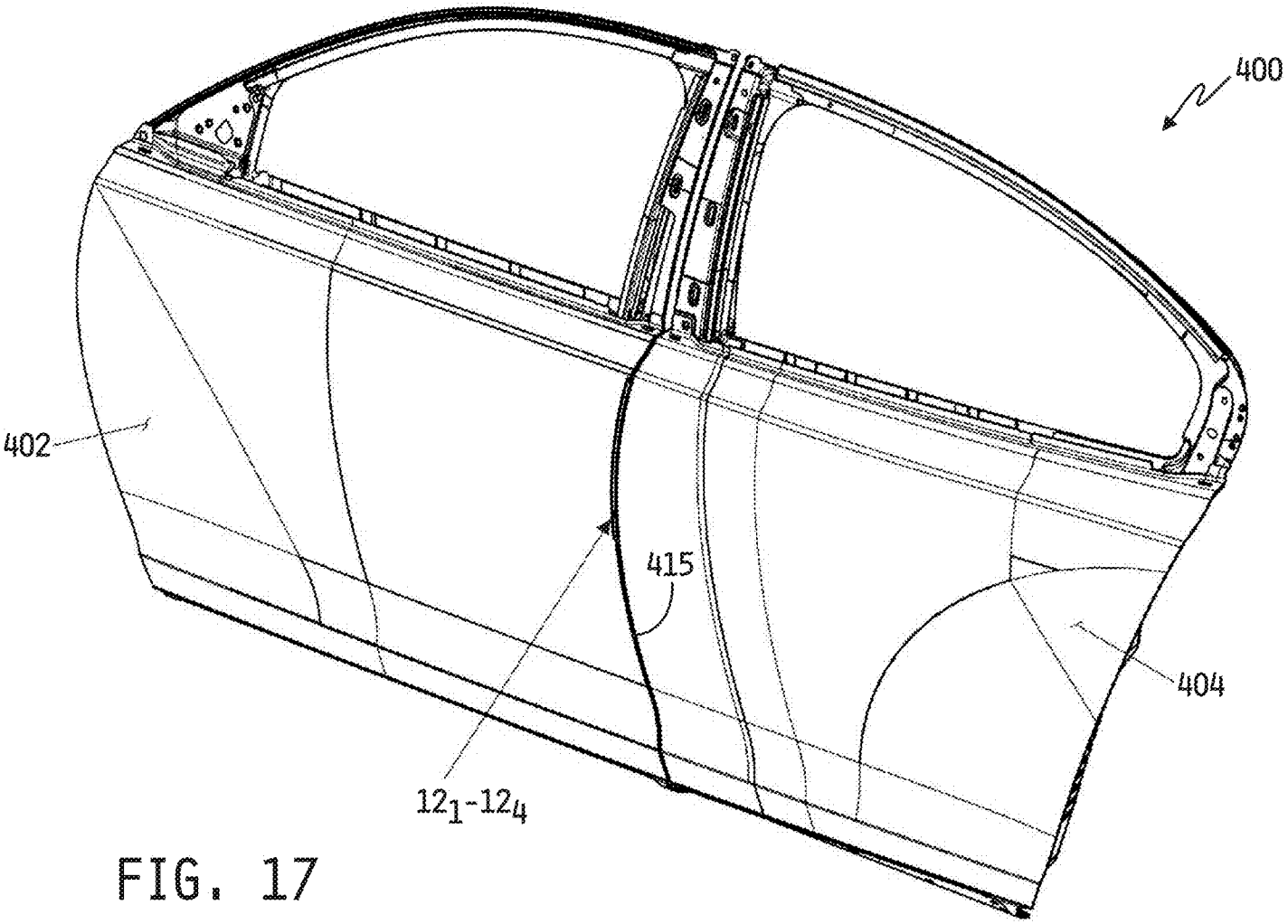
FIG. 17 is a perspective view of an embodiment of a motor vehicle access closure arrangement in which the object detection module of any of FIG. 2, 6A, 7 or 8 may be embodied.
Figure 18:
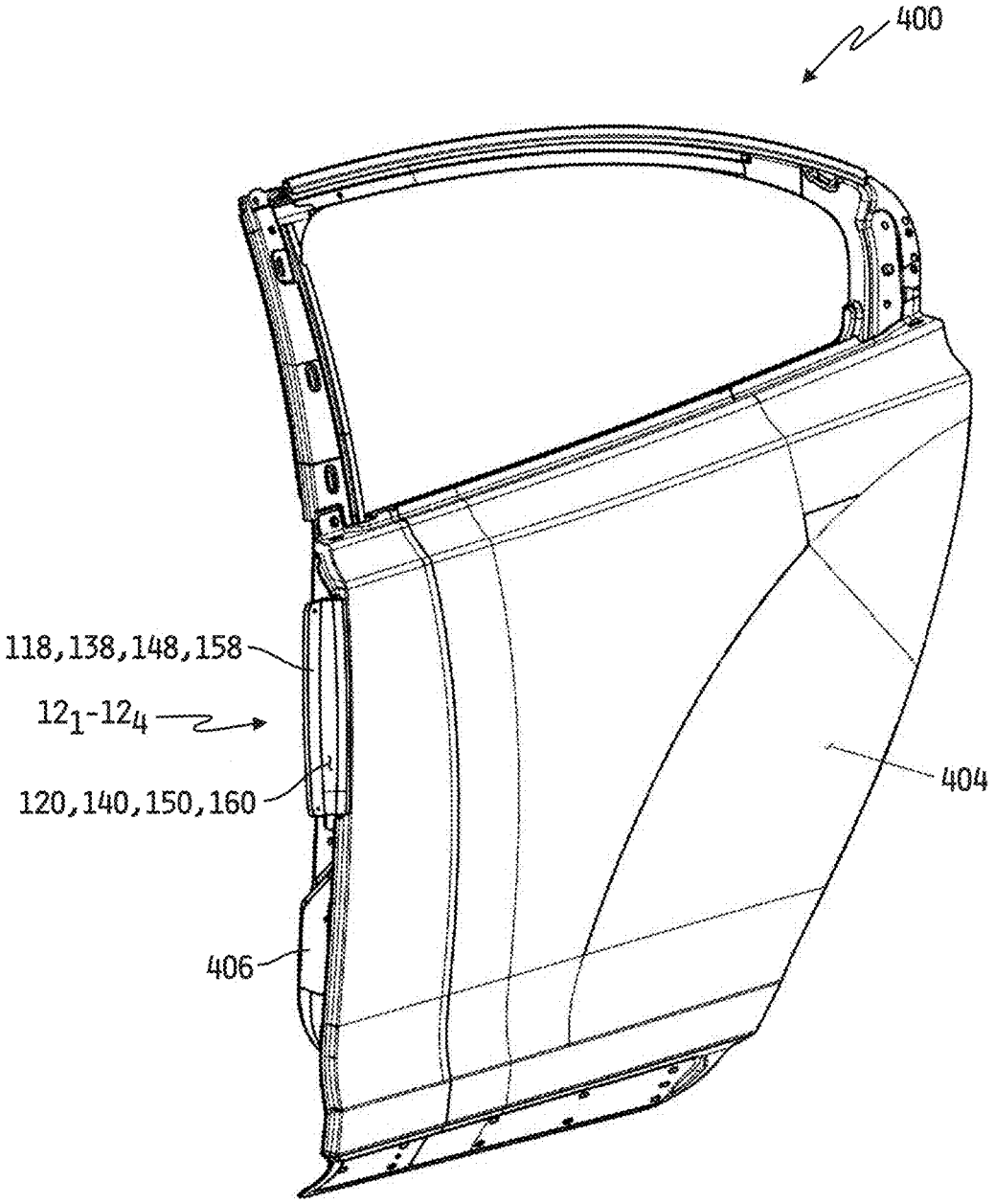
FIG. 18 is a perspective view of a portion of the motor vehicle illustrated in FIG. 17 with the access closure removed to illustrate mounting of the object detection module to a pillar of the motor vehicle.
Figure 19:
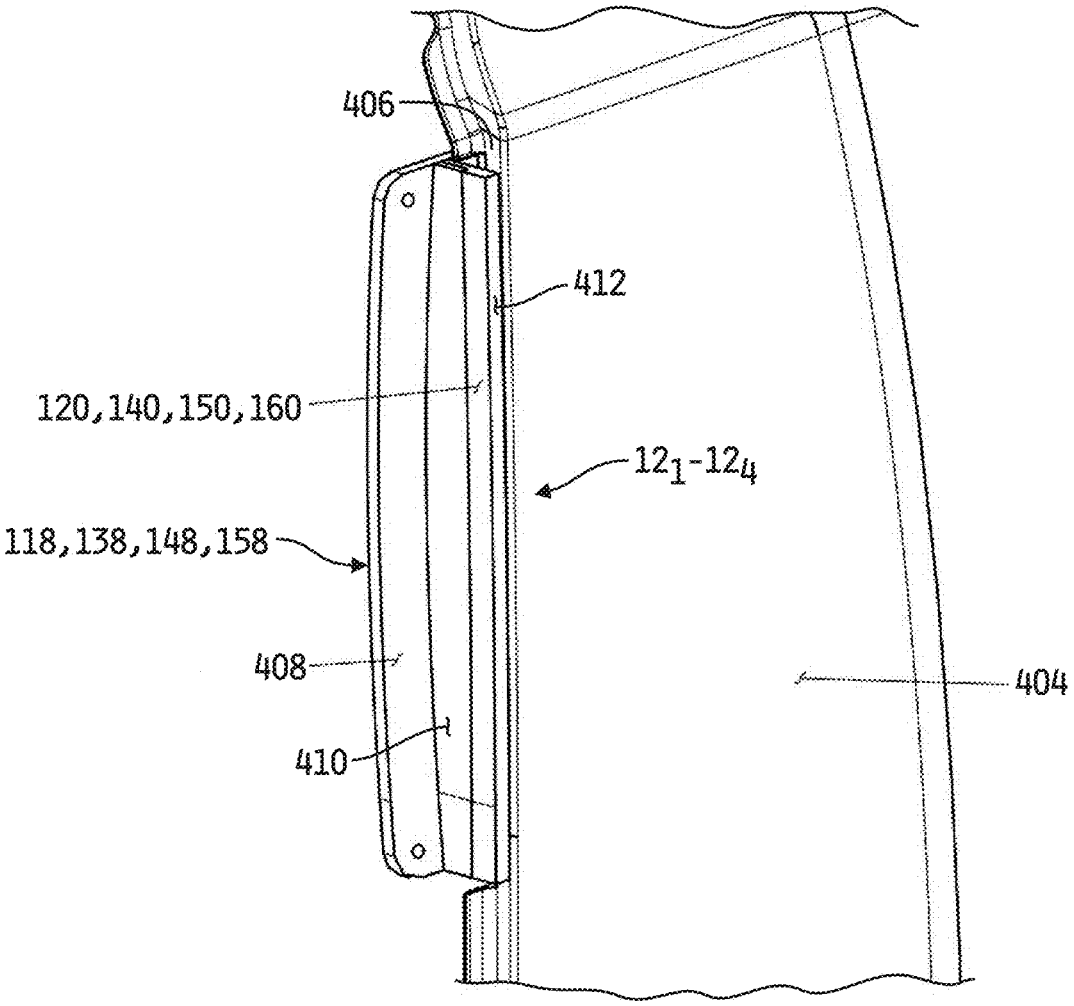
FIG. 19 is a magnified view of the portion of the motor vehicle shown in FIG. 18 and illustrating an embodiment of a housing mounted to the motor vehicle pillar with one of the object detection modules of FIG. 2, 64, 7 or 8 mounted within the housing.

As yet another example implementation of the object detection module 12 in a motor vehicle, any of the object detection modules $\mathbf{12}_1$-$\mathbf{12}_4$ may be embodied in a motor vehicle access assembly 400 as illustrated by example in FIGS. 17-21. Referring to FIGS. 17 through 19, the motor vehicle access assembly 400 is illustratively provided in the form of a housing 118, 138, 148, 158 of a respective one of the object detection modules $\mathbf{12}_1$-$\mathbf{12}_4$ adapted to be mounted to a support member 406 of the motor vehicle, e.g., a pillar, positioned between two access closures, e.g., doors, 402, 404 of the motor vehicle. As most clearly shown in FIG. 19, the housing 118, 138, 148, 158 of any of the respective object detection modules $\mathbf{12}_1$-$\mathbf{12}_4$ is illustratively provided in the form of a first housing portion 408 mounted to the vehicle structure 406, and a second elongated housing portion 410 mounted to the first housing portion 408 such that a free elongated end of the second elongated housing 410 is vertically oriented with a vertical seam 415 defined between the vehicle doors 402, 404. In alternate embodiments, the vertical seam 415 may be defined between an access closure of the motor vehicle and a stationary panel of the motor vehicle.

In embodiments in which the object detection module 12 is provided in the form of the object detection module $\mathbf{12}_3$ or $\mathbf{12}_4$, the radiation emission and detection assembly 100, 130 is illustratively provided in the form of a radiation assembly or module 150, 160 as described above, and in embodiments in which the object detection module 12 is provided in the form of the object detection module $\mathbf{12}_1$ or $\mathbf{12}_2$, the radiation emission and detection assembly 100, 130 and the one or more illumination devices 112 are together provided in the form of a radiation assembly or module 120, 140 as also described above. In the embodiment illustrated in FIGS. 18 and 19, the radiation assembly or module 120, 140, 150, 160 is illustratively an elongated assembly or module mounted to the elongated free end of the housing portion 410 such that the elongated radiation assembly or module 120, 140, 150, 160 is vertically oriented with the vertical seam 415, and such that the housing portion 410 and the radiation assembly or module 120, 140, 150, 160 together are illustratively recessed within the motor vehicle relative to an outer surface of the motor vehicle. In alternate embodiments, the housing portion 410 and the radiation assembly or module 120, 140, 150, 160 are configured such that the housing portion 410 is recessed within the motor vehicle relative to the outer surface of the motor vehicle but at least a portion of the radiation assembly or module 120, 140, 150, 160 extends at least partially into the vertical seam 415. In some such embodiments, the radiation assembly or module 120, 140, 150, 160 may at least partially protrude from the vertical seam 415 and thus extend outwardly from the outer surface of the motor vehicle adjacent one either side of the vertical seam 415, and in other such embodiments the radiation assembly or module 120, 140, 150, 160 may at least partially extend into the vertical seam 415, but not protrude outwardly therefrom and thus not extend outwardly from the outer surface of the motor vehicle. In some embodiments, an elongated lens 412 may cover the radiation assembly or module 120, 140, 150, 160 to protect the same from the outside environment, as illustrated by example in FIG. 19.

Thusly positioned, the at least one radiation transmitter, e.g., the plurality of IR LEDs 102 or the at least one radar transmitter, is positioned relative to the vertical seam 415 such that, when activated, radiation is emitted outwardly through the vertical oriented seam 415 at least partially along its length and, if an object is positioned within a sensing region of the radiation assembly or module 120, 140, 150, 160, at least some reflected radiation signals are reflected back towards (and in some embodiments, through) the vertically oriented seam 415 to be detected by one or more of the radiation receivers, e.g., one or more of the IR sensors 104 or one or more of the radar detectors 134. Otherwise, the respective processor or controller $\mathbf{14}_1$-$\mathbf{14}_4$ is operable as described above with respect to FIGS. 2-8 to actuate at least one actuator 46 upon detection of a predefined gesture, to controllably illuminate the one or more illumination sources 112, as also described above, in embodiments which include the one or more illumination sources 112 and, in some embodiments, to control activation of one or more audio and/or illumination devices 66.

Figure 20:
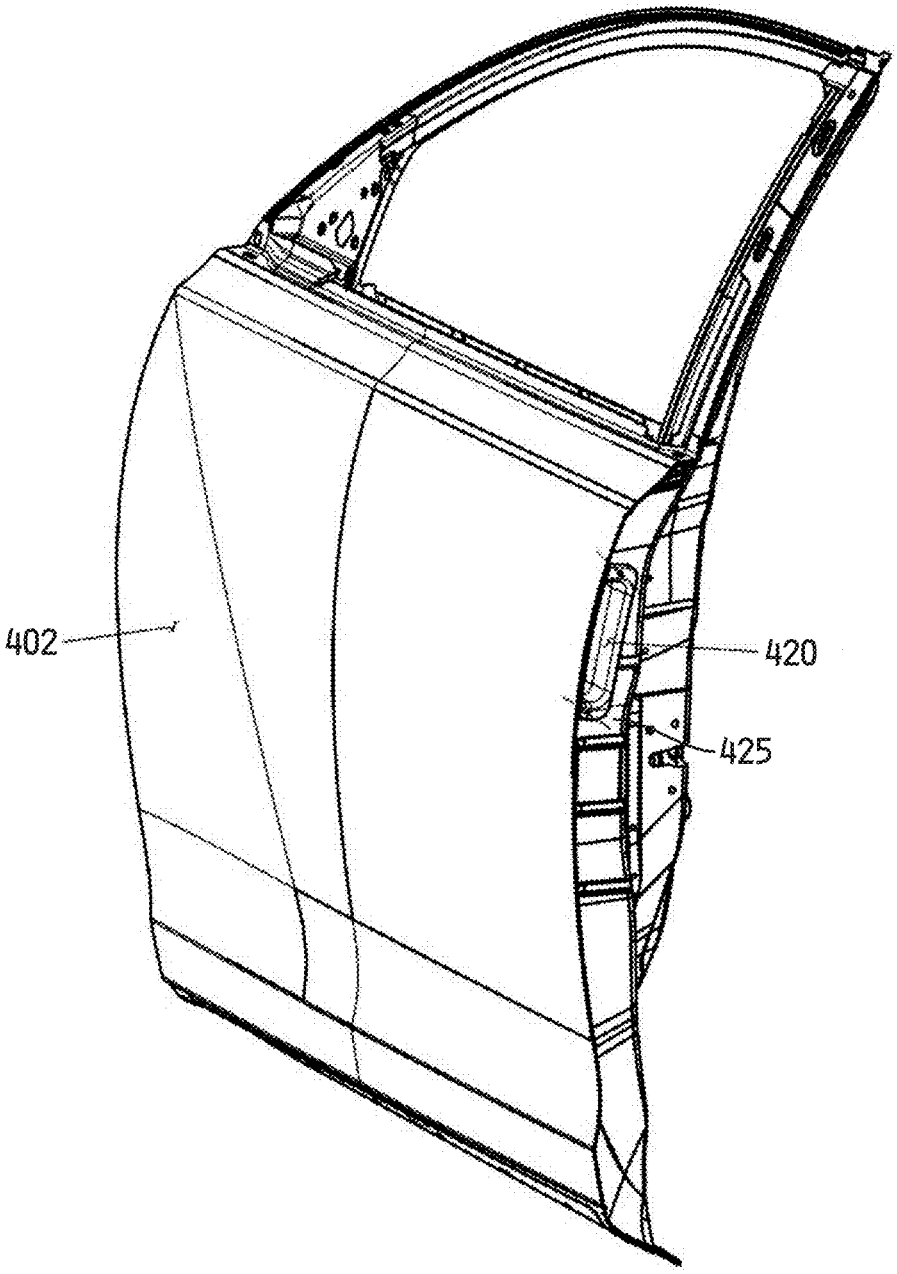
FIG. 20 is a perspective view of the motor vehicle access closure shown in FIG. 17 illustrating an embodiment of a hand-engageable pocket disposed along an inside edge of the access closure.
Figure 21:
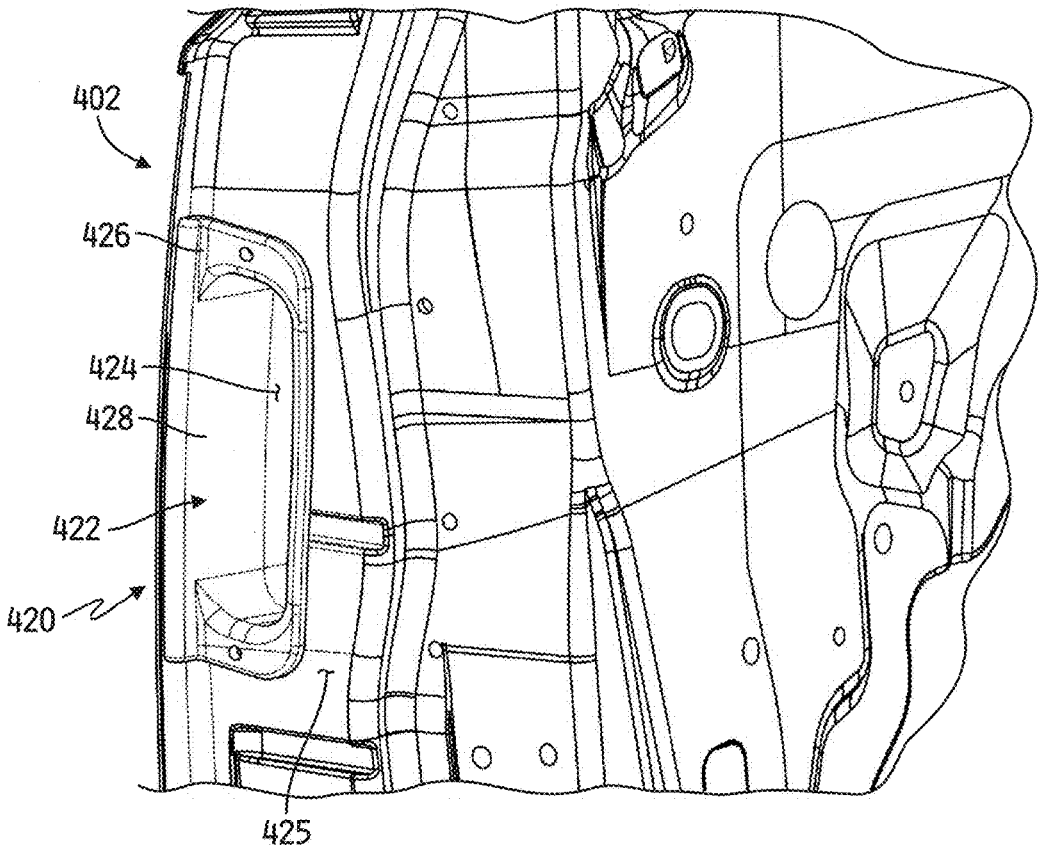
FIG. 21 is a magnified view of the pocket illustrated in FIG. 20.
Figure 22:
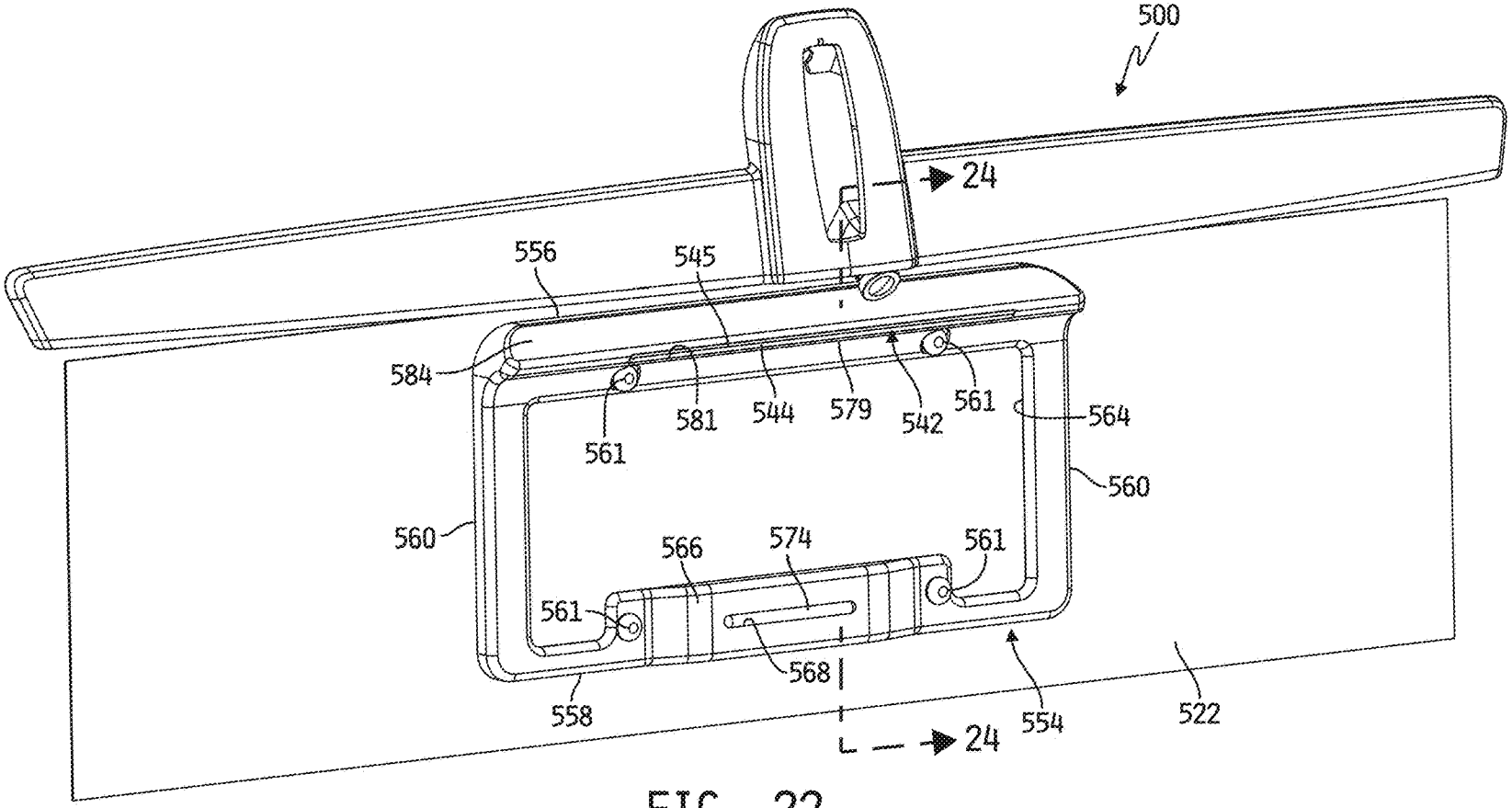
FIG. 22 is a simplified perspective view of an embodiment of a license plate bracket assembly in which the object detection module of any of FIG. 2, 6A 7 or 8 may be embodied, shown mounted to a rear portion of a motor vehicle.

As further illustrated by example in FIGS. 20 and 21, the vehicle access closure 402, e.g., door, which partially defines the vertically oriented seam 415 may be fitted with a passive handle 420 along an inside edge 425 of the closure 402, i.e., along an interior, side surface of the door 402 which is not seen or accessible outside of the motor vehicle when the door 402 is closed but which is seen and accessible when the door 402 is at least partially open. In the illustrated embodiment, the passive handle 420 is illustratively provided in the form of a pocket 422 surrounded by a flange 426 which is attached to the inside edge 425 of the door 402. The pocket 422 illustratively has a sidewall which extends into the inside edge 425 of the door 402 to a bottom surface 424 so as to form a cavity 428 bound by the sides and bottom 424 of the pocket 422. Illustratively, the cavity 428 of the pocket 402 is sized to receive at least two or more fingers of a human hand therein to allow the human hand to facilitate opening the door 402. In the illustrated embodiment, the processor or controller $\mathbf{14_1}$-$\mathbf{14_4}$ is illustratively operable, upon exhibition of a predefined gesture detected by the radiation assembly or module 120, 140, 150, 160, to control at least one actuator driver circuit 40 to activate at least one actuator 46 associated with the door 402 to at least partially open the door 402 sufficiently to allow the two or more fingers of a human hand to access and engage the pocket 402.

As a further example implementation of the object detection module 12 in a motor vehicle, any of the object detection modules $\mathbf{12_1}$-$\mathbf{12_4}$ may be embodied in a motor vehicle access assembly 400 as illustrated by example in FIGS. 22-31. In the embodiment shown in FIGS. 21-31, the motor vehicle access assembly 400 illustratively takes the form of a license plate bracket and sensor assembly 500, 500' for providing hands-free access to a rear access closure, e.g., door, of a motor vehicle 522. It should be appreciated that the terms "rear access closure" and "rear access door" as used herein may include any rear access door for a motor vehicle such as, but not limited to, a lift gate, trunk and tailgate. Additionally, the term "motor vehicle" as used herein may encompass various types of motor vehicles including, but not limited to, automobiles, trucks, all-terrain vehicles and the like.

Figure 23:
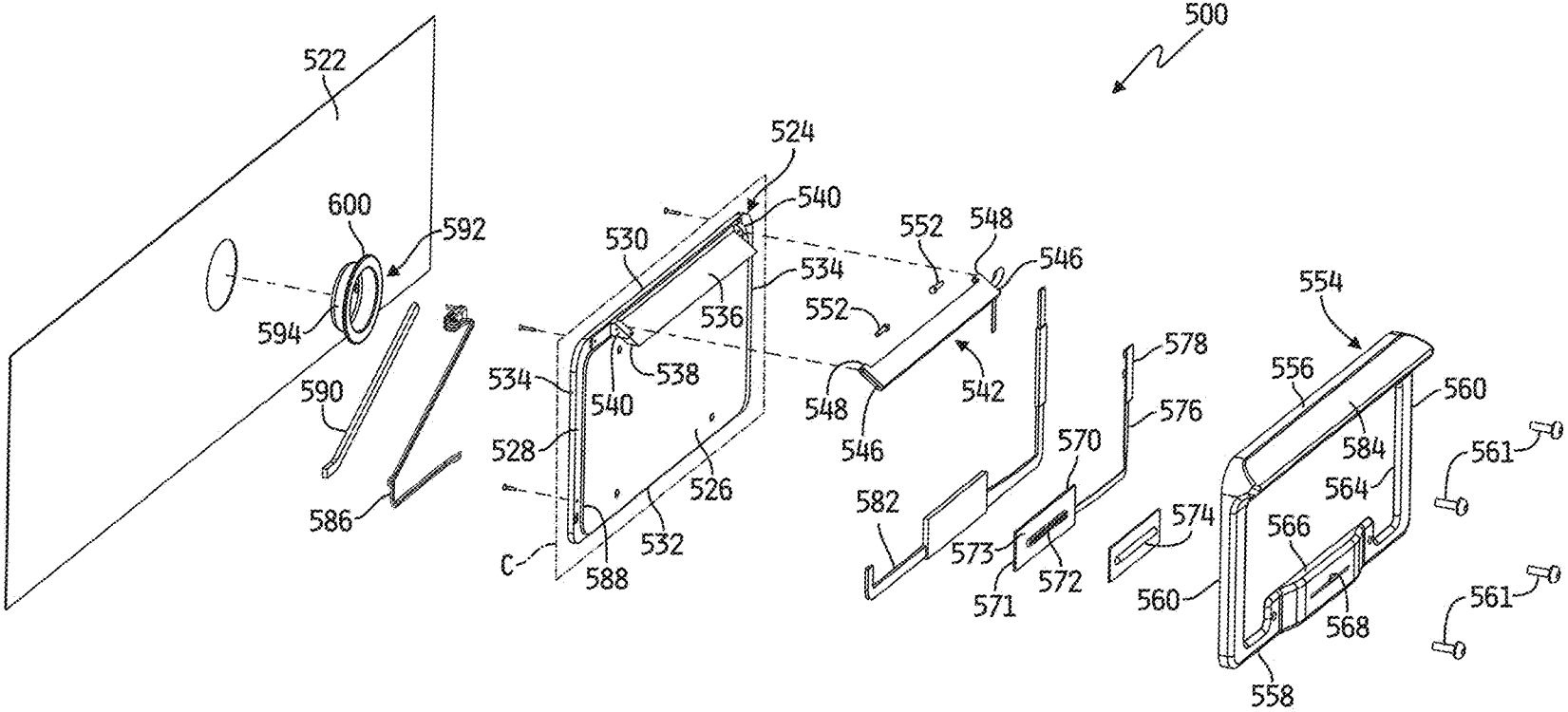
FIG. 23 is an exploded perspective side view of the license plate bracket assembly of FIG. 22.

With specific reference to FIG. 23, the assembly 500 includes a generally rectangular-shaped back plate 524 that extends along a plane C. The back plate 524 presents a front surface 526, a rear surface 528, a top 530, a bottom 532 and a pair of sides 534 that extend between the top 530 and bottom 532. It should be appreciated that the back plate 524 could have other shapes, such as, but not limited to, an oval shape.

Figure 24:
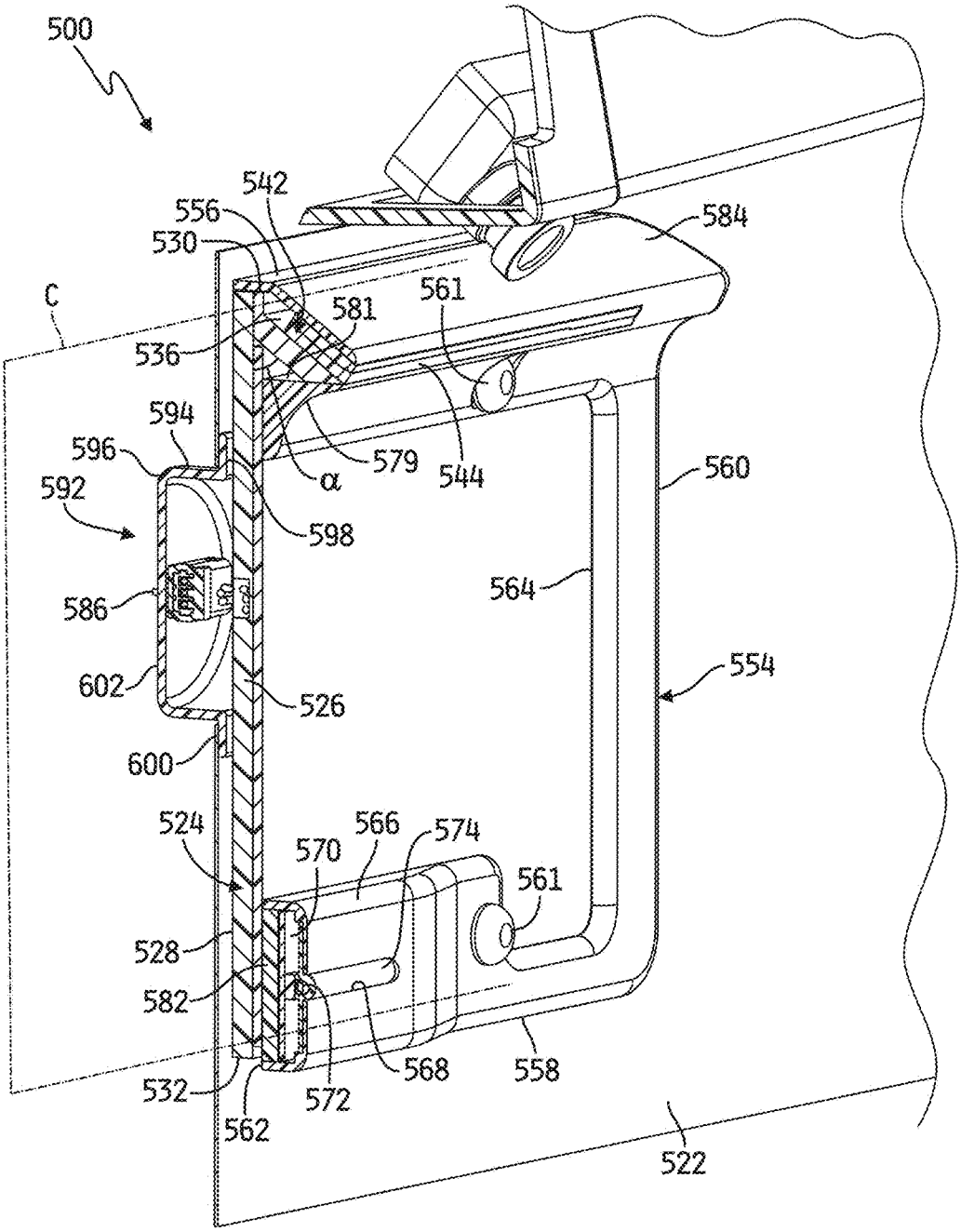
FIG. 24 is a perspective cutaway side view of the license plate bracket assembly of FIG. 22.
Figure 27:
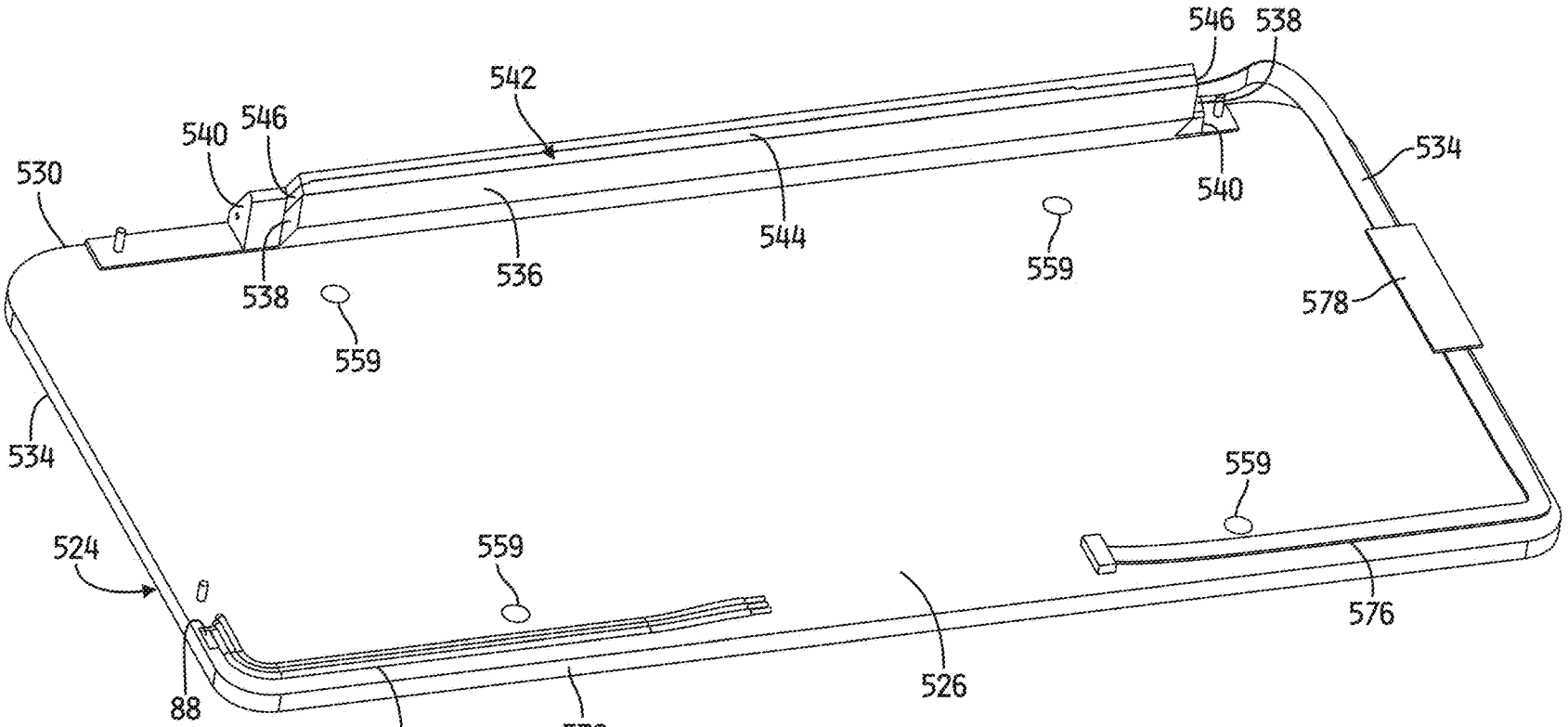
FIG. 27 is a front perspective view of a back plate of the license plate bracket assembly of FIG. 22.
Figure 28:
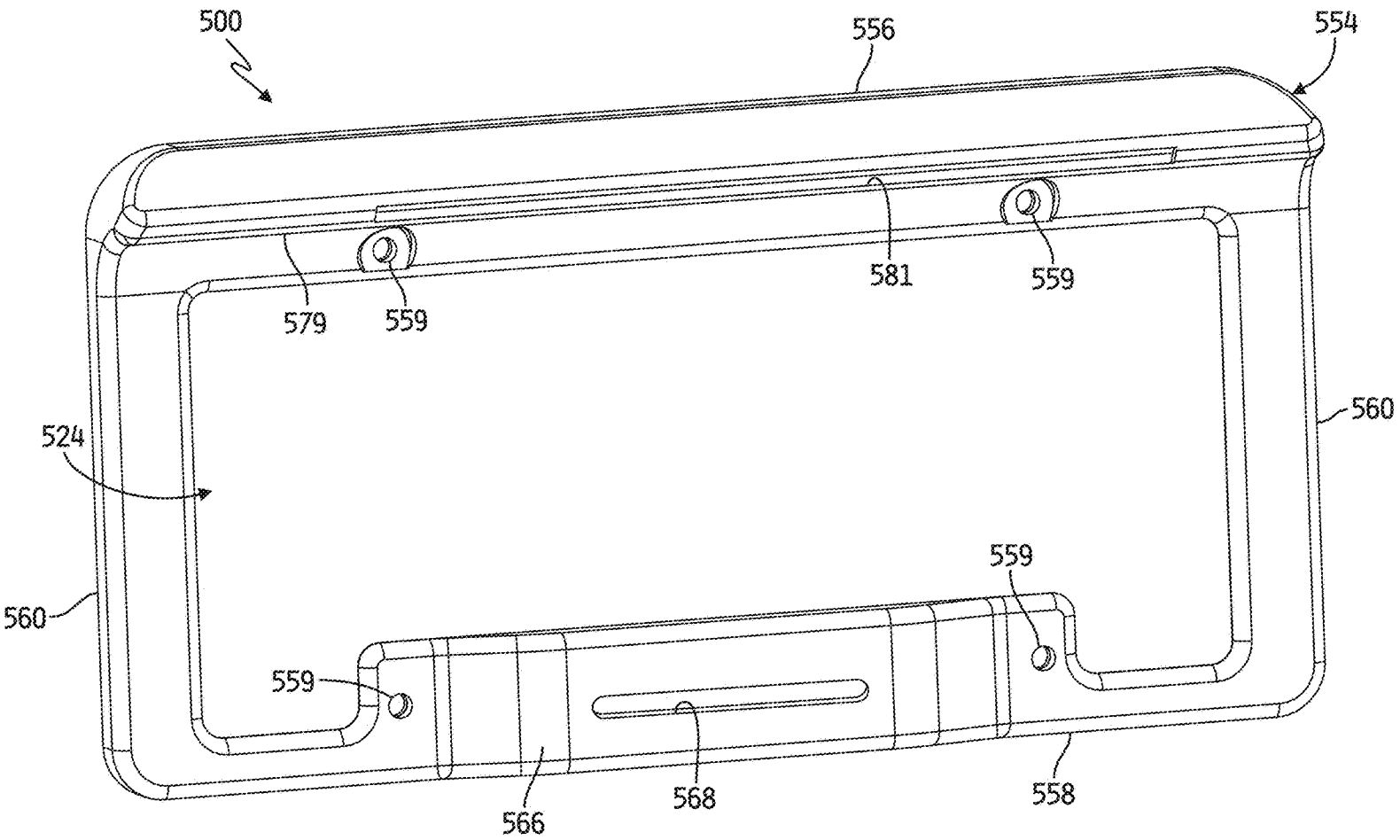
FIG. 28 is a front perspective view of the license plate bracket assembly of FIG. 22.

As best shown in FIG. 24, a first flange 536 extends from the top 530 of the back plate 524 over the front surface 526 at a viewing angle $\alpha$. The viewing angle $\alpha$ is acute relative to the plane C of the back plate 524. As best shown in FIG. 27, the first flange 536 extends between a pair of edges 538 that are spaced inwardly from the sides 534 of the back plate 524. A protrusion 540 extends transversely from the front surface 526 of the back plate 524 adjacent to each of the edges 538 of the first flange 536.

An object detection assembly 542, in the form of one of the object detection module $\mathbf{12_1}$-$\mathbf{12_4}$, overlies the first flange 536. The object detection assembly 542 illustratively includes a radiation emission and detection assembly 544, e.g., in the form of one of the radiation assemblies or modules 120, 140, 150, 160, at the viewing angle $\alpha$ relative to the plane C for detecting movement in a sensing region in front of the assembly 544. It should be appreciated that since the viewing angle $\alpha$ is acute relative to the plane C of the back plate 524, once the assembly 500 is attached or mounted to the motor vehicle 522, the radiation emission and detection assembly 544 is pointed generally toward the feet of an operator that is standing behind the motor vehicle 522, thus allowing the assembly 544 to detect movement in the region of the feet of the operator.

Figure 29:
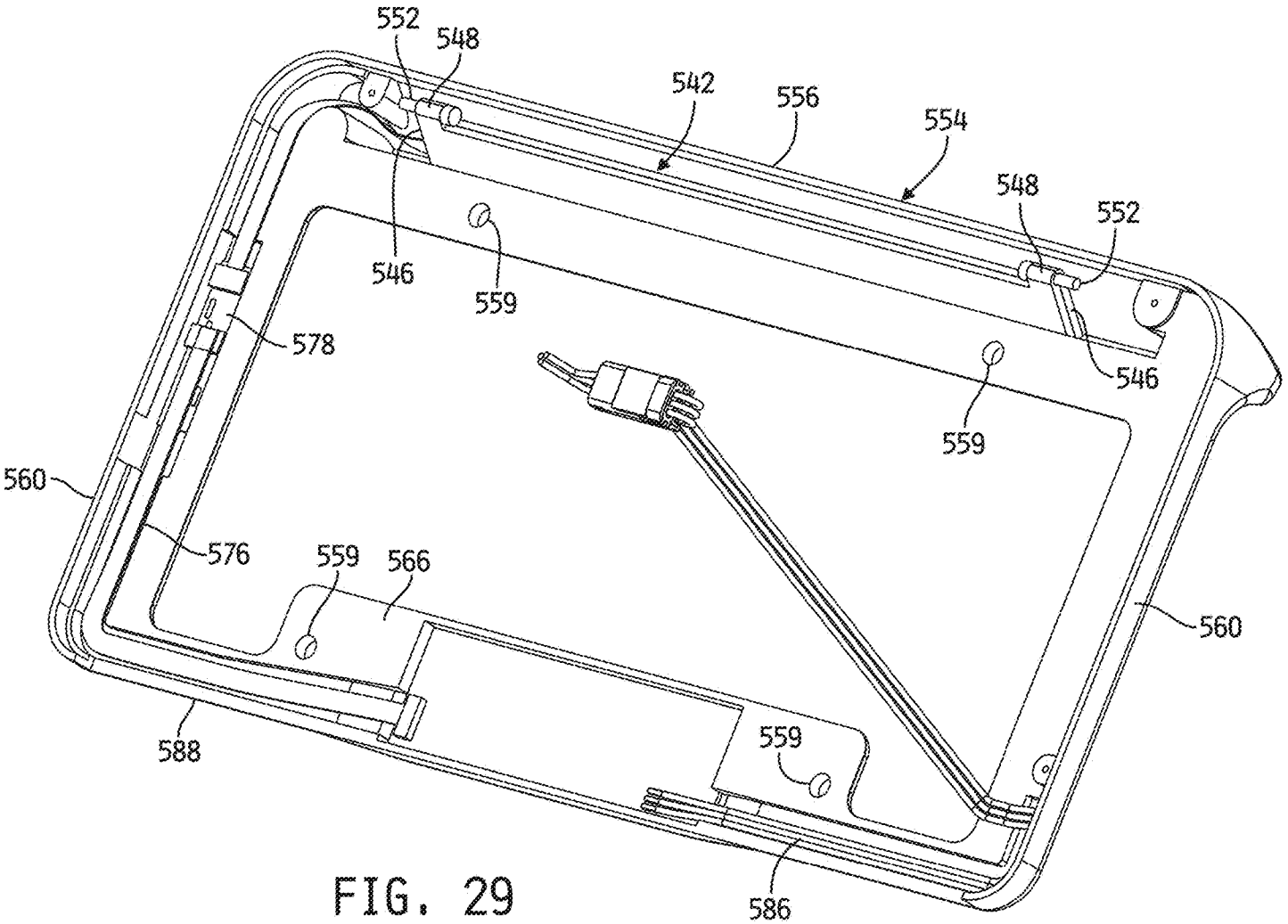
FIG. 29 is a rear perspective view of a plate frame of the license plate bracket assembly of FIG. 22.
Figure 30:
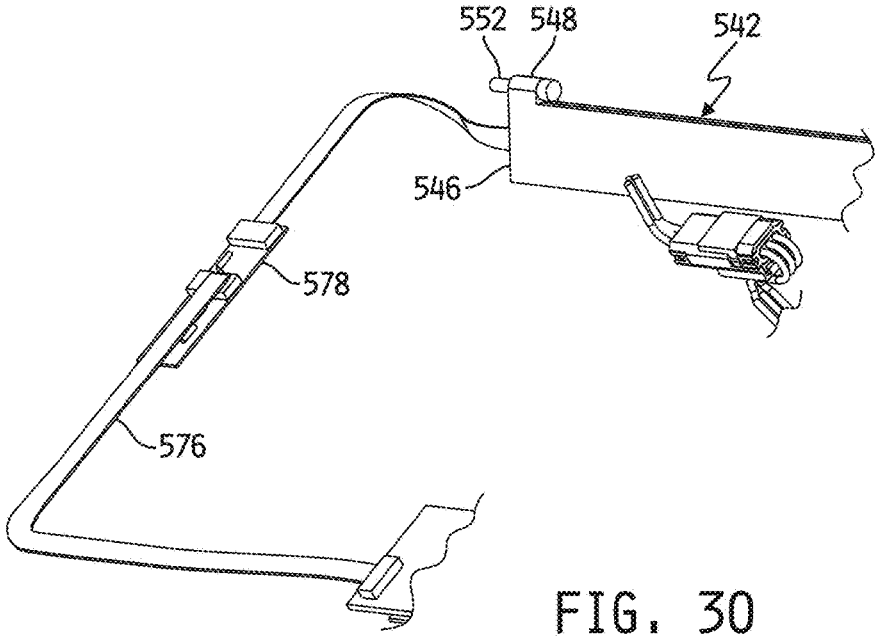
FIG. 30 is a rear perspective view of a plurality of ribbon wires and a jumper board of the license plate bracket assembly of FIG. 22.

As best shown in FIGS. 27 and 29, the object detection assembly 542 extends between a pair of extremities 546, with each of the extremities 546 aligned with one of the edges 538 of the first flange 536. A pair of tabs 548 extend away from the object detection assembly 542, each aligned with one of the extremities 546 and disposed against one of the protrusions 540. A pair of first fasteners 552 each extend through one of the tabs 548 and one of the protrusions 540 to secure the object detection assembly 542 to the first protrusions 540. In the example embodiment, the first fasteners 552 are bolts, however, it should be appreciated that they could be other types of fasteners including, but not limited to, screws or adhesives.

As best shown in FIGS. 22-25, a plate frame 554 overlies the back plate 524. The plate frame 554 has a generally rectangular shaped cross-section and includes an upper segment 556 disposed over the top 530 of the back plate 524, a lower segment 558 disposed over the bottom 532 of the back plate 524 and a pair of flank segments 560 that extend between the upper and lower segments 556, 558 and are disposed over the sides 534 of the back plate 524. The plate frame 554 further defines a window 564 between the upper and lower and flank segments 556, 558, 560 for providing visibility to a license plate 525 disposed between the back plate 524 and the plate frame 554.

Figure 25:
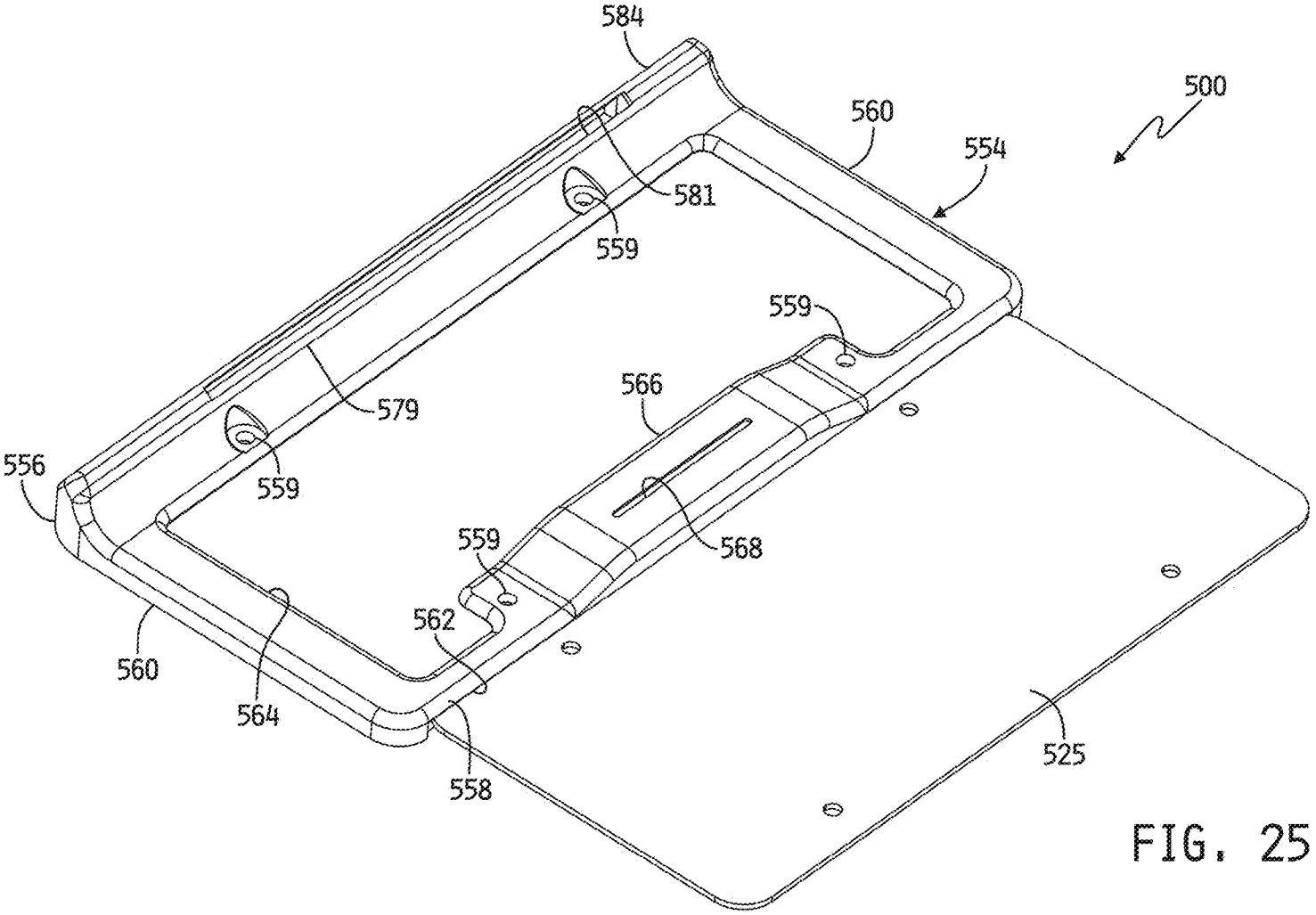
FIG. 25 is a perspective top view of the license plate bracket assembly of FIG. 22 illustrating receipt of a license plate within a slot of the assembly.
Figure 26:
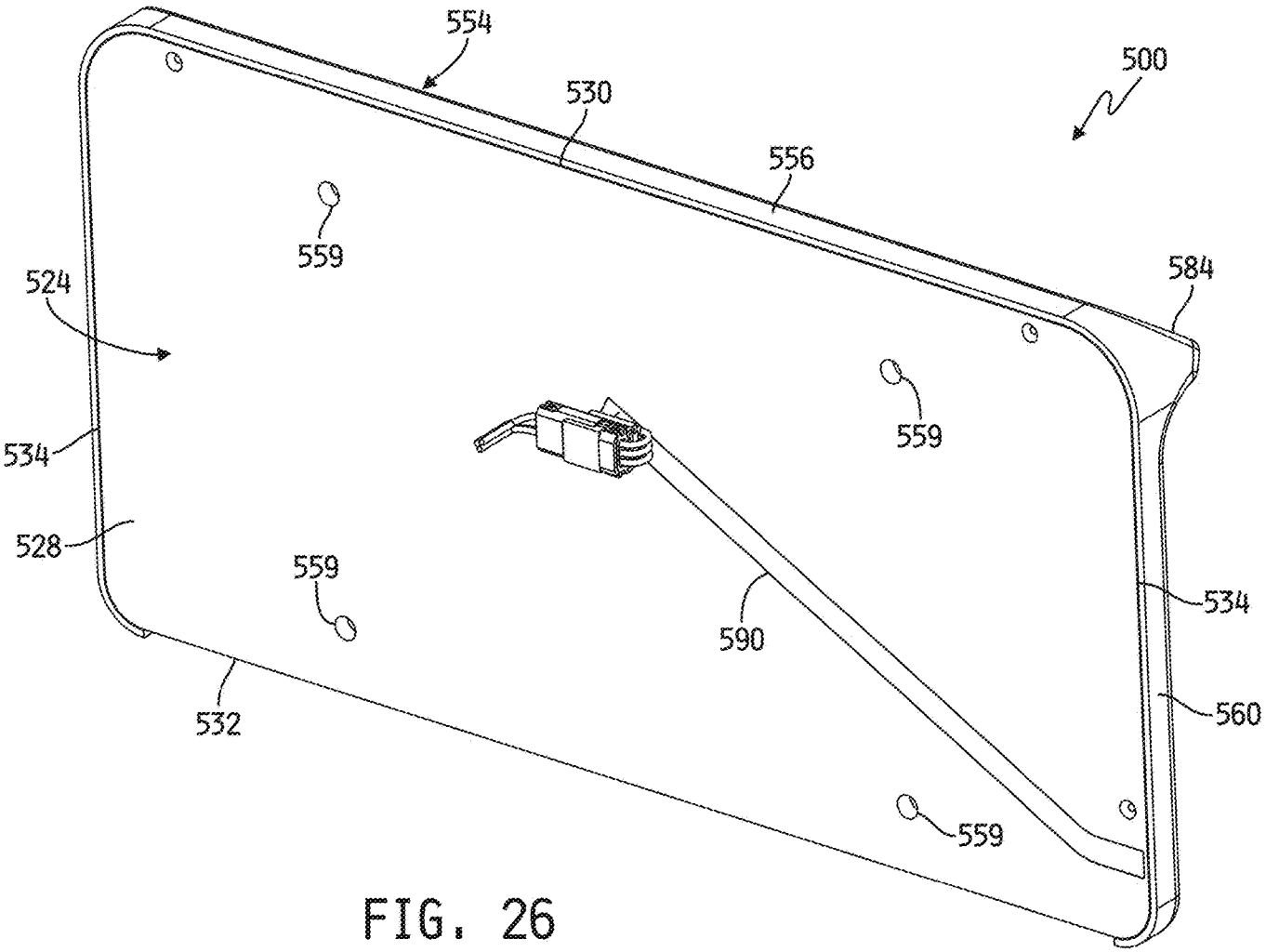
FIG. 26 is a rear perspective view of the license plate bracket assembly of FIG. 22.

As best shown in FIG. 25, the bottom 532 of the back plate 524 and the lower segment 558 of the plate frame 554 define a plate slot 562 therebetween for receiving a license plate 525 between the back plate 524 and the plate frame 554. Said another way, a license plate 525 may be inserted into the object detection assembly 520 through the plate slot 562.

As best shown in FIGS. 23 and 27, a plurality of connection orifices 559 are defined by the plate frame 554 and the back plate 524. A plurality of second fasteners 561 extend through the connection orifices 559 and the license plate 525 for connecting the assembly 500 and the license plate 525 to the motor vehicle 522. In the example embodiments, the second fasteners 561 are bolts; however, it should be appreciated that other types of fasteners could be utilized.

As best shown in FIGS. 23 and 24, a generally rectangular-shaped cover member 566 extends from the lower segment 558 into the window 564 toward the upper segment 556. The cover member 566 defines a linear slit 568 that extends parallel to the lower segment 558 of the plate frame 554.

The processor or controller $\mathbf{14_1}$-$\mathbf{14_2}$ of the object detection assembly 542 is depicted in the example embodiment illustrated in FIGS. 22-30 in the form of a controller 570, 571, which is electrically connected to the object detection assembly 542 for processing information received by the radiation emission and detection assembly 544. In the first example embodiment illustrated in FIGS. 22-30, the controller includes a circuit board 570 that is disposed in alignment with the cover member 566 and is electrically connected to the assembly 544. The circuit board 570 illustratively includes a microprocessor 571 (schematically shown) for processing information received by the assembly 544.

In the illustrated embodiment, the one or more illumination devices 112 is/are depicted in the form of a plurality of light emitting diodes 572 mounted to the circuit board 570 in alignment with the slit 568. Each LED in the plurality of light emitting diodes 572 is electrically connected to the circuit board 570 for emitting light in response to the detection of movement by the assembly 544 as described above. A lens 574 is illustratively disposed between the circuit board 570 and the cover member 566, and overlies the plurality of light emitting diodes 572 for holding the light emitting diodes 572 in place and for protecting the light emitting diodes 572 while allowing light from the light emitting diodes 572 to pass through the lens 574. It should be appreciated that other light emitting devices could be utilized instead of light emitting diodes 572.

In addition to, or as an alternative to the light emitting diodes 572, an audible device 573 (schematically shown and which may be one of the audio devices 66 depicted in FIG.

1) such as a speaker or piezoelectric element may also be disposed on the circuit board 570 or other location of the assembly to provide feedback to an operator of the motor vehicle 522 during use of the object detection assembly 542.

A plurality of first ribbon wires 576 and a jumper board 578 extend between and electrically connect the circuit board 570 and the radiation emission and detection assembly 544. The first ribbon wires 576 extend along the lower and flank segments 558, 560 of the plate frame 554. A first potting material 582 is disposed between back plate 524 and ribbon wires 580 and jumper board 578 for damping vibrations between the back plate 524 and the assembly 544, first ribbon wires 576 and jumper board 578 and for holding the first ribbon wires 576 and jumper board 578 in place relative to the back plate 524.

As best shown in FIGS. 24 and 25, a support member 579 is disposed beneath and engages the first flange 536. The support member 579 extends between the flank segments 557 for supporting the first flange 536. A second flange 584 extends from the upper segment 556 of the plate frame 554 at the viewing angle $\alpha$ and overlies the first flange 536. The second flange 584 and the support member 579 define a detector slot 581 therebetween receiving the object detection assembly 542 for protecting the assembly 542.

As best shown in FIG. 27, the back plate 524 defines a wire opening 588 adjacent to the bottom 532 of the back plate 524. A plurality of second ribbon wires 586 extend from circuit board 570 along the front surface 526 of the back plate 524 adjacent to the bottom 532 of the back plate 524 and through the wire opening 588 and across the rear surface 528 of the back plate 524. A second potting material 590 overlies the second ribbon wires 586 for damping vibrations of the plurality of second ribbon wires 586 and for holding the second ribbon wires 586 in place relative to the rear surface 528 of the back plate 524.

As best shown in FIGS. 23 and 24, a pocket insert 592 of a metal material is fixed to the rear surface 528 of the back plate 524 for being received by a mounting hole on the vehicle 522 for connecting the license plate bracket and sensor assembly 500 to the motor vehicle 522. The pocket insert 592 has a tube portion 594 that extends between a rearward end 596 and a forward end 598. A lip 600 extends outwardly from the forward end 598 of the tube portion 594 and fixedly engages the rear surface 528 of the back plate 524 for connecting the pocket insert 592 to the back plate 524. A lid 602 is disposed across the rearward end 596 of the tube portion 594 to close the rearward end 596. The lid 602 defines a passage 604 that extends therethrough.

The second ribbon wires 586 further extend through the passage 604 for allowing the second ribbon wires 586 to be connected to a computer of the motor vehicle 522 for electrically connecting the circuit board 570 to the computer, e.g., the vehicle control computer 24, of the motor vehicle 522. More specifically, the second wires 576, 580, 586 electrically connect the license plate bracket and sensor assembly 500 to the existing passive entry system of the motor vehicle 522.

Operation of the license plate bracket and sensor assembly 500 is as described above with respect to FIGS. 2-8 in that the microprocessor 571 is programmed to identify a recognizable, predetermined, position, motion or reflection base on signals provided by the object detection assembly 542. Upon recognition of such a position, motion or reflection, the microprocessor 571 illustratively sends one or more signals to the computer 24 of the motor vehicle 522 to open the rear access enclosure. In other words, the microprocessor 571 is configured to receive signals from the object detection assembly 542, and to open the rear access closure in response to the reception and recognition of one or more predetermined signals corresponding to a predefine gesture, e.g., a hand wave or foot wave, within a detection range of the object detection assembly 542.

In embodiments in which the object detection assembly 542 is implemented in the form of the object detection module $\mathbf{12}_1$ or $\mathbf{12}_2$ illustrated in FIGS. 2-6B and described above, the microprocessor 571 is further illustratively configured to cause the one or more illumination devices 112, i.e., the light emitting diodes 572, to emit light, as described above, in a manner which directs the operator to the proper position or motion to open the rear access enclosure of the motor vehicle 522. As one illustrative example, which should not be considered limiting in any way, as the user approaches the side of the assembly 500 the light emitting diodes 572 may initially be controlled to illuminate in red. As the user moves a hand or foot toward the middle of the assembly 500, the light emitting diodes 572 may be controlled to illuminate in amber, and finally to illuminate in green to indicate actuation of an opening mechanism 48 of the rear access closure of the motor vehicle 522. Additionally or as an alternative, the audible device 573 may be activated to further guide the user to the proper position or through the proper predetermined movement to open the rear access closure. Of course, other configurations and/or control techniques of the light emitting diodes 571 may be alternatively or additionally be implemented, several examples of which are described hereinabove.

In embodiments in which the object detection assembly 542 is implemented in the form of the object detection module $\mathbf{12}_3$ or $\mathbf{12}_4$ illustrated in FIGS. 7 and 8 respectively, operation of the assembly 500 may be as just described except with no visual feedback from the module $\mathbf{12}_3$, $\mathbf{12}_4$ due to the absence of the one or more illumination devices 112, e.g., in the form of the light emitting diodes 571.

Figure 31:
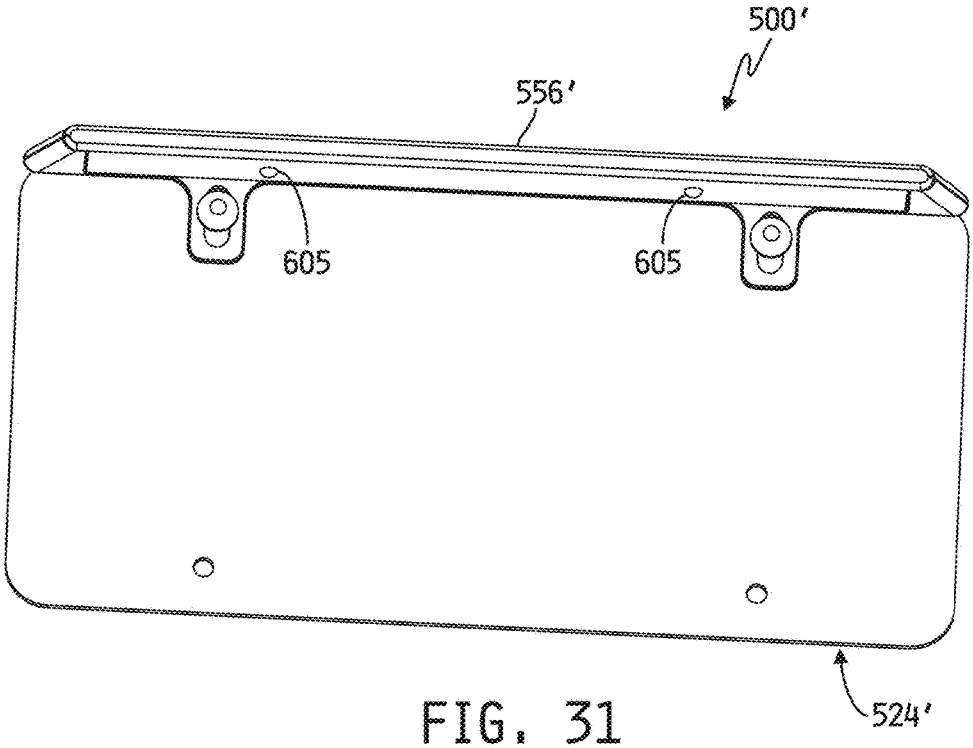
FIG. 31 is a simplified front perspective view of another embodiment of a license plate bracket assembly.

In the second example embodiment of the license plate bracket and sensor assembly 500' illustrated in FIG. 31, the plate frame only extends across the top of the back plate 524', such that only an upper portion of a license plate is covered by the plate frame. In this embodiment, the object detection module $\mathbf{12}_1$-$\mathbf{12}_4$ may be incorporated into an upper segment 556' of the plate frame. Furthermore, a pair of visibility lights 605 may be connected to the upper segment 556' of the plate frame for illuminating the license plate in the event that the assembly 500' casts a shadow on the license plate by blocking the factory installed lights of the motor vehicle 522. It should be appreciated that the first example embodiment of the assembly 500 could also include or more of such visibility lights 605.

Figure 32:
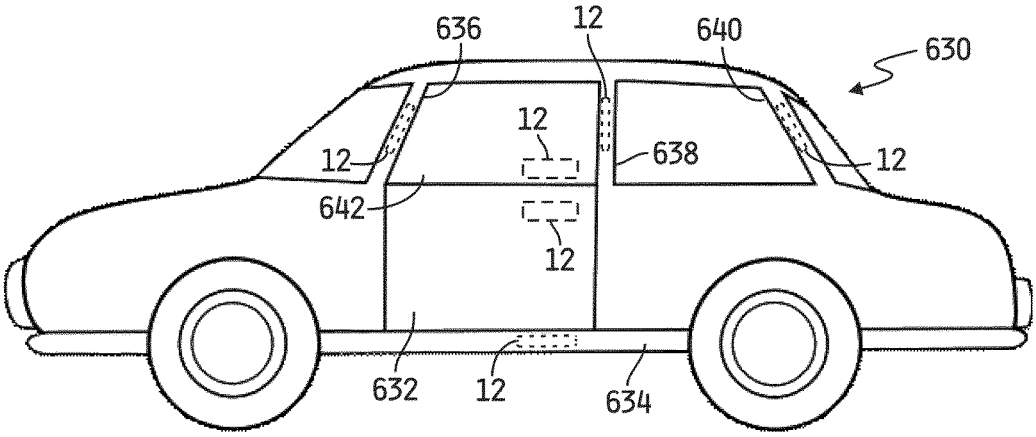
FIG. 32 is a simplified side elevational view of a motor vehicle illustrating various locations on and about the motor vehicle at which the object detection module of any of FIG. 2, 6A 7 or 8 may be mounted.
Figure 33:
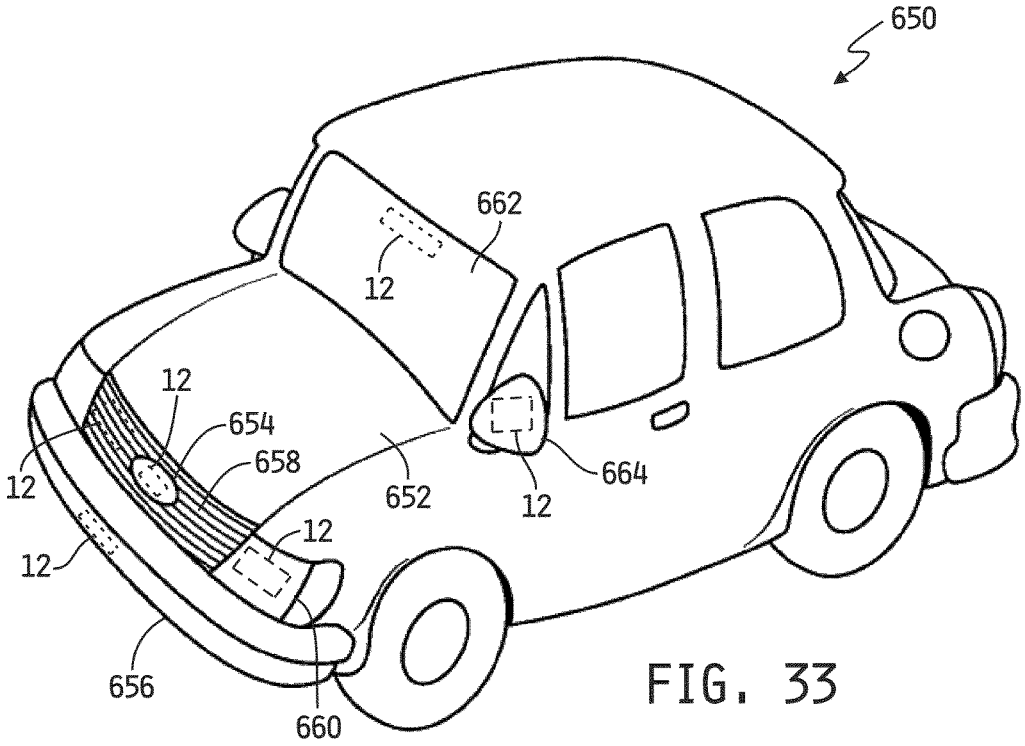
FIG. 33 is a simplified front perspective view of another motor vehicle illustrating various alternate or additional locations on and about the motor vehicle at which the object detection module of any of FIG. 2, 6A 7 or 8 may be mounted.
Figure 34:
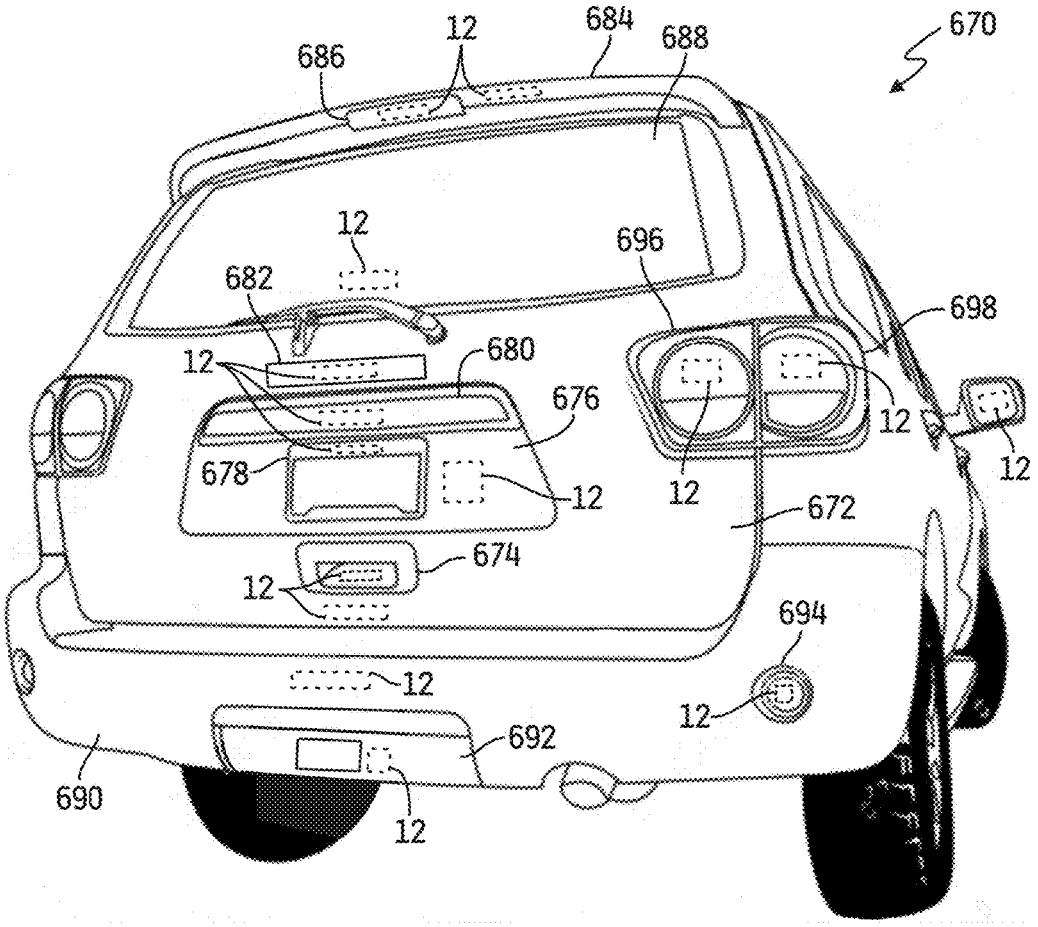
FIG. 34 is a simplified rear perspective view of yet another motor vehicle illustrating further alternate or additional locations on and about the motor vehicle at which the object detection module of any of FIG. 2, 6A 7 or 8 may be mounted.

Referring now to FIG. 32, a motor vehicle 630 is shown depicting various example locations on and around the motor vehicle 630 to or at which all or part of the object detection module 12 (e.g., in any of its example forms $\mathbf{12}_1$-$\mathbf{12}_4$) may be attached, affixed, mounted, integrated or otherwise positioned (collectively "mounted"). For example, one or more object detection modules 12 may be mounted at or to one or more of a side door 632, a rocker panel 634, a so-called "A pillar" 636, a so-called "B pillar" 638, a so-called "C pillar" 640 and a side window 642. Referring to FIG. 33, another motor vehicle 650 is shown depicting other various example locations on and around the motor vehicle 650 to or at which all or part of the object detection module 12 (e.g., in any of its example forms $\mathbf{12}_1$-$\mathbf{12}_4$) may be attached, affixed, mounted, integrated or otherwise positioned (collectively "mounted"). For example, one or more object detection modules 12 may be mounted at or to one or more of an emblem or plaque 654 affixed to a front grille 654 of a hood 652 or front end of the vehicle 650, the front grille 654 or hood 652 itself, a front bumper 656, one or both of the front headlights 660 (or other light fixture(s) on the front of the vehicle 650 and/or on the side of the vehicle 650 adjacent to the front of the vehicle 650), a front windshield 662 and one or more side mirror housings 664. Referring to FIG. 34, yet another motor vehicle 670 is shown depicting still other various example locations on and around the motor vehicle 670 to or at which all or part of the object detection module 12 (e.g., in any of its example forms $\mathbf{12_1}$-$\mathbf{12_4}$) may be attached, affixed, mounted, integrated or otherwise positioned (collectively "mounted"). For example, one or more object detection modules 12 may be mounted at or to one or more of a handle or handle area 674 of a rear closure 672, e.g., rear door or hatch, of the motor vehicle 670, an accessory area 676, e.g., in or to which a license plate and/or lighting may be mounted, a license plate frame 678, a license plate lamp assembly or other rear lamp assembly 680, an emblem or plaque 682 affixed to the rear closure 672, a rear spoiler 684, a brake lamp assembly 686 mounted to the rear spoiler 684 or to the rear closure 672, a rear window 688, the rear bumper 690, a main or auxiliary license plate area 692 of or adjacent to the rear bumper 690, a rear lamp assembly 694 mounted to or within the rear bumper 690, at least one rear lamp assembly 696 mounted to the rear closure 672 and at least one rear lamp assembly 698 mounted to the body of the motor vehicle 670 adjacent to the rear closure 672.

Figure 35:
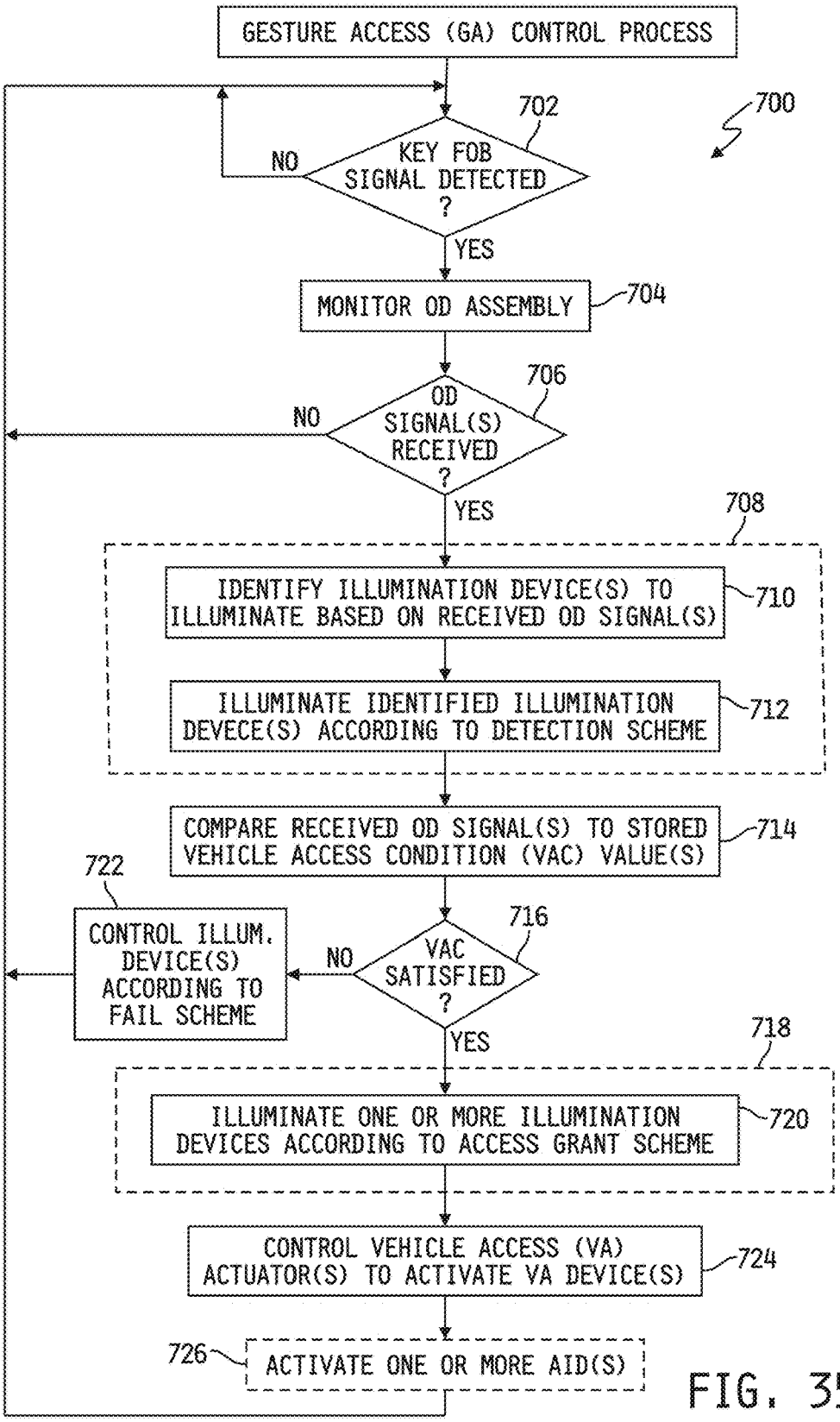
FIG. 35 is a simplified flowchart of an embodiment of a gesture access process executable by one or more processors illustrated in FIG. 1.
Figure 36:
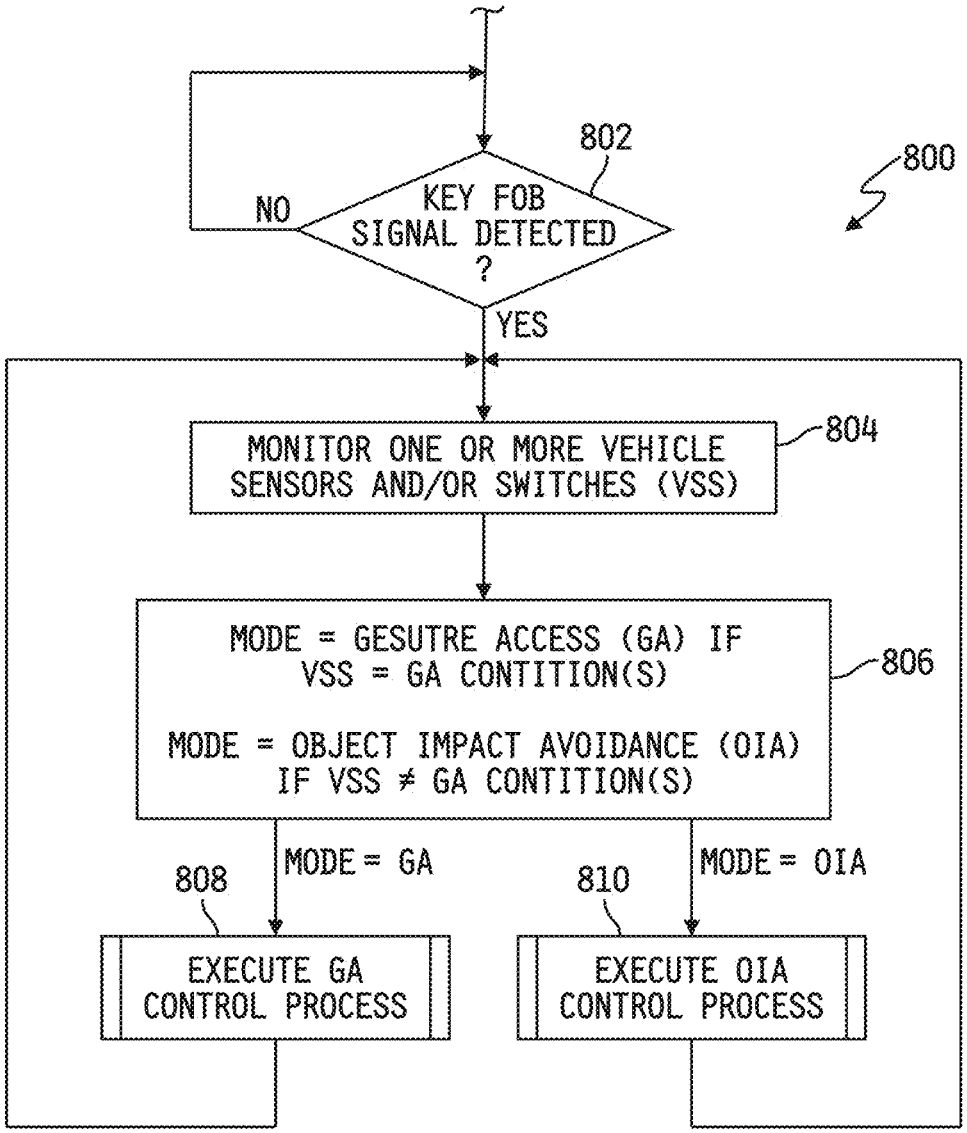
FIG. 36 is a simplified flowchart of an embodiment of a process for executing either of a gesture access process or an object impact avoidance process based upon the status of one or more vehicle sensors and/or switches.
Figure 37:
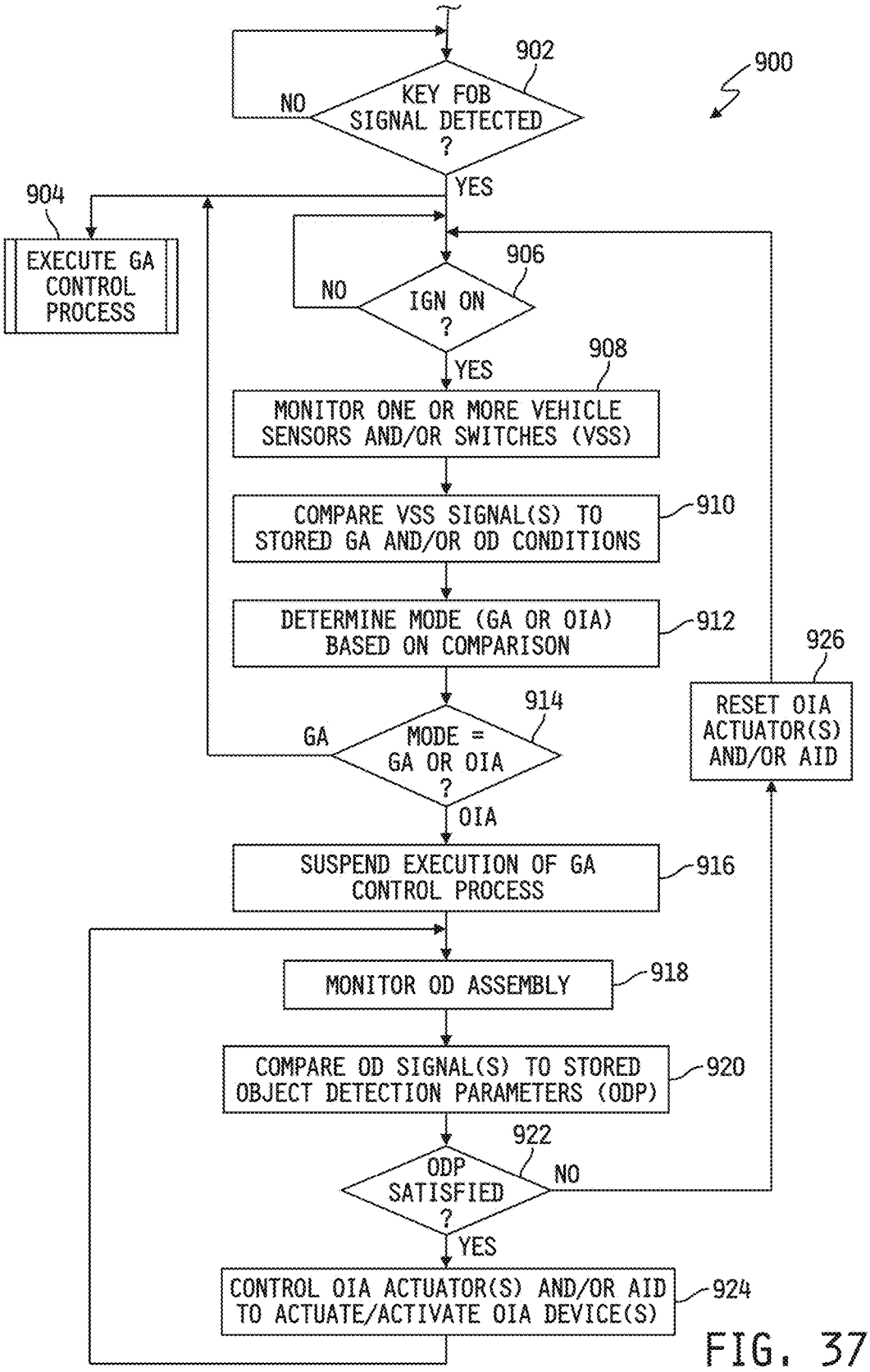
FIG. 37 is a simplified flowchart of another embodiment of a process for executing either of a gesture access process or an object impact avoidance process based upon the status of one or more vehicle sensors and/or switches.

In some embodiments, at least one object detection module 12 illustrated in any of FIGS. 13-34 may include at least one illumination device 112, and in such embodiments the at least one object detection module 12 may be implemented in the form of the object detection module $\mathbf{12_1}$ and/or the object detection module $\mathbf{12_2}$ operable to provide for gesture access to the motor vehicle with visual feedback provided by the at least one illumination device 112 as described hereinabove. In some such embodiments and/or in other embodiments, at least one object detection module 12 illustrated in any of FIGS. 9-12 and 17-34 may not include any illumination device(s) 112, and in such embodiments the at least one object detection module 12 may be implemented in the form of the object detection module $\mathbf{12_3}$ and/or the object detection module $\mathbf{12_4}$ operable to provide for gesture access to the motor vehicle with no visual feedback provided by the object detection module $\mathbf{12_3}$ and/or the object detection module $\mathbf{12_4}$ as also described hereinabove. An example process for providing for such gesture access is illustrated in FIG. 35 and will be described in detail below. In some such embodiments and/or in still other embodiments, at least one object detection module 12 illustrated in any of FIGS. 9-34 may be implemented in the form of the object detection module $\mathbf{12_2}$ and/or the object detection module $\mathbf{12_4}$ which include the radiation emission and detection assembly 130, in the form of at least one radar transmitter 132 and a plurality of radar detectors or receivers 134, to selectively provide for (i) gesture access to the motor vehicle, with or without visual feedback when, e.g., movement of the motor vehicle is disabled, and (ii) object detection for object impact avoidance when, e.g., the motor vehicle is moving or is enabled to move, as briefly described above. Example processes for selectively providing for gesture access and object impact avoidance are illustrated in FIGS. 36 and 37 and will be described in detail below.

Referring now to FIG. 35, a simplified flowchart is shown of a process 700 for providing gesture access to one or more access closures of a motor vehicle in or to which at least one object detection module 12 is mounted. In one embodiment, the process 700 is illustratively stored in the at least one memory 16 of the object detection module 12 in the form of instructions which, when executed by the at least one processor or controller 14 of the object detection module 12, cause the at least one processor or controller 14 to execute the corresponding functions. It will be understood that in some alternate embodiments, such instructions may be stored, in whole or in part, in any one or more of the memory units illustrated in FIG. 1, e.g., in one or more of the memory 16 of the object detection module 12, the memory 28 of the vehicle control computer 24, the memory 44 of the actuator driver circuit(s) 40 and the memory 64 of the audio/illumination device driver circuit(s) 60, and provided to the at least one processor or controller 14 for execution thereby. In other alternate embodiments, such instructions, wherever stored, may be executed, in whole or in part, by any one or more of the processors or controllers illustrated in FIG. 1, e.g., by one or more of the processors or controllers 14, 26, 42 and 62. For purposes of the following description, the process 700 will be described as being executed by the processor or controller 14, it being understood that the process 700 may alternatively or additionally be executed, in whole or in part, by one or more of the processors or controllers 26, 42, 62.

It will be further understood that the process 700 may be executed using any of the object detection modules $\mathbf{12_1}$-$\mathbf{12_4}$. In this regard, dashed-line boxes are shown around some of the steps or groups of steps of the process 700 to identify steps which are part of the process 700 when the object detection module 12 is implemented in the form of the object detection module $\mathbf{12_1}$ or the object detection module $\mathbf{12_2}$ to include at least one illumination device 112. As will be described below, such steps are illustratively omitted in embodiments in which the object detection module 12 is implemented in the form of the object detection module $\mathbf{12_3}$ or the object detection module $\mathbf{12_4}$ which do not include any such illumination devices 112.

The process 700 illustratively begins at step 702 where the processor or controller 14 is operable to determine whether a Key Fob signal has been detected. As described above, the Key Fob signal is illustratively produced by a conventional Key Fob 20 or other mobile electronic device. In some embodiments, the Key Fob signal is received by the communication circuit 30 of the vehicle control computer 24 and passed, processed or unprocessed, to the processor or controller 14. In other embodiments in which the object detection module 12 includes a communication circuit 18, the Key Fob signal may be received directly by the processor or controller 14. In any case, until the Key Fob signal is detected, the process 700 loops back to step 702.

If the Key Fob signal is received by the communication circuit 30 of the vehicle control computer 24, the processor or controller 26 of the vehicle control computer 24 is illustratively operable to decode the received Key Fob signal and determine whether it matches at least one Key Fob code stored in the memory 28. If not, the processor or controller 26 disregards or ignores the Key Fob signal and the process 700 loops back to step 702. Likewise, if the Key Fob signal is received by the communication circuit 18 of the object detection module 12, the processor 14 is similarly operable to determine whether the received Key Fob signal matches at least one Key Fob code stored in the memory 16 or in the memory 28. If not, the process 700 likewise loops back to step 702. Thus, the process 700 advances along the "YES" branch of step 702 only if the received Key Fob signal matches at least one stored Key Fob code, such that the gesture access process proceeds only for authorized users, i.e., only for users carrying a Key Fob 20 that is recognizable by the object detection system 10. It will be understood that some embodiments of the process 700 may not include step 702, and in such embodiments the process 700 begins at step 704.

Following the "YES" branch of step 702 (in embodiments which include step 702), the process 700 advances to step 704 where the processor or controller 14 is operable to monitor the object detection assembly; more specifically, to monitor the radiation emission and detection assembly 100, 130 of the respective object detection module $\mathbf{12}_1$-$\mathbf{12}_4$ for object detection signals produced thereby, if any. In some embodiments, the processor or controller 14 is operable at step 704 to activate the radiation emission and detection assembly 100, 130 to begin transmitting radiation following step 702, and in other embodiments the radiation emission and detection assembly 100, 130 may already be operating and the processor or controller 14 may be operable at step 704 to begin monitoring the signals being produced by the previously activated radiation emission and detection assembly 100, 130.

In any case, following step 704 the processor or controller 14 is operable at step 706 to determine whether any object detection signals have been produced by the radiation emission and detection assembly 100, 130 of the respective object detection module $\mathbf{12}_1$-$\mathbf{12}_4$. If not, then an object has not been detected within the sensing region of the radiation emission and detection assembly 100, 130 of the respective object detection module $\mathbf{12}_1$-$\mathbf{12}_4$. In some embodiments, the process 700 advances from the "NO" branch of step 706 back to the beginning of step 702 as illustrated by example in FIG. 35. In some alternate embodiments, the process 700 may advance from the "NO" branch of step 706 back to the beginning of step 706 such that the process 700 continually checks for an object detection until an object is detected. In such embodiments, a timer or counter may illustratively be implemented such that the process 700 exits the loop of step 706, e.g., by looping back to the beginning of step 702, after a predefined time period has elapsed since detecting the Key Fob signal without thereafter detecting an object. If, at step 706, the signal(s) received from the radiation emission and detection assembly 100, 130 of the respective object detection module $\mathbf{12}_1$-$\mathbf{12}_4$ indicate that an object is detected within the sensing region of thereof, the process 700 proceeds from step 706 along the "YES" branch.

In embodiments in which the object detection module 12 is implemented in the form of the object detection module $\mathbf{12}_1$ or the object detection module $\mathbf{12}_2$, the process 700 illustratively includes step 708. Conversely, in embodiments in which the object detection module 12 is implemented in the form of the object detection module $\mathbf{12}_3$ or the object detection module $\mathbf{12}_4$, the process 700 does not include step 708. In implementations of the process 700 which include it, step 708 illustratively includes step 710 in which the processor or controller 14 is operable to identify one or more illumination devices 112 to illuminate based on the received object detection (OD) signal(s) produced by the radiation emission and detection assembly 100, 130 of the respective object detection module $\mathbf{12}_1$, $\mathbf{12}_2$. Thereafter at step 712, the processor or controller 14 is operable to control one or more of the driver circuit(s) DC to illuminate the identified illumination device(s) 112 according to a predefined detection scheme.

In one embodiment, the processor or controller 14 is operable at steps 710 and 712 to identify and illuminate at least one of the illumination devices 112 according to various different detection or illumination schemes. For example, if an object is determined, based on the object detection signals produced by the radiation emission and detection assembly 100, 130, to be within the sensing region of the radiation emission and detection assembly 100, 130 but within a sub-region of the sensing region that is too small to allow determination by the radiation emission and detection assembly 100, 130 and/or by the processor or controller 14 of whether the object within the sensing region exhibits a predefined gesture, the processor or controller 14 is operable to control illumination of the one or more illumination devices 112 according to an "insufficient detection" illumination scheme. In one embodiment in which the object detection module $\mathbf{12}_1$ or $\mathbf{12}_2$ includes a plurality of illumination devices in the form of an array 110 extending at least partially across the sensing region as described above with respect to the example illustrated in FIG. 3A, the processor or controller 14 is operable to identify for illumination according to the "insufficient detection" scheme those of the illumination devices 112 which occupy the same or substantially the same sub-region of the sensing region as that occupied by the object, and to control such identified illumination devices 112 to illuminate with a predefined color, e.g., red. Alternatively or additionally, the controller 14 may be operable at step 712 to control the identified illumination devices 112 to illuminate according to the "insufficient detection" scheme by switching on and off at a predefined frequency and/or with a predefined duty cycle, and/or to illuminate only a subset of the illumination devices. In embodiments which include more or fewer illumination devices, the processor or controller 14 may be operable at steps 710 and 712 to control at least one illumination device 112 to illuminate according to the "insufficient detection" illumination scheme by illuminating with at least one of a predefined color, a predefined frequency and a predefined duty cycle.

As another example, if an object is determined, based on the object detection signals produced by the radiation emission and detection assembly 100, 130, to be within the sensing region of the radiation emission and detection assembly 100, 130 and also within a sub-region of the sensing region in which the radiation emission and detection assembly 100, 130 and/or by the processor or controller 14 can determine whether the object therein exhibits a predefined gesture, the processor or controller 14 is operable to control illumination of the one or more illumination devices 112 according to an "object detection" illumination scheme. In one embodiment in which the object detection module $\mathbf{12}_1$ or $\mathbf{12}_2$ includes a plurality of illumination devices in the form of an array 110 extending at least partially across the sensing region as described above with respect to the example illustrated in FIG. 4, the processor or controller 14 is operable to identify for illumination according to the "object detection" scheme those of the illumination devices 112 which occupy the same or substantially the same sub-region of the sensing region as that occupied by the object, and to control such identified illumination devices 112 to illuminate with a predefined color that is different from any that may be used in other illumination schemes, e.g., in this case, amber. Alternatively or additionally, the controller 14 may be operable at step 712 to control the identified illumination devices 112 to illuminate according to the "object detection" scheme by switching on and off at a predefined frequency and/or with a predefined duty cycle different from any such predefined frequency and/or duty cycle used in different illumination schemes, and/or to illuminate only a subset of the illumination devices different from any subset used in other illumination schemes. In embodiments which include more or fewer illumination devices, the processor or controller 14 may be operable at steps 710 and 712 to control at least one illumination device 112 to illuminate according to the "object detection" illumination scheme by illuminating with at least one of a predefined color, a predefined frequency and a predefined duty cycle which is/are different that that/those used in other illumination schemes.

In embodiments which include step 708, the process 700 advances from step 712 to step 714, and in embodiments which do not include step 708 the process 700 advances from the "YES" branch of step 706 to step 714. In any case, the processor or controller 14 is operable at step 714 to compare the received object detection signals (OD), i.e., received from the radiation emission and detection assembly 100, 130, to one or more vehicle access condition (VAC) values stored in the memory 16 (or the memory 28, 42 and/or 64), and to determine at step 716 whether the VAC is satisfied. In some embodiments, for example, the stored VAC is satisfied if the object detected within a suitable sub-region of the sensing region of the radiation emission and detection assembly 100, 130 exhibits a predefined gesture which, when processed by the processor or controller 14 to determine a corresponding vehicle access value, matches the stored VAC as described above. Alternatively or additionally, as also described above, one or more VAC values stored in the memory 16, 28, 42 and/or 64 may be associated in the memory with a corresponding Key Fob code, and in some embodiments multiple VAC values are stored in the memory 16, 28, 42, 64 with each associated with a different Key Fob code. In some such embodiments, vehicle access may be granted only if the combination of the Key Fob code and associated VAC are satisfied.

In embodiments in which the object detection module 12 is implemented in the form of the object detection module $\mathbf{12}_1$ or the object detection module $\mathbf{12}_2$, the process 700 illustratively includes step 718 to which the process 700 advances from the "YES" branch of step 716. Conversely, in embodiments in which the object detection module 12 is implemented in the form of the object detection module $\mathbf{12}_3$ or the object detection module $\mathbf{12}_4$, the process 700 does not include step 718. In implementations of the process 700 which include it, step 718 illustratively includes step 720 in which the processor or controller 14 is operable to control one or more of the driver circuit(s) DC to illuminate the identified illumination device(s) 112 according to another predefined detection or illumination scheme different from the "insufficient detection" and "object detection" schemes described above. For example, if an object previously determined to be within the sensing region of the radiation emission and detection assembly 100, 130 is determined, based on the object detection signals produced by the radiation emission and detection assembly 100, 130, to exhibit a predefined gesture as described above, the processor or controller 14 is illustratively operable to control illumination of one or more illumination devices 112 according to an "access grant" illumination scheme. In one embodiment in which the object detection module $\mathbf{12}_1$ or $\mathbf{12}_2$ includes a plurality of illumination devices in the form of an array 110 extending at least partially across the sensing region as described above with respect to the example illustrated in FIG. 5, the processor or controller 14 is operable to identify for illumination according to the "access grant" scheme those of the illumination devices 112 which occupy the same or substantially the same sub-region of the sensing region as that occupied by the object, and to control such identified illumination devices 112 to illuminate with a predefined color that is different from any that may be used in other illumination schemes, e.g., in this case, green. Alternatively or additionally, the controller 14 may be operable at step 718 to control the identified illumination devices 112 to illuminate according to the "access grant" scheme by switching on and off at a predefined frequency and/or with a predefined duty cycle different from any such predefined frequency and/or duty cycle used in other illumination schemes, and/or to illuminate only a subset of the illumination devices different from any subset used in other illumination schemes. In embodiments which include more or fewer illumination devices, the processor or controller 14 may be operable at step 718 to control at least one illumination device 112 to illuminate according to the "access grant" illumination scheme by illuminating with at least one of a predefined color, a predefined frequency and a predefined duty cycle which is/are different that that/those used in other illumination schemes.

In embodiments which include step 718, the process 700 advances from step 718 to step 724, and in embodiments which do not include step 718 the process 700 advances from the "YES" branch of step 716 to step 724. In any case, the processor or controller 14 is operable at step 724 to control one or more of the actuator driver circuits 40 to activate one or more corresponding vehicle access actuators 46 in order to actuate one or more corresponding vehicle access closure devices. Examples of such vehicle access closure devices may include, but are not limited to, one or more access closure locks, one or more access closure latches, and the like. At step 724, the processor or controller 14 may be operable to, for example, control at least one lock actuator associated with at least one access closure of the motor vehicle to unlock the access closure from a locked state or condition and/or to lock the access closure from an unlocked state or condition, and/or to control at least one latch actuator associated with at least one access closure of the motor vehicle to at least partially open the access closure from a closed position or condition and/or to close the access closure from an at least partially open position or condition.

In some embodiments, the process 700 may optionally include a step 726 to which the process 700 advances from step 724, as illustrated by dashed-line representation in FIG. 35. In embodiments which include it, the processor or controller 14 is operable at step 724 to control one or more of the audio and/or illumination device driver circuits 60 to activate one or more corresponding audio and/or illumination devices 66 in addition to controlling one or more vehicle access actuators to activate one or more vehicle access devices at step 724 following detection at step 716 of exhibition of a predefined gesture by the object within the sensing region of the radiation emission and detection assembly 100, 130. Example audio devices which may be activated at step 726 may include, but are not limited to, the vehicle horn, an audible device configured to emit one or more chirps, beeps, or other audible indicators, or the like. Example illumination devices which may be activated at step 726 in addition to one or more illumination devices 112 (in embodiments which include one or more such illumination devices 112) may include, but are not limited to, one or more existing exterior motor vehicle lights or lighting systems, e.g., headlamp(s), tail lamp(s), running lamp(s), brake lamp(s), side marker lamp(s), or the like, and one or more existing interior motor vehicle lights or lighting systems, e.g., dome lamp, access closure-mounted lamp(s), motor vehicle floor-illumination lamp(s), trunk illumination lamp (s), or the like. In any case, following step 726, or following step 724 in embodiments which do not include step 726, the process 700 illustratively loops back to step 702.

In embodiments in which the object detection module 12 is implemented in the form of the object detection module $\mathbf{12}_1$ or the object detection module $\mathbf{12}_2$, the process 700 may illustratively include step 722 to which the process 700 advances from the "NO" branch of step 716. Conversely, in embodiments in which the object detection module 12 is implemented in the form of the object detection module $\mathbf{12}_3$ or the object detection module $\mathbf{12}_4$, the process 700 does not include step 72. In implementations of the process 700 which include it, the processor or controller 14 is illustratively operable at step 722 to control one or more of the driver circuit(s) DC to illuminate the identified illumination device(s) 112 according to another predefined detection or illumination scheme different from the "insufficient detection," "object detection" and "access grant" schemes described above. For example, if an object previously determined to be within the sensing region of the radiation emission and detection assembly 100, 130 is determined, based on the object detection signals produced by the radiation emission and detection assembly 100, 130, to fail to exhibit a predefined gesture as described above within a predefined time period following execution of step 712, the processor or controller 14 may illustratively be operable to control illumination of one or more illumination devices 112 according to a "fail" illumination scheme. In one embodiment in which the object detection module $\mathbf{12}_1$ or $\mathbf{12}_2$ includes a plurality of illumination devices in the form of an array 110 extending at least partially across the sensing region as described above with respect to the example illustrated in FIGS. 3A-5, the processor or controller 14 is operable to identify for illumination according to the "fail" scheme those of the illumination devices 112 which occupy the same or substantially the same sub-region of the sensing region as that occupied by the object, and to control such identified illumination devices 112 to illuminate with a predefined color that is different from any that may be used in other illumination schemes, e.g., in this case, red. Alternatively or additionally, the controller 14 may be operable at step 722 to control the identified illumination devices 112 to illuminate according to the "fail" scheme by switching on and off at a predefined frequency and/or with a predefined duty cycle different from any such predefined frequency and/or duty cycle used in other illumination schemes, and/or to illuminate only a subset of the illumination devices different from any subset used in other illumination schemes. In embodiments which include more or fewer illumination devices, the processor or controller 14 may be operable at step 722 to control at least one illumination device 112 to illuminate according to the "fail" illumination scheme by illuminating with at least one of a predefined color, a predefined frequency and a predefined duty cycle which is/are different that that/those used in other illumination schemes.

Referring now to FIG. 36, a simplified flowchart is shown of a process 800 for selectively providing for (i) gesture access to the motor vehicle, with or without visual feedback, under some operating conditions of the motor vehicle, and (ii) object impact avoidance under other operating conditions of the motor vehicle in or to which at least one object detection module 12 is mounted. Any such object detection module 12 will illustratively be implemented in the form of the object detection module $\mathbf{12}_2$ and/or the object detection module $\mathbf{12}_4$, either of which include the radiation emission and detection assembly 130 in the form of at least one radar transmitter 132 and a plurality of radar detectors or receivers 134. In one embodiment, the process 800 is illustratively stored in the at least one memory 16 of the object detection module 12 in the form of instructions which, when executed by the at least one processor or controller 14 of the object detection module 12, cause the at least one processor or controller 14 to execute the corresponding functions. It will be understood that in some alternate embodiments, such instructions may be stored, in whole or in part, in any one or more of the memory units illustrated in FIG. 1, e.g., in one or more of the memory 16 of the object detection module 12, the memory 28 of the vehicle control computer 24, the memory 44 of the actuator driver circuit(s) 40 and the memory 64 of the audio/illumination device driver circuit(s) 60, and provided to the at least one processor or controller 14 for execution thereby. In other alternate embodiments, such instructions, wherever stored, may be executed, in whole or in part, by any one or more of the processors or controllers illustrated in FIG. 1, e.g., by one or more of the processors or controllers 14, 26, 42 and 62. For purposes of the following description, the process 800 will be described as being executed by the processor or controller 14, it being understood that the process 800 may alternatively or additionally be executed, in whole or in part, by one or more of the processors or controllers 26, 42, 62.

The process 800 illustratively begins at step 802 where the processor or controller 14 is operable to determine whether a Key Fob signal has been detected. Illustratively, the processor or controller 14 is operable to execute step 802 as described above with respect to step 702 of the process 700. Thus, the process 800 advances along the "YES" branch of step 802 only if the received Key Fob signal matches at least one stored Key Fob code, such that the process 800 proceeds from step 802 only for authorized users, i.e., only for users carrying a Key Fob 20 that is recognizable by the object detection system 10. It will be understood that some embodiments of the process 800 may not include step 802, and in such embodiments the process 800 begins at step 804.

Following the "YES" branch of step 802 (in embodiments which include step 802), the process 800 advances to step 804 where the processor or controller 14 is operable to monitor one or more of the vehicle operating parameter sensors and/or switches 50 mounted to or within or otherwise carried by the motor vehicle. Illustratively, signals produced by the one or more monitored sensors and/or the status(es) of the one or more switches monitored at step 804 are indicative of an operating condition or state, e.g., engine running or not, and/or of a moving condition or state of the motor vehicle, e.g., motor vehicle stationary, moving, enabled to move, etc. As described above with respect to FIG. 1, examples of such sensors and/or switches 50 may include, but are not limited to, an engine ignition sensor or sensing system, a vehicle speed sensor or sensing system, a transmission gear selector position sensor, sensing system or switch, a transmission gear position sensor, sensing system or switch, vehicle brake sensor, sensing system or switch, and the like. Those skilled in the art will recognize other sensors and/or switches from which an operating condition or state of the motor vehicle may be determined, implied or estimated and/or from which a moving condition or state of the motor vehicle may be determined, implied or estimated, and it will be understood that monitoring of any such other sensors and/or switches at step 804 is intended to fall within the scope of this disclosure.

Following step 804, the process 800 advances to step 806 where the processor or controller 14 is operable to determine a mode based on the monitored vehicle sensor(s) and/or switch(es). Generally, the mode determined by the processor or controller 14 at step 806 is a gesture access (GA) mode if the signal(s) produced by the monitored vehicle sensor(s) and/or the operational state(s) of the monitored switch(es) correspond to a state or condition of the motor vehicle conducive to gesture access operation of the system 10, and is an object impact avoidance (OIA) mode of signal(s) produced by the monitored vehicle sensor(s) and/or the operational state(s) of the monitored switch(es) correspond to a state or condition of the motor vehicle conducive to object impact avoidance operation of the system 10. In the former case, for example, the processor 14 may operate in the gesture access mode if the motor vehicle is stationary and disabled from moving, and in the latter case, for example, the processor 14 may operate in the object impact avoidance mode if the motor vehicle is moving or is enabled to move.

For purposes of this disclosure, the phrase "disabled from moving" should be understood to mean at least that the engine of the motor vehicle may or may not be running and, if the engine is running, that one or more actuators are preventing the motor vehicle from moving in the forward or reverse direction. In some embodiments, for example, an engine ignition switch in the "off" position means that the motor vehicle is disabled from moving, and the processor 14 may be operable at step 806 under such conditions to set mode=GA. In other example embodiments, an engine ignition switch in the "run" or "on" position means that the engine is running, and the processor 14 may be then operable at step 806 under such conditions to determine the status of one or more other vehicle operating parameters such as the transmission selection lever, the vehicle brakes and/or vehicle road speed. In some such embodiments, the processor 14 may be operable at step 806 when the engine is running to set mode=GA if, and as long as, the transmission selection lever is in "park" or otherwise not in a selectable gear (e.g., in the case of a manual transmission) and/or the vehicle brakes are engaged and/or the vehicle speed is zero. The phrase "enabled to move," on the other hand, should be understood to mean at least that the engine of the motor vehicle has been started, and in some embodiments the processor 14 may be operable at step 806 under conditions in which the engine ignition switch is in the "run" or "on" position to set mode=OIA. In some embodiments in which the processor or controller 14 has determined that the engine has been started, the processor 14 may then be further operable at step 806 to determine the status of at least one other vehicle operating parameter such as the transmission selection lever, the vehicle brakes or vehicle road speed. In some such embodiments, the processor 14 may be operable at step 806 when the engine is running to set mode=OIA if, and as long as, a drive gear (forward or reverse) of the motor vehicle transmission has been selected, and/or the vehicle brakes are disengaged and/or vehicle speed is greater than zero. Those skilled in the art will recognize other vehicle operating parameters which may be used alone, in combination with one or more of the above-described vehicle operating parameters and/or in combination with other vehicle operating parameters to determine when and whether the motor vehicle is disabled from moving or enabled to move, and it will be understood that any such other vehicle operating parameters are intended to fall within the scope of this disclosure. Moreover, those skilled in the art will recognize other vehicle operating conditions conducive to gesture access mode of operation or in which gesture access mode may be safely executed, and it will be understood that the processor or controller 14 may be alternatively configured to set mode=GA at step 806 according to any such other vehicle operating conditions. Further still, those skilled in the art will recognize other vehicle operating conditions conducive to object impact avoidance mode of operation or in which object impact avoidance mode may be safely executed, and it will be understood that the processor or controller 14 may be alternatively configured to set mode=OIA at step 806 according to any such other vehicle operating conditions. It will be appreciated that configuring the processor or controller 14 to set mode=GA or OIA based on any such other vehicle operating conditions will involve only mechanical steps for a skilled programmer.

If, at step 806, the processor or controller 14 has set mode=GA, the process 800 advances to step 808 to execute a GA control process. In some embodiments, the GA control process may be the process 700 illustrated in FIG. 35 and described above. As described above, the process 700 may be executed by or for object detection modules $\mathbf{12}_2$, i.e., having one or more illumination devices 112, and by or for object detection modules $\mathbf{12}_4$, i.e., which do not have any illumination devices 112. It will be understood, however, that the process 800 does not specifically require the GA control process 700 illustrated in FIG. 35, and that other gesture access control processes using a radiation emission and detection assembly 130 having at least one radar transmitter and a plurality of radar detectors may therefore be alternatively executed at step 808.

If, at step 806, the processor or controller 14 has set mode=OIA, the process 800 advances to step 810 to execute an OIA control process. An example of one such OIA process is illustrated in FIG. 37 and will be described with respect thereto, although it will be understood that the process 800 does not specifically require the OIA control process illustrated in FIG. 37, and that other object impact avoidance control processes using a radiation emission and detection assembly 130 having at least one radar transmitter and a plurality of radar detectors may therefore be alternatively executed at step 810. In any case, the process 800 illustratively loops back from either of steps 808 and 810 to step 804.

Referring now to FIG. 37, a simplified flowchart is shown of another process 900 for selectively providing for (i) gesture access to the motor vehicle, with or without visual feedback, under some operating conditions of the motor vehicle, and (ii) object impact avoidance under other operating conditions of the motor vehicle in or to which at least one object detection module 12 is mounted. As with the process 800 illustrated in FIG. 36, any such object detection module 12 will illustratively be implemented in the form of the object detection module $\mathbf{12}_2$ and/or the object detection module $\mathbf{12}_4$, either of which include the radiation emission and detection assembly 130 in the form of at least one radar transmitter 132 and a plurality of radar detectors or receivers or detectors 134. In one embodiment, the process 900 is illustratively stored in the at least one memory 16 of the object detection module 12 in the form of instructions which, when executed by the at least one processor or controller 14 of the object detection module 12, cause the at least one processor or controller 14 to execute the corresponding functions. It will be understood that in some alternate embodiments, such instructions may be stored, in whole or in part, in any one or more of the memory units illustrated in FIG. 1, e.g., in one or more of the memory 16 of the object detection module 12, the memory 28 of the vehicle control computer 24, the memory 44 of the actuator driver circuit(s) 40 and the memory 64 of the audio/illumination device driver circuit(s) 60, and provided to the at least one processor or controller 14 for execution thereby. In other alternate embodiments, such instructions, wherever stored, may be executed, in whole or in part, by any one or more of the processors or controllers illustrated in FIG. 1, e.g., by one or more of the processors or controllers 14, 26, 42 and 62. For purposes of the following description, the process 800 will be described as being executed by the processor or controller 14, it being understood that the process 900 may alternatively or additionally be executed, in whole or in part, by one or more of the processors or controllers 26, 42, 62.

The process 900 illustratively begins at step 902 where the processor or controller 14 is operable to determine whether a Key Fob signal has been detected. Illustratively, the processor or controller 14 is operable to execute step 902 as described above with respect to step 702 of the process 700. Thus, the process 900 advances along the "YES" branch of step 902 only if the received Key Fob signal matches at least one stored Key Fob code, such that the process 900 proceeds from step 902 only for authorized users, i.e., only for users carrying a Key Fob 20 that is recognizable by the object detection system 10. It will be understood that some embodiments of the process 900 may not include step 902, and in such embodiments the process 900 begins at steps 904 and 906.

Following the "YES" branch of step 902 (in embodiments which include step 902), the process 900 advances to steps 904 and 906. At step 904, the processor 14 is illustratively operable to execute a GA control process. In some embodiments, the GA control process may be the process 700 illustrated in FIG. 35 and described above. As described above, the process 700 may be executed by or for object detection modules $\mathbf{12}_2$, i.e., having one or more illumination devices 112, and by or for object detection modules $\mathbf{12}_4$, i.e., which do not have any illumination devices 112. It will be understood, however, that the process 900 does not specifically require the GA control process 700 illustrated in FIG. 35, and that other gesture access control processes using a radiation emission and detection assembly 130 having at least one radar transmitter and a plurality of radar detectors may therefore be alternatively executed at step 904.

At step 906, the processor or controller 14 is operable to determine, e.g., by monitoring the engine ignition switch included in the vehicle sensors/switches 50, whether the engine ignition status IGN is "on" or "running." If not, the process 900 loops back to the beginning of step 906. Thus, as long as the engine of the motor vehicle is not running, the processor or controller 14 will continue to execute the GA control process at step 904. If, however, the processor or controller 14 determines at step 906 that the engine ignition status IGN is "on" or "running," thus indicating that the engine of the motor vehicle has been started and is running, the process 900 advances to step 908 where the processor or controller 14 is operable to monitor one or more vehicle sensors and/or switches. Thereafter at step 910, the processor or controller 14 is operable to compare the signal(s) and/or state(s) of the monitored vehicle sensor(s) and/or switch(es) to gesture access (GA) and/or object detection (OD) conditions, and thereafter at step 912 the processor or controller 14 is operable to determine a mode as either gesture access (GA) or object impact avoidance (OIA) based on the comparison. Illustratively, the processor or controller 14 is operable to execute steps 908-912 as described above with respect to step 806 of the process 800.

Following step 912, the processor or controller 14 is illustratively operable to determine whether the mode determined at step 912 is GA or OIA. If GA, the process 900 loops back to the beginning of steps 904 and 906. Thus, with the engine running, as long as the vehicle operating parameters correspond to gesture access operating conditions, the processor or controller 14 will continue to execute the GA control process at step 904. However, if the processor or controller 14 determines at step 914 that the mode determined at step 912 is OIA, the process 900 advances to step 916 where the processor or controller 14 is operable to suspend execution of the GA control process executing at step 904 and to execute an object impact avoidance control process beginning at step 918.

Figure 6B:
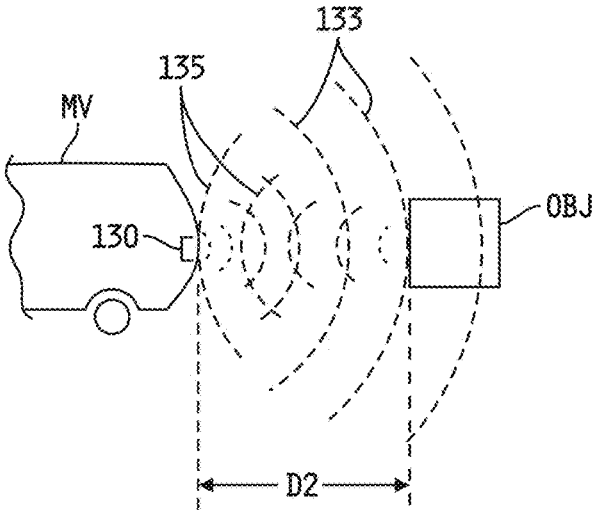
FIG. 6B is a simplified side elevational view of a portion of a motor vehicle having the object detection module of FIG. 6A mounted thereto and depicting an example distance range of object detection by the module.

At step 918, the processor or controller 14 is operable to monitor the object detection assembly; more specifically, to monitor the radiation emission and detection assembly 130 of the respective object detection module $\mathbf{12}_2$, $\mathbf{12}_4$ for object detection signals produced thereby, if any. Thereafter at step 920, the processor or controller 14 is operable to compare the object detection signal(s) produced by the assembly 130 to one or more object detection parameters (ODP) stored in the memory 16 (and/or stored in the memory 28, 44 or 64). In some embodiments, for example, the one or more stored ODPs is/are satisfied by an object detected anywhere within the distance D2 of the radiation emission and detection assembly 130 as illustrated in FIG. 6B and described above with respect thereto. In such embodiments, the detected object signal(s), when processed by the processor or controller 14 to determine a corresponding object detection value, thus matches at least one of the one or more stored ODPs.

Following step 920, the processor or controller 14 is operable at step 922 to determine whether the one or more stored ODPs has/have been satisfied. If so, the process 900 advances to step 924 where the processor or controller 14 is operable to control one or more of the actuator driver circuits 40 to control one or more corresponding actuators 48 to activate one or more corresponding object avoidance devices, mechanisms and/or systems 50 of the motor vehicle. Examples of such object avoidance devices, mechanisms and/or systems 50 may include, but are not limited to, one or more electronically controllable motor vehicle access closure latches or latching systems, an automatic (i.e., electronically controllable) engine ignition system, an automatic (i.e., electronically controllable) motor vehicle braking system, an automatic (i.e., electronically controllable) motor vehicle steering system, an automated (i.e., electronically controllable) motor vehicle driving system (e.g., "self-driving" or "autonomous driving" system), and the like. Thus, depending upon the location of the object detection module 12 on and relative to the motor vehicle, the processor or controller 14 may execute step 924 by locking one or more electronically controllable access closure latches or latching systems, by automatically turning off the engine ignition system, by activating an electrically controllable motor vehicle braking system to automatically apply braking force to stop or slow the motor vehicle, by controlling an automatic steering system so as to avoid impact with the detected object and/or by controlling an automated vehicle driving system so as to avoid impact with the detected object. Those skilled in the art will recognize other object impact avoidance devices, mechanisms and/or systems which may be controlled at step 924 to avoid or mitigate impact with the detected object, and it will be understood that any such other object impact avoidance devices, mechanism and/or systems are intended to fall within the scope of this disclosure. In any case, the process 900 illustratively loops from step 924 back to the beginning of step 918 so that the processor or controller 14 continues to execute the object impact avoidance control process of steps 918-924 as long as the one or more stored ODP conditions continue to be satisfied.

In some embodiments, the processor or controller 14 may be additionally operable at step 926 to control one or more audio and/or illumination driver circuits 60 to activate one or more corresponding audio devices and/or illumination devices 66. Examples of the one or more audio devices 66 which the processor or controller 14 may activate at step 926 may include, but are not limited to, a vehicle horn, one or more electronically controllable audible warning devices, e.g., in the form of one or more predefined alarm sounds, sequences or the like, one or more electronically controllable audio notification devices or systems, one or more electronically controllable audio voice messaging devices or systems, or the like. Examples of the one or more illumination devices 66 which the processor or controller 14 may activate at step 926 may include, but are not limited to, one or more electronically controllable visible warning devices, one or more exterior vehicle lights, one or more interior vehicle lights, or the like.

If at step 922, the processor or controller 14 determines that the one or more stored ODPs is/are not, or no longer, satisfied, the process 900 advances to step 926 where the processor or controller 14 is operable to control the one or more actuator driver circuits 40 to reset the corresponding one or more actuators 46 activated at step 924. If, at step 924, the process or controller 14 activated one or more audible and/or illumination devices 66, the processor or controller 14 is further operable at step 926 to reset or deactivate such one or more activated audible and/or illumination devices 66. Following step 926, the process 900 loops back to steps 904 and 906 where the processor or controller 14 is operable at step 904 to again execute the GA control process and at steps 906-914 to determine whether to continue to execute the GA control process or whether to again suspend the GA process and execute the OIA process of steps 918-924. It will be understood that if step 924 has not yet been executed prior to determining at step 922 that the ODPs is/are not satisfied, step 926 may be bypassed and the process 900 may proceed directly from the "NO" branch of step 922 to steps 904 and 906.

In some embodiments of the process 800 illustrated in FIG. 36, the OIA control process executed at step 810 thereof may be similar or identical to the OIA control process executed at steps 916-924 of the process 900. In other embodiments of the process 800, the OIA control process executed at step 810 may be or include other OIA control processes as described above.

EXAMPLES

In a first example, a gesture access system for a motor vehicle may comprise at least one radiation transmitter configured to be mounted to the motor vehicle and, when activated, to emit radiation outwardly away from the motor vehicle, at least one radiation receiver configured to be mounted to the motor vehicle and to produce radiation detection signals, the radiation detection signals including reflected radiation signals if the emitted radiation is reflected by an object toward and detected by the at least one radiation receiver, at least one illumination device configured to be mounted to the motor vehicle and, when activated, to produce light visible from outside the motor vehicle, at least one processor operatively coupled to the at least one radiation transmitter, to the at least one radiation receiver and to the at least one illumination device, and at least one memory having instructions stored therein which, when executed by the at least one processor, cause the at least one processor to activate the at least one radiation transmitter and to process the radiation detection signals to: determine whether an object is within a sensing region of the at least one radiation receiver, activate the at least one illumination device according to a first illumination scheme if the object is determined to be within the sensing region, determine whether the object within the sensing region exhibits a predefined gesture, and if the object within the sensing region is determined to exhibit the predefined gesture, activate the at least one illumination device according to a second illumination scheme different from the first illumination scheme, and control at least one actuator associated with an access closure of the motor vehicle to at least one of unlock the access closure from a locked condition, lock the access closure from an unlocked condition, open the access closure from a closed position and close the access closure from an open position.

A second example includes the subject matter of the first example, and wherein the instructions stored in the at least one memory may further include instructions which, when executed by the at least one processor, cause the at least one processor to: determine a sub-region of the sensing region occupied by the object if the object is determined to be within the sensing region, and activate the at least one illumination device according to a third illumination scheme, different from the first and second illumination schemes, if the sub-region occupied by the object is too small to allow determination of whether the object within the sensing region exhibits the predefined gesture.

A third example includes the subject matter of the first example or the second example, and wherein the at least one radiation transmitter may be configured to be mounted to the motor vehicle separately and remotely from the at least one radiation receiver.

A fourth example includes the subject matter of the first example or the second example, and wherein the at least one radiation transmitter and the at least one radiation receiver may together comprise a radiation emission and detection assembly configured to be mounted to the motor vehicle.

A fifth example includes the subject matter of any of the first example through the fourth example, and wherein the instructions stored in the at least one memory may further include instructions which, when executed by the at least one processor, cause the at least one processor to activate at least one of one or more auxiliary illumination devices and one or more audio devices on or within the motor vehicle if the object within the sensing region is determined to exhibit the predefined gesture.

A sixth example includes the subject matter of any of the first example through the fifth example, and wherein the at least one memory may have a key fob code stored therein, and wherein the instructions stored in the at least one memory may further include instructions which, when executed by the at least one processor, cause the at least one processor to receive a key fob signal wirelessly transmitted by a key fob within a key fob signal detection area of the motor vehicle, to determine a code based on the received key fob signal, and to activate the at least one radiation transmitter and process the radiation detection signals only if the determined code matches the stored key fob code.

A seventh example includes the subject matter of any of the first example through the sixth example, and wherein the at least one memory further may have at least a first vehicle access condition value stored therein corresponding to a first predefined gesture, and wherein the instructions stored in the at least one memory may further include instructions which, when executed by the at least one processor, cause the at least one processor to determine that the object within the sensing region exhibits the predefined gesture if the processed radiation detection signals match the at least the first vehicle access condition value stored in the at least one memory.

An eighth example includes the subject matter of the seventh example, and wherein the first vehicle access condition value may be associated in the at least one memory with a first key fob code, and the at least one memory may further have at least a second vehicle access condition value stored therein corresponding to a second predefined gesture and the second vehicle access condition value is associated in the at least one memory with a second key fob code different from the first key fob code, and wherein the instructions stored in the at least one memory may further include instructions which, when executed by the at least one processor, cause the at least one processor to receive a key fob signal wirelessly transmitted by a key fob within a key fob signal detection area of the motor vehicle, to determine a code based on the received key fob signal, and to determine that the object within the sensing region exhibits the predefined gesture if the processed radiation signals match the at least the stored first vehicle access condition value and the determined code matches the stored first key fob code or if the processed radiation signals match the at least the stored second vehicle access condition value and the determined code matches the stored second key fob code.

A ninth example includes the subject matter of any of the first example through the eighth example, and wherein the at least one illumination device may comprise at least one multi-color LED, and wherein the instructions stored in the at least one memory may further include instructions which, when executed by the at least one processor, cause the at least one processor to activate the at least one illumination device according to the first illumination scheme by controlling the at least one multi-color LED to emit visible light of a first color, and to activate the at least one illumination device according to the second illumination scheme by controlling the at least one multi-color LED to emit visible light of a second color different from the first color.

A tenth example includes the subject matter of the ninth example, and wherein the instructions stored in the at least one memory may further include instructions which, when executed by the at least one processor, cause the at least one processor to activate the at least one illumination device according to the third illumination scheme by controlling the at least one multi-color LED to emit visible light of a third color different from the first and second colors.

An eleventh example includes the subject matter of any of the first example through the tenth example, and wherein the instructions stored in the at least one memory may further include instructions which, when executed by the at least one processor, cause the at least one processor to activate the at least one illumination device according to the first illumination scheme by controlling the at least one illumination device to switch on and off with at least one of a first frequency and a first duty cycle, and to activate the at least one illumination device according to the second illumination scheme by controlling the at least one illumination device to switch on and off with at least one of a second frequency different from the first frequency and a second duty cycle different from the first duty cycle.

A twelfth example includes the subject matter of the eleventh example, and wherein the instructions stored in the at least one memory may further include instructions which, when executed by the at least one processor, cause the at least one processor to activate the at least one illumination device according to the third illumination scheme by controlling the at least one illumination device to switch on and off with at least one of a third frequency different from the first and second frequencies and a third duty cycle different from the first and second duty cycles.

A thirteenth example includes the subject matter of any of the first example through the twelfth example, and wherein the at least one illumination device may comprise a plurality of illumination devices, and wherein the instructions stored in the at least one memory may further include instructions which, when executed by the at least one processor, cause the at least one processor to activate the at least one illumination device according to the first illumination scheme by controlling at least a first one of the plurality of illumination devices to illuminate, and to activate the at least one illumination device according to the second illumination scheme by controlling at least a second one of the plurality of illumination devices, different from the at least the first one of the plurality of illumination devices, to illuminate.

A fourteenth example includes the subject matter of the thirteenth example, and wherein the instructions stored in the at least one memory may further include instructions which, when executed by the at least one processor, cause the at least one processor to activate the at least one illumination device according to the third illumination scheme by controlling at least a third one of the plurality of illumination devices, different from the at least the first one of the plurality of illumination devices and from the at least the second one of the plurality of illumination devices, to illuminate.

A fifteenth example includes the subject matter of any of the first example through the eighth example, and wherein the at least one illumination device may comprise a plurality of illumination devices each configured to selectively emit visible light in any of a plurality of colors, and wherein the instructions stored in the at least one memory may further include instructions which, when executed by the at least one processor, cause the at least one processor to activate the at least one illumination device according to the first illumination scheme by controlling one or more of the plurality of illumination sources to emit visible light of a first one of the plurality of colors, and to activate the at least one illumination device according to the second illumination scheme by controlling one or more of the plurality of illumination sources to emit visible light of a second one of the plurality of colors different from the first one of the plurality of colors.

A sixteenth example includes the subject matter of the fifteenth example, and wherein the instructions stored in the at least one memory may further include instructions which, when executed by the at least one processor, cause the at least one processor to activate the at least one illumination device according to the third illumination scheme by controlling one or more of the plurality of illumination sources to emit visible light of a third one of the plurality of colors different from the first one of the plurality of colors and from the second one of the plurality of colors.

A seventeenth example includes the subject matter of any of the first example through the eighth example, and wherein the at least one illumination device may comprise a plurality of illumination devices each configured to selectively emit visible light, and wherein the instructions stored in the at least one memory may further include instructions which, when executed by the at least one processor, cause the at least one processor to activate the at least one illumination device according to the first illumination scheme by controlling one or more of the plurality of illumination sources to switch on and off with at least one of a first frequency and a first duty cycle, and to activate the at least one illumination device according to the second illumination scheme by controlling one or more of the plurality of illumination sources to switch on and off with at least one of a second frequency different from the first frequency and a second duty cycle different from the first duty cycle.

An eighteenth example includes the subject matter of the seventeenth example, and wherein the instructions stored in the at least one memory may further include instructions which, when executed by the at least one processor, cause the at least one processor to activate the at least one illumination device according to the third illumination scheme by controlling one or more of the plurality of illumination sources to switch on and off with at least one of a third frequency different from the first and second frequencies and a third duty cycle different from the first and second duty cycles.

A nineteenth example includes the subject matter of any of the first example through the eighteenth example, and wherein the at least one illumination device may comprise two or more illumination devices spaced apart at least partially across the sensing region, and wherein the instructions stored in the at least one memory may include instructions which, when executed by the at least one processor, cause the at least one processor to activate according to at least one of the first, second and third illumination schemes at least one of the two or more illumination devices aligned with the portion of the sensing region occupied by the object.

A twentieth example includes the subject matter of the nineteenth example, and wherein the at least one radiation receiver may comprise two or more radiation sensors or receivers spaced apart at least partially across the sensing region, each of the two or more radiation sensors aligned with a corresponding one of the two or more illumination devices.

A twenty first example includes the subject matter of any of the first example through the twentieth example, and wherein the at least one radiation transmitter may comprise a plurality of infrared LEDs for emitting the radiation in the form of infrared radiation, and wherein the at least one radiation receiver may comprise a plurality of infrared radiation sensors.

A twenty second example includes the subject matter of the twenty first example, and wherein the plurality of infrared LEDs may be arranged as an array of the plurality of infrared LEDs, and wherein the plurality of infrared radiation sensors may be arranged as an array of the plurality of infrared radiation sensors.

A twenty third example includes the subject matter of the twenty second example, and wherein the array of infrared LEDs may be arranged to align with the array of infrared radiation sensors such that each infrared LED in the array of infrared LEDs is positioned adjacent to a corresponding one of the infrared radiation sensors in the array of infrared radiation sensors.

A twenty fourth example includes the subject matter of the twenty second example or the twenty third example, and wherein the at least one illumination device may comprise a plurality of illumination devices arranged as an array of the plurality of illumination devices, and wherein the array of illumination devices may be arranged to align with the array of infrared radiation sensors such that each illumination device in the array of illumination devices is positioned adjacent to a corresponding one of the infrared radiation sensors in the array of infrared radiation sensors.

A twenty fifth example includes the subject matter of any of the first example through the twentieth example, and wherein the at least one radiation transmitter may comprise at least one radar transmitter configured to emit radar signals when activated, and wherein the at least one radiation receiver may comprise at least one radar receiver configured to detect reflected radar signals and to produce the radar detection signals.

A twenty sixth example includes the subject matter of the twenty fifth example, and wherein the at least one radar receiver may comprise two or more radar receivers spaced apart at least partially across the sensing region.

A twenty seventh example includes the subject matter of the twenty fifth example or the twenty sixth example, and wherein the at least one illumination device may comprise two or more illumination devices spaced apart at least partially across the sensing region.

A twenty eighth example includes the subject matter of any of the first example through the twenty seventh example, and wherein the system may further comprise a housing for mounting to at least a portion of the motor vehicle, and wherein at least one of the at least one radiation transmitter and the at least one of the radiation receiver may be mounted to or within the housing, and wherein the at least one illumination device may be mounted to or within the housing, and wherein the access closure of the motor vehicle may comprise one of a front, rear and side access closure of the motor vehicle.

A twenty ninth example includes the subject matter of any of the first example through twenty seventh example, and wherein the system may further comprise a circuit substrate for mounting to at least a portion of the motor vehicle, and wherein at least one of the at least one radiation transmitter and the at least one of the radiation receiver may be operatively mounted to the circuit substrate, and wherein the access closure of the motor vehicle may comprise one of a front, rear and side access closure of the motor vehicle.

A thirtieth example includes the subject matter of the twenty ninth example, and wherein the at least one illumination device may be operatively mounted to the circuit substrate.

A thirty first example includes the subject matter of the twenty ninth example, and wherein the circuit substrate may comprise a first circuit substrate mounted to at least a first portion of the motor vehicle, and further may comprise a second circuit substrate for mounting to at least a second portion of the motor vehicle proximate to or remote from the first portion of the motor vehicle.

A thirty second example includes the subject matter of any of the first example through the twenty seventh example, and wherein the system may further comprise a license plate bracket having a housing for mounting to the motor vehicle and supporting a license plate against the motor vehicle, and wherein the at least one radiation transmitter and the at least one radiation receiver may be mounted to or within the housing, and wherein at least one of the plurality of illumination devices may be mounted to or within the housing, and wherein the access closure of the motor vehicle may comprise a rear access closure of the motor vehicle.

A thirty third example includes the subject matter of the thirty second example, and wherein the at least one actuator may comprise at least one of a latch for releasably securing the rear access closure in a closed position, a locking device for locking and unlocking the rear access closure in its closed position and at least one motor for opening and closing the rear access closure.

A thirty fourth example includes the subject matter of the thirty second example or the thirty third example, and wherein the rear access closure may be one of a rear hatch door and a trunk lid of the motor vehicle.

A thirty fifth example includes the subject matter of any of the first example through the twenty seventh example, and wherein the access closure may comprise an access door of the motor vehicle, and wherein the system may further comprise a handle assembly mountable to the access door, the handle assembly including a housing, and wherein the at least one radiation transmitter and the at least one radiation receiver may be mounted to or within the housing, and wherein at least one of the plurality of illumination devices may be mounted to or within the housing.

In a thirty sixth example, a gesture access system for a motor vehicle, may comprise a housing configured to be mounted to a motor vehicle adjacent to a first door of the motor vehicle and aligned with a vertically oriented seam defined between the first door and one of a second door of the motor vehicle adjacent to the first door and a stationary exterior member of the motor vehicle adjacent to the first door, the housing recessed within the motor vehicle relative to an outer surface of the first door, a radiation assembly carried by the housing, the radiation assembly including at least one radiation transmitter configured, when activated, to emit radiation outwardly through the vertically oriented seam, and at least one radiation receiver configured to produce radiation detection signals, the radiation detection signals including reflected radiation signals if the emitted radiation is reflected by an object back inwardly through the vertically oriented seam and detected by the at least one radiation receiver, at least one processor operatively connected to the radiation assembly, and at least one memory having instructions stored therein which, when executed by the at least one processor, cause the at least one processor to activate the at least one radiation transmitter and to process the radiation detection signals to: determine whether an object is within a sensing region of the radiation assembly opposite the vertically-oriented seam and, if so, whether the object exhibits a predefined gesture while within the sensing region, and if the object exhibits the predefined gesture while within the sensing region of the radiation assembly, control at least one actuator associated with the first door to at least one of unlock the first door from a locked condition, lock the first door from an unlocked condition and at least partially open the first door from a closed position.

A thirty seventh example includes the subject matter of the thirty sixth example, and wherein the at least one radiation transmitter may comprise an array of infrared LEDs each configured to emit infrared radiation when activated, and wherein the at least one radiation receiver may comprise an array of infrared radiation sensors each configured to detect reflected infrared radiation and produce corresponding radiation signals, and wherein the array of infrared radiation-emitted LEDs and the array of infrared radiation sensors may each be arranged vertically relative to the housing and aligned with the vertically-oriented seam.

A thirty eighth example includes the subject matter of the thirty sixth example, and wherein the at least one radiation transmitter may comprise at least one radar transmitter configured to emit radar signals when activated, and wherein the at least one radiation receiver may comprise at least one radar receiver configured to detect reflected radar signals and to produce the radar detection signals, and wherein the at least one radar transmitter and the at least one radar receiver may each be arranged relative to the housing to be aligned with the vertically-oriented seam.

A thirty ninth example includes the subject matter of any of the thirty sixth example through the thirty eighth example, and wherein the system may further comprise a recess or pocket provided along an inside edge of the first door, the recess or pocket dimensioned to receive two or more fingers of a human hand in order to facilitate opening the first door, and wherein the at least one processor may be operable to control the at least one actuator associated with the first door to at least partially open the first door sufficiently to allow the two or more fingers of a human hand to access and engage the recess or pocket.

A fortieth example includes the subject matter of any of the thirty sixth example through the thirty ninth example, and wherein the system may further comprise at least one illumination device configured to produce visible light, the at least one illumination device mounted to or within the housing and arranged relative to the housing to emit the visible light outwardly away from the motor vehicle through the vertically-oriented seam, and wherein the instructions stored in the at least one memory may further include instructions which, when executed by the at least one processor, cause the at least one processor to activate the at least one illumination device according to a first illumination scheme when the object is within the sensing region of the radiation assembly and to activate the at least one illumination device according to a second illumination scheme, different from the first illumination scheme, if the object exhibits the predefined gesture while within the sensing region of the radiation assembly.

A forty first example includes the subject matter of any of the thirty sixth example through the fortieth example, and wherein the at least one memory may have a key fob code stored therein, and wherein the instructions stored in the at least one memory may further include instructions which, when executed by the at least one processor, cause the at least one processor to receive a key fob signal wirelessly transmitted by a key fob within a key fob signal detection area of the motor vehicle, to determine a code based on the received key fob signal, and to activate the at least one radiation transmitter and process the radiation detection signals only if the determined code matches the stored key fob code.

In a forty second example, a gesture access and object impact avoidance system for a motor vehicle may comprise at least one radar signal transmitter configured to be mounted to the motor vehicle and, when activated, to emit radar signals, at least one radar signal receiver configured to be mounted to the motor vehicle and to produce radar detection signals, the radar detection signals including at least one reflected radar signal if at least one of the emitted radar signals is reflected by an object toward and detected by the at least one radar signal receiver, at least one processor operatively connected to the at least one radar signal transmitter and to the at least one radar signal receiver, and configured to activate the at least one radar signal transmitter, and at least one memory having instructions stored therein which, when executed by the at least one processor, cause the at least one processor to: monitor at least one vehicle operating parameter signal produced by at least one vehicle operating parameter sensor or switch, if the monitored at least one vehicle operating parameter signal satisfies a first vehicle operating condition, operate in a gesture access mode by monitoring the radar detection signals to determine whether an object is within a sensing region of the at least one radar signal receiver and, if so, controlling at least one actuator associated with an access closure of the motor vehicle to lock, unlock, open or close the access closure if the object within the sensing region exhibits a predefined gesture, and if the at least one vehicle operating parameter sensor signal satisfies a second vehicle operating condition different from the first vehicle operating condition, operate in an object impact avoidance mode by monitoring the radar detection signals to determine whether an object is within a predefined distance of the at least one radar signal receiver and, if so, at least one of activating at least one warning device and controlling at least one actuator associated with at least one impact avoidance device of the motor vehicle.

A forty third example includes the subject matter of the forty second example, and wherein the at least one radar signal transmitter and the at least one radar signal receiver may be provided together in the form of a radar signal transceiver module configured to be mounted to the motor vehicle.

A forty fourth example includes the subject matter of the forty second example or the forty third example, and wherein the system may further comprise a housing configured to be mounted to the motor vehicle, and wherein the at least one radar signal transmitter and the at least one radar signal receiver may be mounted together to or within the housing.

A forty fifth example includes the subject matter of any of the forty second example through the forty fourth example, and wherein the at least one radar signal receiver may comprise a plurality of radar signal receivers spaced apart at least partially across the sensing region.

A forty sixth example includes the subject matter of any of the forty second example through the forty fifth example, and wherein the system may further comprise at least one illumination device configured to be mounted to the motor vehicle and, when activated, to produce visible light, and wherein the instructions stored in the at least one memory may further include instructions which, when executed by the at least one processor, cause the at least one processor, when operating in the gesture access mode, to activate the at least one illumination device according to a first illumination scheme if the object is determined to be within the sensing region of the radar signal receiver, and to activate the at least one illumination device according to a second illumination scheme, different from the first illumination scheme, if the object within the sensing region exhibits the predefined gesture.

A forty seventh example includes the subject matter of the forty sixth example, and wherein the instructions stored in the at least one memory may further include instructions which, when executed by the at least one processor, cause the at least one processor, when operating in the gesture access mode, to process the at least one at least one radar detection signal to determine a sub-region of the sensing region occupied by the object if the object is determined to be within the sensing region of the at least one radar signal receiver, and to activate the at least one illumination device according to a third illumination scheme, different from the first illumination scheme and the second illumination scheme, if the sub-region occupied by the object is too small to allow determination of whether the object within the sensing region exhibits the predefined gesture.

A forty eighth example includes the subject matter of the forty sixth example or the forty seventh example, and wherein at least one illumination device may be configured to produce the visible light in each of at least first and second different colors, and wherein the instructions stored in the at least one memory may further include instructions which, when executed by the at least one processor, cause the at least one processor to activate the at least one illumination device according to the first and second illumination schemes by controlling the at least one illumination device to produce the visible light in the first and second respective colors.

A forty ninth example includes the subject matter of the forty eighth example, and wherein at least one illumination device may be further configured to produce the visible light in a third color different from the first and second colors, and wherein the instructions stored in the at least one memory may further include instructions which, when executed by the at least one processor, cause the at least one processor to activate the at least one illumination device according to the third illumination scheme by controlling the at least one illumination device to produce the visible light in the third color.

A fiftieth example includes the subject matter of any of the forty sixth example through the forty ninth example, and wherein the instructions stored in the at least one memory may further include instructions which, when executed by the at least one processor, cause the at least one processor, when operating in the gesture access mode, to activate the at least one illumination device according to the first illumination scheme by controlling the at least one illumination device to switch on and off with at least one of a first frequency and a first duty cycle, and to activate the at least one illumination device according to the second illumination scheme by controlling the at least one illumination device to switch on and off with at least one of a second frequency and a second duty cycle, the second frequency different from the first frequency and the second duty cycle different from the first duty cycle.

A fifty first example includes the subject matter of the fiftieth example, and wherein the instructions stored in the at least one memory may further include instructions which, when executed by the at least one processor, cause the at least one processor, when operating in the gesture access mode, to activate the at least one illumination device according to the third illumination scheme by controlling the at least one illumination device to switch on and off with at least one of a third frequency and a third duty cycle, the third frequency different from the first and second frequencies and the third duty cycle different from the first and second duty cycles.

A fifty second example includes the subject matter of any of the forty sixth example through the fifty first example, and wherein the at least one illumination device may comprise a plurality of illumination devices spaced apart at least partially across the sensing region.

A fifty third example includes the subject matter of the fifty second example, and wherein the instructions stored in the at least one memory may further include instructions which, when executed by the at least one processor, cause the at least one processor, when operating in the gesture access mode, to activate the at least one illumination device according to the first illumination scheme by controlling at least a first one of the plurality of illumination devices to illuminate, and to activate the at least one illumination device according to the second illumination scheme by controlling at least a second one of the plurality of illumination devices, different from the first one of the plurality of illumination devices, to illuminate.

A fifty fourth example includes the subject matter of the forty second example through the fifty third example, wherein the at least one memory may have a key fob code stored therein, and wherein the instructions stored in the at least one memory may further include instructions which, when executed by the at least one processor, cause the at least one processor to receive a key fob signal wirelessly transmitted by a key fob within a key fob signal detection area of the motor vehicle, to determine a code based on the received key fob signal, and to activate the at least one radar transmitter and process the radar detection signals only if the determined code matches the stored key fob code.

A fifty fifth example includes the subject matter of any of the forty second example through the fifty third example, and wherein the at least one memory may further have at least a first vehicle access condition value stored therein corresponding to a first predefined gesture, and wherein the instructions stored in the at least one memory may further include instructions which, when executed by the at least one processor, cause the at least one processor to determine that the object within the sensing region exhibits the predefined gesture if the processed radar detection signals match the at least the first vehicle access condition value stored in the at least one memory.

A fifth sixth example includes the subject matter of the fifty fifth example, and wherein the first vehicle access condition value may be associated in the at least one memory with a first key fob code, and the at least one memory may further have at least a second vehicle access condition value stored therein corresponding to a second predefined gesture and the second vehicle access condition value may be associated in the at least one memory with a second key fob code different from the first key fob code, and wherein the instructions stored in the at least one memory may further include instructions which, when executed by the at least one processor, cause the at least one processor to receive a key fob signal wirelessly transmitted by a key fob within a key fob signal detection area of the motor vehicle, to determine a code based on the received key fob signal, and to determine that the object within the sensing region exhibits the predefined gesture if the processed radar signals match the at least the stored first vehicle access condition value and the determined code matches the stored first key fob code or if the processed radar signals match the at least the stored second vehicle access condition value and the determined code matches the stored second key fob code.

A fifty seventh example includes the subject matter of any of the forty second example through the fifty sixth example, wherein the at least one warning device may comprise at least one of one or more illuminating devices and one or more audible sound producing devices.

A fifty eighth example includes the subject matter of any of the forty second example through the fifty seventh example, and wherein the at least one impact avoidance device of the motor vehicle may comprise at least one of an electronically controllable motor vehicle braking system, an electronically controllable motor vehicle steering system and an electronically controllable locking system for selectively locking at least one access closure of the motor vehicle.

A fifty ninth example includes the subject matter of any of the forty second example through the fifty eighth example, and wherein the at least one vehicle operating parameter sensor or switch may comprise at least one of an ignition switch, a transmission gear position sensor and a vehicle speed sensor.

In a sixtieth example, a gesture access and object impact avoidance system for a motor vehicle may comprise at least one radar signal transmitter configured to be mounted to the motor vehicle and, when activated, to emit radar signals, at least one radar signal receiver configured to be mounted to the motor vehicle and to produce radar detection signals, the radar detection signals including at least one reflected radar signal if at least one of the emitted radar signals is reflected by an object toward and detected by the at least one radar signal receiver, at least one processor operatively connected to the at least one radar transmitter and the at least one radar receiver, the at least one processor configured to activate the at least one radar signal transmitter and to be operable in either of (i) a gesture access mode to control an actuator associated with an access closure of the motor vehicle to lock, unlock, open or close the access closure if an object within a sensing region of the at least one radar signal receiver exhibits a predefined gesture, and (ii) an object impact avoidance mode to activate a warning device or control an actuator associated with an impact avoidance device of the motor vehicle if an object is within a predefined distance of the at least one radar signal receiver, and at least one memory having instructions stored therein which, when executed by the at least one processor, cause the at least one processor to operate in the gesture access mode if the motor vehicle is disabled from moving, and to operate in the object impact avoidance mode if the motor vehicle is moving or enabled to move.

A sixty first example includes the subject matter of the sixtieth example, and wherein the at least one memory may have a key fob code stored therein, and wherein the instructions stored in the at least one memory may further include instructions which, when executed by the at least one processor, cause the at least one processor to receive a key fob signal wirelessly transmitted by a key fob within a key fob signal detection area of the motor vehicle, to determine a code based on the received key fob signal, and operate in the gesture access mode only if the determined code matches the stored key fob code.

A sixty second example includes the subject matter of the sixtieth example or the sixty first example, and wherein the at least one radar signal transmitter and the at least one radar signal receiver may be provided together in the form of a radar signal transceiver module configured to be mounted to the motor vehicle.

A sixty third example includes the subject matter of any of the sixtieth example through the sixty second example, wherein the system may further comprise a housing configured to be mounted to the motor vehicle, and wherein the at least one radar signal transmitter and the at least one radar signal receiver may be mounted together to or within the housing.

A sixty fourth example includes the subject matter of any of the sixtieth example through the sixty third example, and wherein the at least one radar signal receiver may comprise a plurality of radar signal receivers spaced apart at least partially across the sensing region.

A sixty fifth example includes the subject matter of any of the sixtieth example through the sixty fourth example, and wherein the system may further comprise at least one illumination device configured to be mounted to the motor vehicle and further configured, when activated, to produce visible light, and wherein the instructions stored in the at least one memory may further include instructions which, when executed by the at least one processor, cause the at least one processor, when operating in the gesture access mode, to activate the at least one illumination device according to a first illumination scheme if the object is determined to be within the sensing region of the at least one radar signal receiver, and to activate the at least one illumination device according to a second illumination scheme, different from the first illumination scheme, if the object within the sensing region exhibits the predefined gesture.

A sixty sixth example includes the subject matter of the sixty second example, and wherein the instructions stored in the at least one memory may further include instructions which, when executed by the at least one processor, cause the at least one processor, when operating in the gesture access mode, to process the radar detection signals to determine a sub-region of the sensing region occupied by the object if the object is determined to be within the sensing region of the at least one radar signal receiver, and to activate the at least one illumination device according to a third illumination scheme, different from the first illumination scheme and the second illumination scheme, if the sub-region occupied by the object is too small to allow determination of whether the object within the sensing region exhibits the predefined gesture.

A sixty seventh example includes the subject matter of the sixty fifth example or the sixty sixth example, and wherein the at least one illumination device may comprise a plurality of illumination devices spaced apart at least partially across the sensing region.

A sixty eighth example includes the subject matter of any of the sixtieth example through the sixty seventh example, and wherein the at least one warning device may comprise at least one of one or more illuminating devices and one or more audible sound producing devices.

A sixty ninth example includes the subject matter of any of the sixtieth example through the sixty eighth example, and wherein the at least one impact avoidance device of the motor vehicle may comprise at least one of an electronically controllable motor vehicle braking system, an electronically controllable motor vehicle steering system and an electronically controllable locking system for selectively locking at least one access closure of the motor vehicle.

A seventieth example includes the subject matter of any of the sixtieth example through the sixty ninth example, and wherein the instructions stored in the at least one memory may further include instructions which, when executed by the at least one processor, cause the at least one processor to monitor at least one vehicle operating parameter signal produced by at least one vehicle operating parameter sensor or switch, and to determine whether the motor vehicle is disabled from moving, is moving or is enabled to move based on the at least one vehicle operating parameter signal.

A seventy first example includes the subject matter of the seventieth example, and wherein the at least one vehicle operating parameter sensor or switch may comprise at least one of an ignition switch, a transmission gear position sensor and a vehicle speed sensor.

In a seventy second example, a method is provided for processing reflected radar signals produced by at least one radar signal receiver mounted to a motor vehicle, the reflected radar signals including at least one radar signal transmitted by at least one radar signal transmitter, also mounted to the motor vehicle, and reflected by an object toward and detected by the at least one radar signal receiver. In this seventy second example, the method may comprise monitoring, with at least one processor, at least one vehicle operating parameter signal produced by at least one vehicle operating parameter sensor or switch carried by the motor vehicle, if the monitored at least one vehicle operating parameter signal satisfies a first vehicle operating condition, operating in a gesture access mode by processing the reflected radar signals with the at least one processor to determine whether an object is within a sensing region of the at least one radar signal receiver and, if so, controlling at least one actuator associated with an access closure of the motor vehicle with the at least one processor to lock, unlock, open or close the access closure if the object within the sensing region exhibits a predefined gesture, and if the at least one vehicle operating parameter sensor signal satisfies a second vehicle operating condition different from the first vehicle operating condition, operating in an object impact avoidance mode by processing the reflected radar signals with the at least one processor to determine whether an object is within a predefined distance of the at least one radar signal receiver and, if so, at least one of activating at least one warning device with the at least one processor and controlling at least one actuator associated with at least one impact avoidance device of the motor vehicle with the at least one processor.

In a seventy third example, a method is provided for processing reflected radar signals produced by at least one radar signal receiver mounted to a motor vehicle, the reflected radar signals including at least one radar signal transmitted by at least one radar signal transmitter, also mounted to the motor vehicle, and reflected by an object toward and detected by the at least one radar signal receiver. In this seventy third example, the method may comprise monitoring, with at least one processor, at least one vehicle operating parameter signal produced by at least one vehicle operating parameter sensor or switch carried by the motor vehicle, determining, with the at least one processor, whether the motor vehicle is moving or enabled to move based on the at least one vehicle operating parameter signal, if the motor vehicle is determined by the processor to be moving or enabled to move, operating in an object impact avoidance mode by processing the reflected radar signals with the at least one processor to determine whether an object is within a predefined distance of the at least one radar signal receiver and, if so, at least one of activating, with the at least one processor, at least one warning device and controlling, with the at least one processor, at least one actuator associated with an impact avoidance device of the motor vehicle to activate the at least one impact avoidance device, and otherwise operating in a gesture access mode by processing the reflected radar signals with the at least one processor to determine whether an object is within a sensing region of the at least one radar signal receiver and, if so, controlling at least one actuator associated with an access closure of the motor vehicle with the at least one processor to at lock, unlock, open or close the access closure if the object within the sensing region exhibits a predefined gesture.

While this disclosure has been illustrated and described in detail in the foregoing drawings and description, the same is to be considered as illustrative and not restrictive in character, it being understood that only illustrative embodiments thereof have been shown and described and that all changes and modifications that come within the spirit of this disclosure are desired to be protected. For example, while some embodiments are illustrated in the attached drawings and described above as including at least one illumination device 112 for providing visual feedback during gesture access operation, any of the object detection modules 12 which include at least one illumination device 112 may alternatively include at least one audible device responsive to at least one control signal to produce at least one audible signal. In some such embodiments, at least one audible device may be configured to produce sounds of different volumes and/or frequencies. In other such embodiments, two or more audible devices may be included, each producing sound with a different volume and/or frequency. In any such embodiments, the at least one audible device may be controlled to switch on and off with a predefined frequency and/or duty cycle. In some such embodiments which include multiple audible devices, at least two of the multiple audible devices may be controlled to switch on and off with different frequencies and/or duty cycles. Obviously, many modifications and variations of this disclosure are possible in light of the above teachings, and it is to be understood that the various features described herein may be practiced in any combination whether or not specifically recited in the appended claims.

What is claimed is:

1. A gesture access and object impact avoidance system for a motor vehicle, comprising:

at least one radar signal transmitter configured to be mounted to the motor vehicle and responsive to activation thereof to emit radar signals, at least one radar signal receiver configured to be mounted to the motor vehicle and to produce radar detection signals, the radar detection signals including at least one reflected radar signal in response to detection by the at least one radar signal receiver of at least one of the emitted radar signals reflected by an object toward the at least one radar signal receiver, at least one processor operatively connected to the at least one radar transmitter and the at least one radar receiver, the at least one processor programmed to activate the at least one radar signal transmitter and to be operable in either of (i) a gesture access mode to control an actuator associated with an access closure of the motor vehicle to lock, unlock, open or close the access closure in response to an object within a sensing region of the at least one radar signal receiver exhibiting a predefined gesture, and (ii) an object impact avoidance mode to activate a warning device or control an actuator associated with an impact avoidance device of the motor vehicle in response to an object being within a predefined distance of the at least one radar signal receiver, and at least one memory having instructions stored therein executable by the at least one processor to cause the at least one processor to be responsive to the motor vehicle disabled from moving to operate in the gesture access mode, and to be responsive to the motor vehicle moving or enabled to move to operate in the object impact avoidance mode.

2. The gesture access and object impact avoidance system of claim 1, wherein the at least one memory has a key fob code stored therein, and wherein the instructions stored in the at least one memory further include instructions executable by the at least one processor to cause the at least one processor to receive a key fob signal wirelessly transmitted by a key fob within a key fob signal detection area of the motor vehicle, to determine a code based on the received key fob signal, and operate in the gesture access mode only in response to the determined code matching the stored key fob code.

3. The gesture access and object impact avoidance system of claim 1, wherein the at least one radar signal transmitter and the at least one radar signal receiver are provided together in the form of a radar signal transceiver module configured to be mounted to the motor vehicle.

4. The gesture access and object impact avoidance system of claim 1, further comprising a housing configured to be mounted to the motor vehicle, wherein the at least one radar signal transmitter and the at least one radar signal receiver are mounted together to or within the housing.

5. The gesture access and object impact avoidance system of claim 1, wherein the at least one radar signal receiver comprises a plurality of radar signal receivers spaced apart across the sensing region.

6. The gesture access and object impact avoidance system of claim 1, further comprising at least one illumination device configured to be mounted to the motor vehicle and responsive to activation thereof to produce visible light, wherein the instructions stored in the at least one memory further include instructions executable by the at least one processor to cause the at least one processor operating in the gesture access mode to activate the at least one illumination device according to a first illumination scheme in response to determining the object to be within the sensing region of the at least one radar signal receiver, and to activate the at least one illumination device according to a second illumination scheme, different from the first illumination scheme, in response to the object within the sensing region exhibiting the predefined gesture.

7. The gesture access and object impact avoidance system of claim 6, wherein the instructions stored in the at least one memory further include instructions executable by the at least one processor to cause the at least one processor operating in the gesture access mode to process the radar detection signals to determine a sub-region of the sensing region occupied by the object determined to be within the sensing region of the at least one radar signal receiver, and to activate the at least one illumination device according to a third illumination scheme, different from the first illumination scheme and the second illumination scheme, upon determining that the sub-region occupied by the object is too small to allow determination of whether the object within the sensing region exhibits the predefined gesture.

8. The gesture access and object impact avoidance system of claim 6, wherein the at least one illumination device comprises a plurality of illumination devices spaced apart across the sensing region.

9. The gesture access and object impact avoidance system of claim 1, wherein the at least one warning device comprises at least one of one or more illuminating devices and one or more audible sound producing devices.

10. The gesture access and object impact avoidance system of claim 1, wherein the at least one impact avoidance device of the motor vehicle comprises at least one of an electronically controllable vehicle braking system, an electronically controllable vehicle steering system and an electronically controllable locking system for selectively locking at least one access closure of the motor vehicle.

11. The gesture access and object impact avoidance system of claim 1, wherein the instructions stored in the at least one memory further include instructions executable by the at least one processor to cause the at least one processor to monitor at least one vehicle operating parameter signal produced by at least one vehicle operating parameter sensor or switch, and to determine whether the motor vehicle is disabled from moving, is moving or is enabled to move based on the at least one vehicle operating parameter signal.

12. The gesture access and object impact avoidance system of claim 11, wherein the at least one vehicle operating parameter sensor or switch comprises at least one of an ignition switch, a transmission gear position sensor and a vehicle speed sensor.

13. A gesture access and object impact avoidance system for a motor vehicle, comprising:

at least one radar signal transmitter configured to be mounted to the motor vehicle and responsive to activation thereof to emit radar signals, at least one radar signal receiver configured to be mounted to the motor vehicle and to produce radar detection signals, the radar detection signals including at least one reflected radar signal in response to detection by the at least one radar receiver of at least one of the emitted radar signals reflected by an object toward the at least one radar signal receiver, at least one processor operatively connected to the at least one radar signal transmitter and to the at least one radar signal receiver, and configured to activate the at least one radar signal transmitter, and at least one memory having instructions stored therein executable by the at least one processor to cause the at least one processor to:

monitor at least one vehicle operating parameter signal produced by at least one vehicle operating parameter sensor or switch, in response to the monitored at least one vehicle operating parameter signal satisfying a first vehicle operating condition, operate in a gesture access mode by monitoring the radar detection signals to determine whether an object is within a sensing region of the at least one radar signal receiver and, upon determining that an object is within the sensing region, controlling at least one actuator associated with an access closure of the motor vehicle to lock, unlock, open or close the access closure in response to the object within the sensing region exhibiting a predefined gesture, and in response to the at least one vehicle operating parameter sensor signal satisfying a second vehicle operating condition different from the first vehicle operating condition, operate in an object impact avoidance mode by monitoring the radar detection signals to determine whether an object is within a predefined distance of the at least one radar signal receiver and, upon determining that an object is within the predefined distance of the at least one radar signal receiver, at least one of activating at least one warning device and controlling at least one actuator associated with at least one impact avoidance device of the motor vehicle.

14. The gesture access and object impact avoidance system of claim 13, further comprising at least one illumination device configured to be mounted to the motor vehicle and responsive to activation thereof to produce visible light, wherein the instructions stored in the at least one memory further include instructions executable by the at least one processor to cause the at least one processor operating in the gesture access mode to activate the at least one illumination device according to a first illumination scheme upon determining that the object is within the sensing region of the at least one radar signal receiver, and to activate the at least one illumination device according to a second illumination scheme, different from the first illumination scheme, in response to the object within the sensing region exhibiting the predefined gesture.

15. The gesture access and object impact avoidance system of claim 14, wherein the instructions stored in the at least one memory further include instructions executable by the at least one processor to cause the at least one processor operating in the gesture access mode with the object within the sensing region of the at least one radar signal receiver to process the at least one radar detection signal to determine a sub-region of the sensing region occupied by the object, and to activate the at least one illumination device according to a third illumination scheme, different from the first illumination scheme and the second illumination scheme, upon determining that the sub-region occupied by the object is too small to allow determination of whether the object within the sensing region exhibits the predefined gesture.

16. The gesture access and object impact avoidance system of claim 15, wherein the instructions stored in the at least one memory further include instructions executable by the at least one processor to cause the at least one processor operating in the gesture access mode to activate the at least one illumination device according to the first illumination scheme by controlling the at least one illumination device to switch on and off with at least one of a first frequency and a first duty cycle, and to activate the at least one illumination device according to the second illumination scheme by controlling the at least one illumination device to switch on and off with at least one of a second frequency different from the first frequency and a second duty cycle different from the first duty cycle.

17. The gesture access and object impact avoidance system of claim 14, wherein the at least one illumination device is configured to produce the visible light in each of at least first and second different colors, and wherein the instructions stored in the at least one memory further include instructions executable by the at least one processor to cause the at least one processor to activate the at least one illumination device according to the first and second illumination schemes by controlling the at least one illumination device to produce the visible light in the first and second respective colors.

18. The gesture access and object impact avoidance system of claim 14, wherein the at least one illumination device comprises a plurality of illumination devices spaced apart across the sensing region.

19. The gesture access and object impact avoidance system of claim 18, wherein the instructions stored in the at least one memory further include instructions executable by the at least one processor to cause the at least one processor operating in the gesture access mode to activate the at least one illumination device according to the first illumination scheme by controlling at least a first one of the plurality of illumination devices to illuminate, and to activate the at least one illumination device according to the second illumination scheme by controlling at least a second one of the plurality of illumination devices, different from the first one of the plurality of illumination devices, to illuminate.

20. A method of processing reflected radar signals produced by at least one radar signal receiver mounted to a motor vehicle, the reflected radar signals including at least one radar signal transmitted by at least one radar signal transmitter, also mounted to the motor vehicle, and reflected by an object toward and detected by the at least one radar signal receiver, the method comprising:

monitoring, with at least one processor, at least one vehicle operating parameter signal produced by at least one vehicle operating parameter sensor or switch carried by the motor vehicle, in response to the monitored at least one vehicle operating parameter signal satisfying a first vehicle operating condition, operating in a gesture access mode by processing the reflected radar signals with the at least one processor to determine whether an object is within a sensing region of the at least one radar signal receiver and, upon determining that an object is within the sensing region, controlling at least one actuator associated with an access closure of the motor vehicle with the at least one processor to lock, unlock, open or close the access closure in response to the object within the sensing region exhibiting a predefined gesture, and in response to the at least one vehicle operating parameter sensor signal satisfying a second vehicle operating condition different from the first vehicle operating condition, operating in an object impact avoidance mode by processing the reflected radar signals with the at least one processor to determine whether an object is within a predefined distance of the at least one radar signal receiver and, upon determining that an object is within the predefined distance of the at least one radar signal receiver, at least one of activating at least one warning device with the at least one processor and controlling at least one actuator associated with at least one impact avoidance device of the motor vehicle with the at least one processor.

* * * * *